US011830466B2

(12) United States Patent
Beasley

(10) Patent No.: US 11,830,466 B2
(45) Date of Patent: Nov. 28, 2023

(54) SYSTEM AND METHOD FOR GENERATING HARMONIOUS COLOR SETS FROM MUSICAL INTERVAL DATA

(71) Applicant: James K. Beasley, Tulunga, CA (US)

(72) Inventor: James K. Beasley, Tulunga, CA (US)

( * ) Notice: Subject to any disclaimer, the term of this patent is extended or adjusted under 35 U.S.C. 154(b) by 9 days.

(21) Appl. No.: 17/979,282

(22) Filed: Nov. 2, 2022

(65) Prior Publication Data

US 2023/0096679 A1 Mar. 30, 2023

Related U.S. Application Data

(62) Division of application No. 16/784,220, filed on Feb. 6, 2020, now Pat. No. 11,532,293.

(51) Int. Cl.
*G10H 1/36* (2006.01)
*G10H 1/00* (2006.01)

(52) U.S. Cl.
CPC ..... *G10H 1/368* (2013.01); *G10H 1/0025* (2013.01); *G10H 1/366* (2013.01); *G10H 2220/005* (2013.01); *G10H 2220/021* (2013.01)

(58) Field of Classification Search
CPC ..... G10H 1/368; G10H 1/0025; G10H 1/366; G10H 2220/005; G10H 2220/021
USPC ..... 84/483.2, 609
See application file for complete search history.

(56) References Cited

U.S. PATENT DOCUMENTS 6,841,724 B2 * 1/2005 George ..... G09B 15/026 84/474
6,930,235 B2 * 8/2005 Sandborn ..... G09B 15/02 84/464 R
7,504,572 B2 * 3/2009 Nakamura ..... G10H 1/18 84/464 R (Continued)

FOREIGN PATENT DOCUMENTS

KR 20080021201 A 3/2008
WO 0188905 A1 11/2001

(Continued)

OTHER PUBLICATIONS

Ciuha et al., "Visualization of concurrent tones in music with colours", Computer Architecture, 2011 38th Annual International Symposium, Oct. 25, 2010, pp. 1677-1680 (Year: 2010).*

(Continued)

*Primary Examiner* — Christina M Schreiber
(74) *Attorney, Agent, or Firm* — Levine's Tech Consulting LLC; Frank E. Levine

(57) ABSTRACT

Systems and methods are disclosed for generating color sets based on musical concepts of pitch intervals and harmony. Color sets are derived via a music-to-hue process which analyzes musical pitch data associated with musical input to determine pitch intervals included in the music. Pitch interval angles associated with the pitch intervals are applied to a tuned hue index to identify hue note ordered within the index which are separated by a hue interval angle similar to the pitch angle associated with the analyzed pitch data. The systems and methods provide for the creation of color sets which are analogous to musical chords in that they include multiple hue notes selected based on hue interval angles derived from musical interval angles associated with the received musical input.

21 Claims, 64 Drawing Sheets

(56) References Cited

U.S. PATENT DOCUMENTS

| | | | | |
|---|---|---|---|---|
| 8,793,580 | B2 * | 7/2014 | Robinson | G11B 33/10 715/716 |
| 2002/0176591 | A1 * | 11/2002 | Sandborn | G09B 15/02 84/464 R |
| 2002/0178896 | A1 * | 12/2002 | George | G09B 15/026 84/477 R |
| 2003/0117400 | A1 * | 6/2003 | Steinberg | G10H 1/0008 345/440 |
| 2004/0148575 | A1 * | 7/2004 | Haase | G10H 1/0008 715/201 |
| 2005/0275626 | A1 * | 12/2005 | Mueller | H05B 47/19 345/156 |
| 2012/0216666 | A1 * | 8/2012 | Fresolone | G09B 21/009 84/483.2 |
| 2013/0220101 | A1 * | 8/2013 | Lemons | G09B 15/026 84/483.2 |
| 2017/0358284 | A1 * | 12/2017 | Miki | G11B 27/031 |
| 2018/0144508 | A1 * | 5/2018 | Hu | G06T 11/00 |
| 2019/0051276 | A1 * | 2/2019 | Lathrop | G10G 1/02 |
| 2022/0122572 | A1 * | 4/2022 | Beasley | G10H 1/0008 |
| 2023/0096679 | A1 * | 3/2023 | Beasley | G10H 1/0066 84/483.2 |

FOREIGN PATENT DOCUMENTS

| | | | | |
|---|---|---|---|---|
| WO | WO-0188905 | A1 * | 11/2001 | G10L 21/06 |
| WO | 2008008395 | A2 | 1/2008 | |
| WO | WO-2008008395 | A2 * | 1/2008 | G09B 15/009 |
| WO | 20201633660 | A2 | 6/2020 | |
| WO | WO-2020163660 | A2 * | 8/2020 | G06T 11/00 |

OTHER PUBLICATIONS

European Search Opinion, Application No. EP20752093.3, dated Sep. 30, 2022.

Ciuha Peter et al: "Visualization of concurrent tones in music with colours", Computer Architecture (ISCA), 2011 38th Annual International Symposium On, IEEE, 2 Penn Plaza, Suite 701 New York NY 10121-0701 USA, Oct. 25, 2010 (Oct. 25, 2010), pp. 1677-1680, XP058599645, DOI: 10.1145/1873951.1874320 ISBN: 978-1-4503-0472-6.

International Search Report and Written Opinion, Application No. PCT/IB2022/052252, dated Jun. 16, 2022.

* cited by examiner

Figure 2: Exemplary System
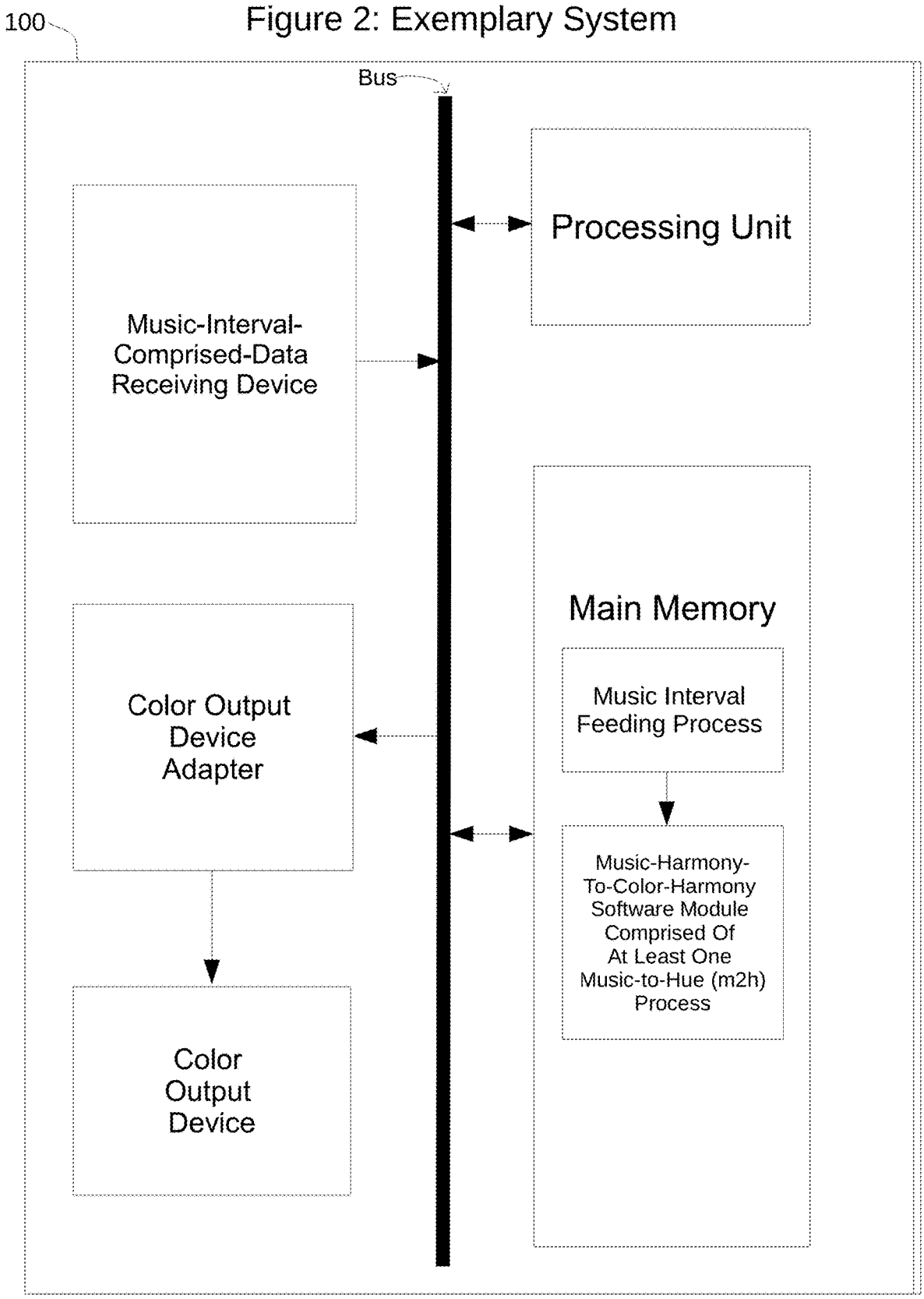

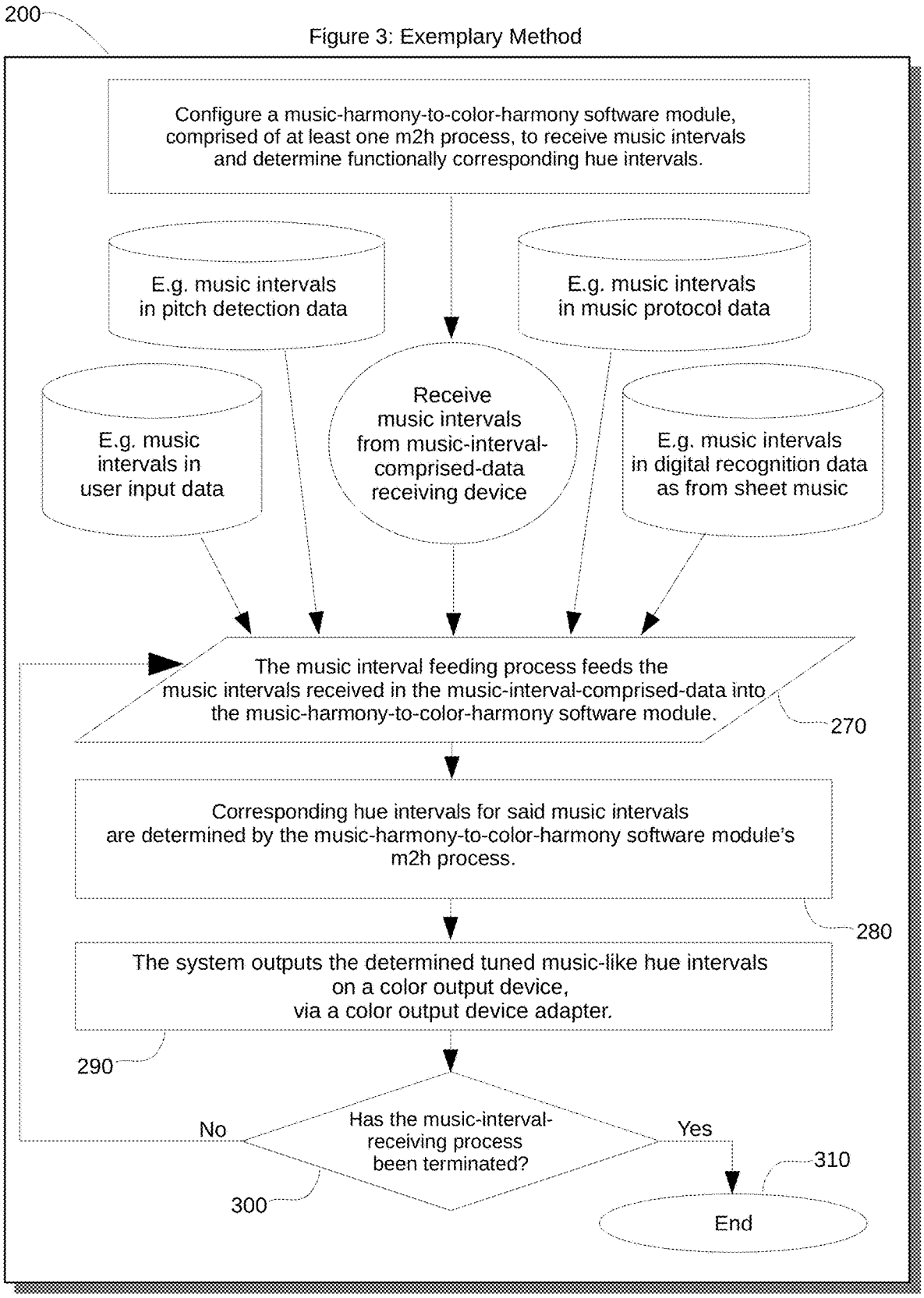
200
Figure 3: Exemplary Method
Configure a music-harmony-to-color-harmony software module, comprised of at least one m2h process, to receive music intervals and determine functionally corresponding hue intervals.
E.g. music intervals in pitch detection data
E.g. music intervals in music protocol data
E.g. music intervals in user input data
Receive music intervals from music-interval-comprised-data receiving device
E.g. music intervals in digital recognition data as from sheet music
The music interval feeding process feeds the music intervals received in the music-interval-comprised-data into the music-harmony-to-color-harmony software module.
270
Corresponding hue intervals for said music intervals are determined by the music-harmony-to-color-harmony software module's m2h process.
280
The system outputs the determined tuned music-like hue intervals on a color output device, via a color output device adapter.
290
Has the music-interval-receiving process been terminated?
No
Yes
300
310
End Portion within DWW Forms a "Visible-Spectrum-Like Hue Gradient"
Tuned Hue Chromatic Circle (THCC) (in 240-Res – w/ 1 Color Chip per 5 Hue Cents)

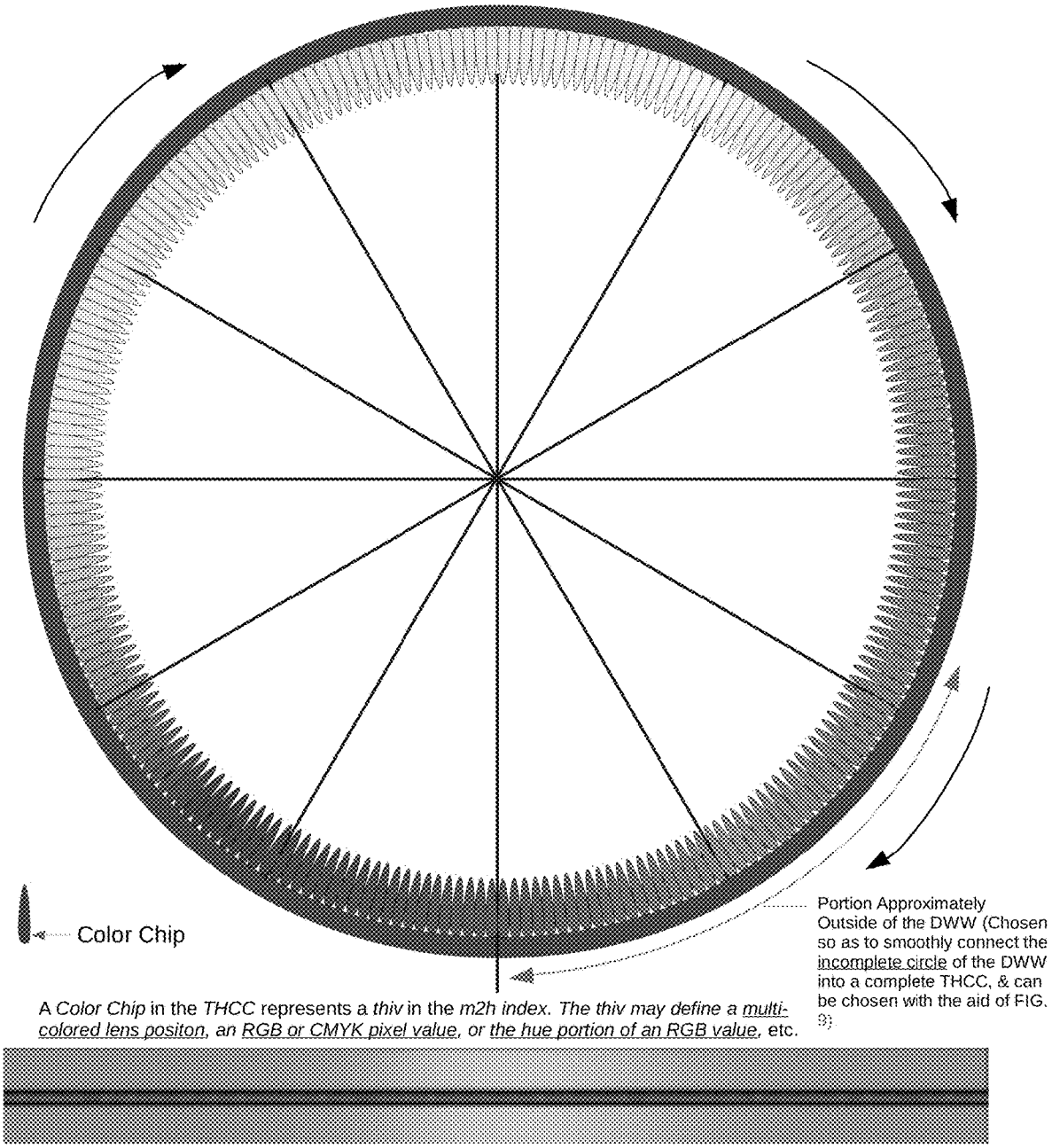

A *Color Chip* in the *THCC* represents a *thiv* in the *m2h index*. *The thiv may define a multi-colored lens positon*, *an RGB or CMYK pixel value*, *or the hue portion of an RGB value*, etc.

(shown above: a visible spectrum hue gradient)

The hue gradient of a THCC should typically appear smooth, like the visible spectrum.

FIG. 4

Musical Transposition (Offset) Is Fundamental to the Method

FIG. 9

| | | | Geometrically Increasing | Geometrically Decreasing | Geometrically Decreasing | Increasing Linearly |
|---|---|---|---|---|---|---|
| PHI Hue Cents | MIDI Note # | Pitch Name | Apprx Music Pitch Frequency | Apprx Hue D/W's Frequency in Ghz | Apprx Music Wavelength in feet | Apprx Hue Dom Wavelength |
| 00.00 | 60 | C | 261.625 | 705.39401882 | 3761108.456760631 | 425.00 nm |
| 00.50 | | | 269.291 | 687.83402088 | 3654039.681979717 | 435.85 nm |
| 01.00 | 61 | C#/Db | 277.182 | 671.12706067 | 3550014.070177717 | 446.7 nm |
| 01.50 | | | 285.304 | 655.21245328 | 3448952.6960715596 | 457.55 nm |
| 02.00 | 62 | D | 293.664 | 640.03513664 | 3350768.224910102 | 468.4 nm |
| 02.50 | | | 302.269 | 625.54503495 | 3255378.4873738294 | 479.25 nm |
| 03.00 | 63 | D#/Eb | 311.126 | 611.69650684 | 3162705.7847945853 | 490.1 nm |
| 03.50 | | | 320.242 | 598.44786506 | 3162705.7847945853 | 500.95 nm |
| 04.00 | 64 | E | 329.627 | 585.76095741 | 2985192.3537816987 | 511.8 nm |
| 04.50 | | | 339.285 | 573.60079977 | 2900216.6320350147 | 522.65 nm |
| 05.00 | 65 | F | 349.228 | 561.93525398 | 2817643.487921931 | 533.5 nm |
| 05.50 | | | 359.461 | 550.73474419 | 2737431.8771716543 | 544.35 nm |
| 06.00 | 66 | F#/Gb | 369.994 | 539.97200648 | 2659502.58652843 | 555.2 nm |
| 06.50 | | | 380.835 | 529.62186733 | 2583796.1321832296 | 566.05 nm |
| 07.00 | 67 | G | 391.995 | 519.66104698 | 2510236.099950255 | 576.9 nm |
| 07.50 | | | 403.481 | 510.06798469 | 2438776.5470988723 | 587.75 nm |
| 08.00 | 68 | G#/Ab | 415.304 | 500.82268293 | 2369348.718047503 | 598.6 nm |
| 08.50 | | | 427.473 | 491.90656822 | 2301899.769108224 | 609.45 nm |
| 09.00 | 69 | A | 440 | 483.30236666 | 2236363.6363636367 | 620.3 nm |
| 09.50 | | | 452.892 | N/A | 2172703.4259823533 | Cool Red |
| 10.00 | 70 | A#/Bb | 466.163 | N/A | 2110849.6384311924 | Slightly Bluish Red |
| 10.50 | | | 479.822 | N/A | 2050760.4903485044 | Very Bluish Red |
| 11.00 | 71 | B | 493.883 | N/A | 1992374.7122294148 | Magenta |
| 11.50 | | | 508.354 | N/A | 1935659.009273066 | Reddish Purple |
| 00.00 | 60 | C | 261.625 | 705882.3529411765 | 3761108.456760631 | 425.00 nm |

| | | |
|---|---|---|
| MIDI Note #0 | C-1 | 08.176 hz |
| MIDI Note #1 | C#-1 | 08.662 hz |
| MIDI Note #2 | D -1 | 09.177 hz |
| MIDI Note #3 | D# -1 | 09.723 hz |
| MIDI Note #4 | E -1 | 10.301 hz |
| MIDI Note #5 | F -1 | 10.913 hz |
| MIDI Note #6 | F# -1 | 11.562 hz |
| MIDI Note #7 | G -1 | 12.250 hz |
| MIDI Note #8 | G# -1 | 12.978 hz |
| MIDI Note #9 | A -1 | 13.750 hz |
| MIDI Note #10 | A# -1 | 14.568 hz |
| MIDI Note #11 | B -1 | 15.434 hz |
| MIDI Note #12 | C 0 | 16.352 hz |
| MIDI Note #13 | C# 0 | 17.324 hz |
| MIDI Note #14 | D 0 | 18.354 hz |
| MIDI Note #15 | D# 0 | 19.445 hz |
| MIDI Note #16 | E 0 | 20.601 hz |
| MIDI Note #17 | F 0 | 21.826 hz |
| MIDI Note #18 | F# 0 | 23.124 hz |
| MIDI Note #19 | G 0 | 24.499 hz |
| MIDI Note #20 | G# 0 | 25.956 hz |
| MIDI Note #21 | A 0 | 27.500 hz |

etc.

Figure 27: The Interval Helix

The Interval Helix: The interval helix of the present invention is a 3D helix structure associated with music intervals, in which increase in vertical height is associated w/ decrease in W/L & increase in freq. Relationships between a sequence of tuned music intervals & correlated hue intervals may be represented using the interval helix, by scrolling through the sequence. The interval helix can be used alongside a traditional piano roll, and the thiNK interface. It is a useful visualization means because it simultaneously represents octave-reduced and non-octave-reduced intervals. The former typically determine hue while the latter typically determine color object array behaviors. Octave-reduced pitches or intervals (which can be cents-based values) may be viewed/edited as rays/central angles on the bottom (in virtual 3D) on the Chromatic Circle that forms the Interval Helix base. Non-octave-reduced-intervals may be interpreted simply as 'angles-plus-height-in-octaves' from the interval bottom (E.g. C0 to D1 is -30° plus one octave). [Generic octave-reduced & non-octave-reduced intervals may be formulated, and as such may temporarily occupy a selected "current vertical transposition range" from a "current trans-position bottom" (transposition in the musical sense). [This bottom is of course equivalent to the current Music Key (or Hue Key) if the lowest note of the selection is the Music (or Hue) Tonic.] For example an entire Beatles song can be conceived as being raised or lowered vertically upon the interval helix. If shifts are made by some number of exact octaves, pre and post-shifted angles are the same and only the Octave value changes. If shifts are made that include changing pitch class of the lowest note, then rotation also occurs.] For our description we have selected our "arbitrary music interval bottom" on the interval helix as C, Octave = "minus one" (C-1), MIDI Note # 0. = 8.175798916 hz.

Music's Chromatic Circle shown with 12 "Interval Angle" Slices

Here we extrude music's Chromatic Circle up into 3D. The pitches form a helix. -30° "Interval angle" slices on the Chromatic Circle represent neighboring pairs of semitone pitch classes (clockwise = up) Non-octave-reduced pitches are positioned on the helix (in virtual 3D) directly above their pitch class on the musical Chromatic Circle. This format can be in-creased in resolution to show 5 cent increments as in the 240-Res THCC (or even 1 cent increments) increments.

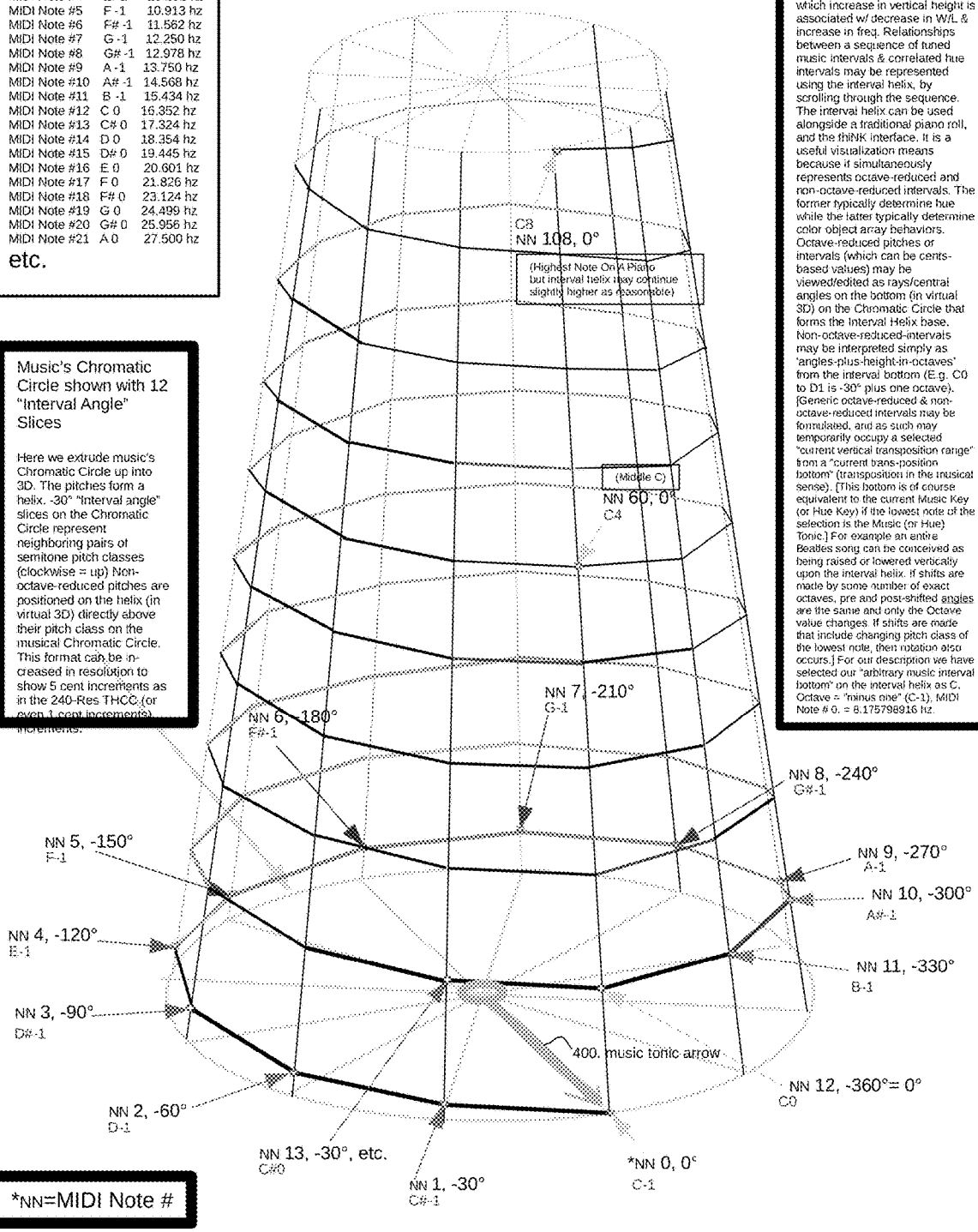

*NN=MIDI Note #

Example Of Music-to-Hue-Cent-Measurement-Bins & Their Dominant Wavelength Values.

(The Hue Half Step span chosen per music half step is: 21.7nm)

| m2hcmb Bottom in hz. | absolute cents | MIDI Note # | m2hcmb#'s | Dom W/L in nm |
|---|---|---|---|---|
| 8.175798915 hz | 0000 | 0 | 1 | 425.00 nm |
| 8.199445679 hz | 0005 | | 2 | 426.085 nm |
| 8.223160836 hz | 0010 | | 3 | 427.17 nm |
| 8.246944585 " | 0015 | | 4 | 428.255 " |
| 8.270797123 | 0020 | | 5 | 429.34 |
| 8.294718649 | 0025 | | 6 | 430.425 |
| 8.318709363 | 0030 | | 7 | 431.51 |
| 8.342769465 | 0035 | | 8 | 432.595 |
| 8.366899156 | 0040 | | 9 | 433.68 |
| 8.391098637 | 0045 | | 10 | 434.765 |
| 8.415368110 | 0050 | | 11 | 435.85 |
| 8.439707777 | 0055 | | 12 | 436.935 |
| 8.464117841 | 0060 | | 13 | 438.02 |
| 8.488598507 | 0065 | | 14 | 439.105 |
| 8.513149977 | 0070 | | 15 | 440.19 |
| 8.537772457 | 0075 | | 16 | 441.275 |
| 8.562466153 | 0080 | | 17 | 442.36 |
| 8.587231270 | 0085 | | 18 | 443.445 |
| 8.612068015 | 0090 | | 19 | 443.53 |
| 8.636976595 | 0095 | | 20 | 445.615 |
| 8.661957217 | 0100 | 1 | 21 | 446.7 |
| 8.687010091 | 0105 | | 22 | 447.785 |
| 8.712135425 | 0110 | | 23 | 448.87 |
| 8.737333429 | 0115 | | 24 | 449.955 |
| 8.762604312 | 0120 | | 25 | 451.04 |
| 8.787948286 | 0125 | | 26 | 452.125 |
| 8.813365563 | 0130 | | 27 | 453.21 |
| 8.838856353 | 0135 | | 28 | 454.295 |
| 8.864420870 | 0140 | | 29 | 455.38 |
| 8.890059327 | 0145 | | 30 | 456.465 |
| 8.915771938 | 0150 | | 31 | 457.55 |
| 8.941558917 | 0155 | | 32 | 458.635 |
| 8967420479 | 0160 | | 33 | 459.72 |
| 8.993356841 | 0165 | | 34 | 460.805 |
| 9.019368217 | 0170 | | 35 | 461.89 |
| 9.045454827 | 0175 | | 36 | 462.975 |
| 9.071616886 | 0180 | | 37 | 464.06 |
| 9.097854613 | 0185 | | 38 | 465.145 |
| 9.124168228 | 0190 | | 39 | 466.23 |

FIG. 30

| | | | | |
|---|---|---|---|---|
| 9.150557949 | 0195 | | 40 | 467.315 |
| 9.177023997 | 0200 | 2 | 41 | 468.4 |
| 9.203566592 | 0205 | | 42 | 469.485 |
| 9.230185956 | 0210 | | 43 | 470.57 |
| 9.256882311 | 0215 | | 44 | 471.655 |
| 9.283655879 | 0220 | | 45 | 472.74 |
| 9.310506885 | 0225 | | 46 | 473.825 |
| 9.337435551 | 0230 | | 47 | 474.91 |
| 9.364442102 | 0235 | | 48 | 475.995 |
| 9.391526765 | 0240 | | 49 | 477.08 |
| 9.418689764 | 0245 | | 50 | 478.165 |
| 9.445931326 | 0250 | | 51 | 479.25 |
| 9.473251678 | 0255 | | 52 | 480.335 |
| 9.500651049 | 0260 | | 53 | 481.42 |
| 9.528129667 | 0265 | | 54 | 482.505 |
| 9.555687761 | 0270 | | 55 | 483.59 |
| 9.583325561 | 0275 | | 56 | 484.675 |
| 9.611043297 | 0280 | | 57 | 485.76 |
| 9.638841201 | 0285 | | 58 | 486.845 |
| 9.666719504 | 0290 | | 59 | 487.93 |
| 9.694678440 | 0295 | | 60 | 489.015 |
| 9.722718241 | 0300 | 3 | 61 | 490.1 |
| 9.750839141 | 0305 | | 62 | 491.185 |
| 9.779041375 | 0310 | | 63 | 492.27 |
| 9.807325177 | 0315 | | 64 | 493.355 |
| 9.835690785 | 0320 | | 65 | 494.44 |
| 9.864138434 | 0325 | | 66 | 495.525 |
| 9.892668362 | 0330 | | 67 | 496.61 |
| 9.921280807 | 0335 | | 68 | 497.695 |
| 9.949976007 | 0340 | | 69 | 498.78 |
| 9.978754202 | 0345 | | 70 | 499.865 |
| 10.007615631 | 0350 | | 71 | 500.95 |
| 10.036560537 | 0355 | | 72 | 502.035 |
| 10.065589159 | 0360 | | 73 | 503.12 |
| 10.094701740 | 0365 | | 74 | 504.205 |
| 10.123898524 | 0370 | | 75 | 505.29 |
| 10.153179753 | 0375 | | 76 | 506.375 |
| 10.182545671 | 0380 | | 77 | 507.46 |
| 10.211996525 | 0385 | | 78 | 508.545 |
| 10.241532558 | 0390 | | 79 | 509.63 |
| 10.271154019 | 0395 | | 80 | 510.715 |
| 10.300861153 | 0400 | 4 | 81 | 511.8 |
| 10.330654209 | 0405 | | 82 | 512.885 |
| 10.360533435 | 0410 | | 83 | 513.97 |
| 10.390499080 | 0415 | | 84 | 515.055 |
| 10.420551394 | 0420 | | 85 | 516.14 |
| 10.450690629 | 0425 | | 86 | 517.225 |
| 10.480917034 | 0430 | | 87 | 518.31 |
| 10.511230864 | 0435 | | 88 | 519.395 |

FIG. 30 continued

| | | | | |
|---|---|---|---|---|
| 10.541632369 | 0440 | | 89 | 520.48 |
| 10.572121804 | 0445 | | 90 | 521.565 |
| 10.602699424 | 0450 | | 91 | 522.65 |
| 10.633365483 | 0455 | | 92 | 523.735 |
| 10.664120237 | 0460 | | 93 | 524.82 |
| 10.694963943 | 0465 | | 94 | 525.905 |
| 10.725896857 | 0470 | | 95 | 526.99 |
| 10.756919238 | 0475 | | 96 | 528.075 |
| 10.788031346 | 0480 | | 97 | 529.16 |
| 10.819233438 | 0485 | | 98 | 530.245 |
| 10.850525775 | 0490 | | 99 | 531.33 |
| 10.881908619 | 0495 | | 100 | 532.415 |
| 10.913382232 | 0500 | 5 | 101 | 533.5 |
| 10.944946875 | 0505 | | 102 | 534.585 |
| 10.976602812 | 0510 | | 103 | 535.67 |
| 11.008350307 | 0515 | | 104 | 536.755 |
| 11.040189625 | 0520 | | 105 | 537.84 |
| 11.072121032 | 0525 | | 106 | 538.925 |
| 11.104144793 | 0530 | | 107 | 540.01 |
| 11.136261176 | 0535 | | 108 | 541.095 |
| 11.168470449 | 0540 | | 109 | 542.18 |
| 11.200772881 | 0545 | | 110 | 543.265 |
| 11.233168740 | 0550 | | 111 | 544.35 |
| 11.265658298 | 0555 | | 112 | 545.435 |
| 11.298241825 | 0560 | | 113 | 546.52 |
| 11.330919593 | 0565 | | 114 | 547.605 |
| 11.363691874 | 0570 | | 115 | 548.69 |
| 11.396558942 | 0575 | | 116 | 549.775 |
| 11.429521071 | 0580 | | 117 | 550.86 |
| 11.462578537 | 0585 | | 118 | 551.945 |
| 11.495731613 | 0590 | | 119 | 553.03 |
| 11.528980579 | 0595 | | 120 | 554.115 |
| 11.562325709 | 0600 | 6 | 121 | 555.2 |
| 11.595767284 | 0605 | | 122 | 556.285 |
| 11.629305581 | 0610 | | 123 | 557.37 |
| 11.662940880 | 0615 | | 124 | 558.455 |
| 11.696673463 | 0620 | | 125 | 559.54 |
| 11.730503609 | 0625 | | 126 | 560.625 |
| 11.764431603 | 0630 | | 127 | 561.71 |
| 11.798457725 | 0635 | | 128 | 562.795 |
| 11.832582262 | 0640 | | 129 | 563.88 |
| 11.866805496 | 0645 | | 130 | 564.965 |
| 11.901127713 | 0650 | | 131 | 566.05 |
| 11.935549201 | 0655 | | 132 | 567.135 |
| 11.970070245 | 0660 | | 133 | 568.22 |
| 12.004691134 | 0665 | | 134 | 569.305 |
| 12.039412156 | 0670 | | 135 | 570.39 |
| 12.074233602 | 0675 | | 136 | 571.475 |
| 12.109155761 | 0680 | | 137 | 572.56 |
| 12.144178926 | 0685 | | 138 | 573.645 |
| 12.179303387 | 0690 | | 139 | 574.73 |

FIG. 30 continued

| | | | | |
|---|---|---|---|---|
| 12.214529439 (3:2 | 0695 | | 140 | 575.815 |
| 12.249857374 | 0700 | 7 | 141 | 576.9 |
| 12.285287488 | 0705 | | 142 | 577.985 |
| 12.320820076 | 0710 | | 143 | 579.07 |
| 12.356455434 | 0715 | | 144 | 580.155 |
| 12.392193860 | 0720 | | 145 | 581.24 |
| 12.428035652 | 0725 | | 146 | 582.325 |
| 12.463981109 | 0730 | | 147 | 583.41 |
| 12.500030530 | 0735 | | 148 | 584.495 |
| 12.536184217 | 0740 | | 149 | 585.58 |
| 12.572442471 | 0745 | | 150 | 586.665 |
| 12.608805594 | 0750 | | 151 | 587.75 |
| 12.645273889 | 0755 | | 152 | 588.835 |
| 12.681847661 | 0760 | | 153 | 589.92 |
| 12.718527215 | 0765 | | 154 | 591.005 |
| 12.755312857 | 0770 | | 155 | 592.09 |
| 12.792204894 | 0775 | | 156 | 593.175 |
| 12.829203633 | 0780 | | 157 | 594.26 |
| 12.866309383 | 0785 | | 158 | 595.345 |
| 12.903522454 | 0790 | | 159 | 596.43 |
| 12.940843155 | 0795 | | 160 | 597.515 |
| 12.978271799 | 0800 | 8 | 161 | 598.6 |
| 13.045808697 | 0805 | | 162 | 599.685 |
| 13.053454163 | 0810 | | 163 | 600.77 |
| 13.091208510 | 0815 | | 164 | 601.855 |
| 13.129072053 | 0820 | | 165 | 602.94 |
| 13.167045109 | 0825 | | 166 | 604.025 |
| 13.208127994 | 0830 | | 167 | 605.11 |
| 13.243321025 | 0835 | | 168 | 606.195 |
| 13.281624522 | 0840 | | 169 | 607.28 |
| 13.320038804 | 0845 | | 170 | 608.365 |
| 13.358564190 | 0850 | | 171 | 609.45 |
| 13.397201003 | 0855 | | 172 | 610.535 |
| 13.435949565 | 0860 | | 173 | 611.62 |
| 13.474810199 | 0865 | | 174 | 612.705 |
| 13.513783229 | 0870 | | 175 | 613.79 |
| 13.552868981 | 0875 | | 176 | 614.875 |
| 13.592067779 | 0880 | | 177 | 615.96 |
| 13.631379952 | 0885 | | 178 | 617.045 |
| 13.670805827 | 0890 | | 179 | 618.13 |
| 13.710345733 | 0895 | | 180 | 619.215 |
| 13.749999999 | 0900 | 9 | 181 | 620.3 |
| 13.789768958 | 0905 | | 182 | 621.385 |
| 13.829652939 | 0910 | | 183 | 622.47 |
| 13.869652277 | 0915 | | 184 | 623.555 |
| 13.909767304 | 0920 | | 185 | 624.64 |
| 13.949998355 | 0925 | | 186 | 625.725 |
| 13.990345766 | 0930 | | 187 | 626.81 |
| 14.030809873 | 0935 | | 188 | 627.895 |

FIG. 30 continued

| | | | | |
|---|---|---|---|---|
| 14.071391014 | 0940 | | 189 | 628.98 |
| 14.112089528 | 0945 | | 190 | |
| 14.152905753 | 0950 | | 191 | Cool Red |
| 14.193840031 | 0955 | | 192 | |
| 14.234892702 | 0960 | | 193 | |
| 14.276064110 | 0965 | | 194 | |
| 14.317354597 | 0970 | | 195 | |
| 14.358764508 | 0975 | | 196 | |
| 14.400294188 | 0980 | | 197 | |
| 14.441943984 | 0985 | | 198 | |
| 14.483714244 | 0990 | | 199 | |
| 14.525605315 | 0995 | | 200 | |
| 14.567617547 | 1000 | 10 | 201 | Slightly Bluish Red |
| 14.609751290 | 1005 | | 202 | |
| 14.652006897 | 1010 | | 203 | |
| 14.694384719 | 1015 | | 204 | |
| 14.736885109 | 1020 | | 205 | |
| 14.779508423 | 1025 | | 206 | |
| 14.822255016 | 1030 | | 207 | |
| 14.865125245 | 1035 | | 208 | |
| 14.908119466 | 1040 | | 209 | |
| 14.951238039 | 1045 | | 210 | |
| 14.994481324 | 1050 | | 211 | Very Bluish Red |
| 15.037849680 | 1055 | | 212 | |
| 15.081343470 | 1060 | | 213 | |
| 15.124963057 | 1065 | | 214 | |
| 15.168708804 | 1070 | | 215 | |
| 15.212581077 | 1075 | | 216 | |
| 15.256580240 | 1080 | | 217 | |
| 15.300706662 | 1085 | | 218 | |
| 15.344960711 | 1090 | | 219 | |
| 15.389342754 | 1095 | | 220 | |
| 15.433853164 | 1100 | 11 | 221 | Magenta |
| 15.478492310 | 1105 | | 222 | |
| 15.523260566 | 1110 | | 223 | |
| 15.568158304 | 1115 | | 224 | |
| 15.613185899 | 1120 | | 225 | |
| 15.658343727 | 1125 | | 226 | |
| 15.703632165 | 1130 | | 227 | |
| 15.749051590 | 1135 | | 228 | |
| 15.794602381 | 1140 | | 229 | |
| 15.840284918 | 1145 | | 230 | |
| 15.886099581 | 1150 | | 231 | Reddish Purple |
| 15.932046755 | 1155 | | 232 | |
| 15.978126820 | 1160 | | 233 | |
| 16.024340162 | 1165 | | 234 | |
| 16.070687167 | 1170 | | 235 | |
| 16.117168221 | 1175 | | 236 | |
| 16.163783711 | 1180 | | 237 | |

FIG. 30 continued

| | | | | |
|---|---|---|---|---|
| 16.210534026 | 1185 | | 238 | |
| 16.257419557 | 1190 | | 239 | |
| 16.304440695 | 1195 | | 240 | |
| 16.351579632 | 0000 | 0 | 1 | 425.00 |

FIG. 30 continued

Example Of PPI and PHI Bins with hz and Dom W/L values

In Example Default Alignment Where PHI C (C-1) = PHI Violet 425nm

(The Hue Half Step span chosen per music half step is: Up 21.7nm)

| Prime *PITCH* Interval bin# | PPI Bin bottom in hz | Prime *HUE* Interval bin# | PHI Half Steps | PHI Bin Dominant wavelength nm |
|---|---|---|---|---|
| ppi b1 | 8.175798915 hz C-1 | phi b1 | 00.00 ~> | 425.000 nm |
| ppi b2 | 8.199445679 hz | phi b2 | 00.05 ~> | 426.085 nm |
| ppi b3 | 8.223160836 hz | phi b3 | 00.10 ~> | 427.170 nm |
| ppi b4 | 8.246944585 " | phi b4 | 00.15 ~> | 428.255 " |
| ppi b5 | 8.270797123 | phi b5 | 00.20 ~> | 429.340 |
| ppi b6 | 8.294718649 | phi b6 | 00.25 ~> | 430.425 |
| ppi b7 | 8.318709363 | phi b7 | 00.30 ~> | 431.510 |
| ppi b8 | 8.342769465 | phi b8 | 00.35 ~> | 432.595 |
| ppi b9 | 8.366899156 | phi b9 | 00.40 ~> | 433.680 |
| ppi b10 | 8.391098637 | phi b10 | 00.45 ~> | 434.765 |
| ppi b11 | 8.415368110 | phi b11 | 00.50 ~> | 435.850 |
| ppi b12 | 8.439707777 | phi b12 | 00.55 ~> | 436.935 |
| ppi b13 | 8.464117841 | phi b13 | 00.60 ~> | 438.020 |
| ppi b14 | 8.488598507 | phi b14 | 00.65 ~> | 439.105 |
| ppi b15 | 8.513149977 | phi b15 | 00.70 ~> | 440.190 |
| ppi b16 | 8.537772457 | phi b16 | 00.75 ~> | 441.275 |
| ppi b17 | 8.562466153 | phi b17 | 00.80 ~> | 442.360 |
| ppi b18 | 8.587231270 | phi b18 | 00.85 ~> | 443.445 |
| ppi b19 | 8.612068015 | phi b19 | 00.90 ~> | 443.530 |
| ppi b20 | 8.636976595 | phi b20 | 00.95 ~> | 445.615 |
| ppi b21 | 8.661957217 C#-1 | phi b21 | 01.00 ~> | 446.700 |
| ppi b22 | 8.687010091 | phi b22 | 01.05 ~> | 447.785 |
| ppi b23 | 8.712135425 | phi b23 | 01.10 ~> | 448.870 |
| ppi b24 | 8.737333429 | phi b24 | 01.15 ~> | 449.955 |
| ppi b25 | 8.762604312 | phi b25 | 01.20 ~> | 451.040 |
| ppi b26 | 8.787948286 | phi b26 | 01.25 ~> | 452.125 |
| ppi b27 | 8.813365563 | phi b27 | 01.30 ~> | 453.210 |
| ppi b28 | 8.838856353 | phi b28 | 01.35 ~> | 454.295 |
| ppi b29 | 8.864420870 | phi b29 | 01.40 ~> | 455.380 |
| ppi b30 | 8.890059327 | phi b30 | 01.45 ~> | 456.465 |
| ppi b31 | 8.915771938 | phi b31 | 01.50 ~> | 457.550 |
| ppi b32 | 8.941558917 | phi b32 | 01.55 ~> | 458.635 |
| ppi b33 | 8967420479 | phi b33 | 01.60 ~> | 459.720 |
| ppi b34 | 8.993356841 | phi b34 | 01.65 ~> | 460.805 |
| ppi b35 | 9.019368217 | phi b35 | 01.70 ~> | 461.890 |
| ppi b36 | 9.045454827 | phi b36 | 01.75 ~> | 462.975 |
| ppi b37 | 9.071616886 | phi b37 | 01.80 ~> | 464.060 |
| ppi b38 | 9.097854613 | phi b38 | 01.85 ~> | 465.145 |
| ppi b39 | 9.124168228 | phi b39 | 01.90 ~> | 466.230 |
| ppi b40 | 9.150557949 | phi b40 | 01.95 ~> | 467.315 |
| ppi b41 | 9.177023997 D-1 | phi b41 | 02.00 ~> | 468.400 |

FIG. 31

| | | | | |
|---|---|---|---|---|
| ppi b42 | 9.203566592 | phi b42 | 02.05 ~> | 469.485 |
| ppi b43 | 9.230185956 | phi b43 | 02.10 ~> | 470.570 |
| ppi b44 | 9.256882311 | phi b44 | 02.15 ~> | 471.655 |
| ppi b45 | 9.283655879 | phi b45 | 02.20 ~> | 472.740 |
| ppi b46 | 9.310506885 | phi b46 | 02.25 ~> | 473.825 |
| ppi b47 | 9.337435551 | phi b47 | 02.30 ~> | 474.910 |
| ppi b48 | 9.364442102 | phi b48 | 02.35 ~> | 475.995 |
| ppi b49 | 9.391526765 | phi b49 | 02.40 ~> | 477.080 |
| ppi b50 | 9.418689764 | phi b50 | 02.45 ~> | 478.165 |
| ppi b51 | 9.445931326 | phi b51 | 02.50 ~> | 479.250 |
| ppi b52 | 9.473251678 | phi b52 | 02.55 ~> | 480.335 |
| ppi b53 | 9.500651049 | phi b53 | 02.60 ~> | 481.420 |
| ppi b54 | 9.528129667 | phi b54 | 02.65 ~> | 482.505 |
| ppi b55 | 9.555687761 | phi b55 | 02.70 ~> | 483.590 |
| ppi b56 | 9.583325561 | phi b56 | 02.75 ~> | 484.675 |
| ppi b57 | 9.611043297 | phi b57 | 02.80 ~> | 485.760 |
| ppi b58 | 9.638841201 | phi b58 | 02.85 ~> | 486.845 |
| ppi b59 | 9.666719504 | phi b59 | 02.90 ~> | 487.930 |
| ppi b60 | 9.694678440 | phi b60 | 02.95 ~> | 489.015 |
| ppi b61 | 9.722718241 D#-1 | phi b61 | 03.00 ~> | 490.100 |
| ppi b62 | 9.750839141 | phi b62 | 03.05 ~> | 491.185 |
| ppi b63 | 9.779041375 | phi b63 | 03.10 ~> | 492.270 |
| ppi b64 | 9.807325177 | phi b64 | 03.15 ~> | 493.355 |
| ppi b65 | 9.835690785 | phi b65 | 03.20 ~> | 494.440 |
| ppi b66 | 9.864138434 | phi b66 | 03.25 ~> | 495.525 |
| ppi b67 | 9.892668362 | phi b67 | 03.30 ~> | 496.610 |
| ppi b68 | 9.921280807 | phi b68 | 03.35 ~> | 497.695 |
| ppi b69 | 9.949976007 | phi b69 | 03.40 ~> | 498.780 |
| ppi b70 | 9.978754202 | phi b70 | 03.45 ~> | 499.865 |
| ppi b71 | 10.007615631 | phi b71 | 03.50 ~> | 500.950 |
| ppi b72 | 10.036560537 | phi b72 | 03.55 ~> | 502.035 |
| ppi b73 | 10.065589159 | phi b73 | 03.60 ~> | 503.120 |
| ppi b74 | 10.094701740 | phi b74 | 03.65 ~> | 504.205 |
| ppi b75 | 10.123898524 | phi b75 | 03.70 ~> | 505.290 |
| ppi b76 | 10.153179753 | phi b76 | 03.75 ~> | 506.375 |
| ppi b77 | 10.182545671 | phi b77 | 03.80 ~> | 507.460 |
| ppi b78 | 10.211996525 | phi b78 | 03.85 ~> | 508.545 |
| ppi b79 | 10.241532558 | phi b79 | 03.90 ~> | 509.630 |
| ppi b80 | 10.271154019 | phi b80 | 03.95 ~> | 510.715 |
| ppi b81 | 10.300861153 E-1 | phi b81 | 04.00 ~> | 511.800 |
| ppi b82 | 10.330654209 | phi b82 | 04.05 ~> | 512.885 |
| ppi b83 | 10.360533435 | phi b83 | 04.10 ~> | 513.970 |
| ppi b84 | 10.390499080 | phi b84 | 04.15 ~> | 515.055 |
| ppi b85 | 10.420551394 | phi b85 | 04.20 ~> | 516.140 |
| ppi b86 | 10.450690629 | phi b86 | 04.25 ~> | 517.225 |
| ppi b87 | 10.480917034 | phi b87 | 04.30 ~> | 518.310 |
| ppi b88 | 10.511230864 | phi b88 | 04.35 ~> | 519.395 |
| ppi b89 | 10.541632369 | phi b89 | 04.40 ~> | 520.480 |
| ppi b90 | 10.572121804 | phi b90 | 04.45 ~> | 521.565 |
| ppi b91 | 10.602699424 | phi b91 | 04.50 ~> | 522.650 |
| ppi b92 | 10.633365483 | phi b92 | 04.55 ~> | 523.735 |
| ppi b93 | 10.664120237 | phi b93 | 04.60 ~> | 524.820 |
| ppi b94 | 10.694963943 | phi b94 | 04.65 ~> | 525.905 |

FIG. 31 continued

| | | | | |
|---|---|---|---|---|
| ppi b95 | 10.725896857 | phi b95 | 04.70 ~> | 526.990 |
| ppi b96 | 10.756919238 | phi b96 | 04.75 ~> | 528.075 |
| ppi b97 | 10.788031346 | phi b97 | 04.80 ~> | 529.160 |
| ppi b98 | 10.819233438 | phi b98 | 04.85 ~> | 530.245 |
| ppi b99 | 10.850525775 | phi b99 | 04.90 ~> | 531.330 |
| ppi b100 | 10.881908619 | phi b100 | 04.95 ~> | 532.415 |
| ppi b101 | 10.913382232 F-1 | phi b101 | 05.00 ~> | 533.500 |
| ppi b102 | 10.944946875 | phi b102 | 05.05 ~> | 534.585 |
| ppi b103 | 10.976602812 | phi b103 | 05.10 ~> | 535.670 |
| ppi b104 | 11.008350307 | phi b104 | 05.15 ~> | 536.755 |
| ppi b105 | 11.040189625 | phi b105 | 05.20 ~> | 537.840 |
| ppi b106 | 11.072121032 | phi b106 | 05.25 ~> | 538.925 |
| ppi b107 | 11.104144793 | phi b107 | 05.30 ~> | 540.010 |
| ppi b108 | 11.136261176 | phi b108 | 05.35 ~> | 541.095 |
| ppi b109 | 11.168470449 | phi b109 | 05.40 ~> | 542.180 |
| ppi b110 | 11.200772881 | phi b110 | 05.45 ~> | 543.265 |
| ppi b111 | 11.233168740 | phi b111 | 05.50 ~> | 544.350 |
| ppi b112 | 11.265658298 | phi b112 | 05.55 ~> | 545.435 |
| ppi b113 | 11.298241825 | phi b113 | 05.60 ~> | 546.520 |
| ppi b114 | 11.330919593 | phi b114 | 05.65 ~> | 547.605 |
| ppi b115 | 11.363691874 | phi b115 | 05.70 ~> | 548.690 |
| ppi b116 | 11.396558942 | phi b116 | 05.75 ~> | 549.775 |
| ppi b117 | 11.429521071 | phi b117 | 05.80 ~> | 550.860 |
| ppi b118 | 11.462578537 | phi b118 | 05.85 ~> | 551.945 |
| ppi b119 | 11.495731613 | phi b119 | 05.90 ~> | 553.030 |
| ppi b120 | 11.528980579 | phi b120 | 05.95 ~> | 554.115 |
| ppi b121 | 11.562325709 F#-1 | phi b121 | 06.00 ~> | 555.200 |
| ppi b122 | 11.595767284 | phi b122 | 06.05 ~> | 556.285 |
| ppi b123 | 11.629305581 | phi b123 | 06.10 ~> | 557.370 |
| ppi b124 | 11.662940880 | phi b124 | 06.15 ~> | 558.455 |
| ppi b125 | 11.696673463 | phi b125 | 06.20 ~> | 559.540 |
| ppi b126 | 11.730503609 | phi b126 | 06.25 ~> | 560.625 |
| ppi b127 | 11.764431603 | phi b127 | 06.30 ~> | 561.710 |
| ppi b128 | 11.798457725 | phi b128 | 06.35 ~> | 562.795 |
| ppi b129 | 11.832582262 | phi b129 | 06.40 ~> | 563.880 |
| ppi b130 | 11.866805496 | phi b130 | 06.45 ~> | 564.965 |
| ppi b131 | 11.901127713 | phi b131 | 06.50 ~> | 566.050 |
| ppi b132 | 11.935549201 | phi b132 | 06.55 ~> | 567.135 |
| ppi b133 | 11.970070245 | phi b133 | 06.60 ~> | 568.220 |
| ppi b134 | 12.004691134 | phi b134 | 06.65 ~> | 569.305 |
| ppi b135 | 12.039412156 | phi b135 | 06.70 ~> | 570.390 |
| ppi b136 | 12.074233602 | phi b136 | 06.75 ~> | 571.475 |
| ppi b137 | 12.109155761 | phi b137 | 06.80 ~> | 572.560 |
| ppi b138 | 12.144178926 | phi b138 | 06.85 ~> | 573.645 |
| ppi b139 | 12.179303387 | phi b139 | 06.90 ~> | 574.730 |
| ppi b140 | 12.21452944 | phi b140 | 06.95 ~> | 575.815 |
| ppi b141 | 12.249857374 G-1 | phi b141 | 07.00 ~> | 576.900 |
| ppi b142 | 12.285287488 | phi b142 | 07.05 ~> | 577.985 |
| ppi b143 | 12.320820076 | phi b143 | 07.10 ~> | 579.070 |
| ppi b144 | 12.356455434 | phi b144 | 07.15 ~> | 580.155 |
| ppi b145 | 12.392193860 | phi b145 | 07.20 ~> | 581.240 |
| ppi b146 | 12.428035652 | phi b146 | 07.25 ~> | 582.325 |
| ppi b147 | 12.463981109 | phi b147 | 07.30 ~> | 583.410 |
| ppi b148 | 12.500030530 | phi b148 | 07.35 ~> | 584.495 |

FIG. 31 continued

| | | | | |
|---|---|---|---|---|
| ppi b149 | 12.536184217 | phi b149 | 07.40 ~> | 585.580 |
| ppi b150 | 12.572442471 | phi b150 | 07.45 ~> | 586.665 |
| ppi b151 | 12.608805594 | phi b151 | 07.50 ~> | 587.750 |
| ppi b152 | 12.645273889 | phi b152 | 07.55 ~> | 588.835 |
| ppi b153 | 12.681847661 | phi b153 | 07.60 ~> | 589.920 |
| ppi b154 | 12.718527215 | phi b154 | 07.65 ~> | 591.005 |
| ppi b155 | 12.755312857 | phi b155 | 07.70 ~> | 592.090 |
| ppi b156 | 12.792204894 | phi b156 | 07.75 ~> | 593.175 |
| ppi b157 | 12.829203633 | phi b157 | 07.80 ~> | 594.260 |
| ppi b158 | 12.866309383 | phi b158 | 07.85 ~> | 595.345 |
| ppi b159 | 12.903522454 | phi b159 | 07.90 ~> | 596.430 |
| ppi b160 | 12.940843155 | phi b160 | 07.95 ~> | 597.515 |
| ppi b161 | 12.978271799 G#-1 | phi b161 | 08.00 ~> | 598.600 |
| ppi b162 | 13.045808697 | phi b162 | 08.05 ~> | 599.685 |
| ppi b163 | 13.053454163 | phi b163 | 08.10 ~> | 600.770 |
| ppi b164 | 13.091208510 | phi b164 | 08.15 ~> | 601.855 |
| ppi b165 | 13.129072053 | phi b165 | 08.20 ~> | 602.940 |
| ppi b166 | 13.167045109 | phi b166 | 08.25 ~> | 604.025 |
| ppi b167 | 13.208127994 | phi b167 | 08.30 ~> | 605.110 |
| ppi b168 | 13.243321025 | phi b168 | 08.35 ~> | 606.195 |
| ppi b169 | 13.281624522 | phi b169 | 08.40 ~> | 607.280 |
| ppi b170 | 13.320038804 | phi b170 | 08.45 ~> | 608.365 |
| ppi b171 | 13.358564190 | phi b171 | 08.50 ~> | 609.450 |
| ppi b172 | 13.397201003 | phi b172 | 08.55 ~> | 610.535 |
| ppi b173 | 13.435949565 | phi b173 | 08.60 ~> | 611.620 |
| ppi b174 | 13.474810199 | phi b174 | 08.65 ~> | 612.705 |
| ppi b175 | 13.513783229 | phi b175 | 08.70 ~> | 613.790 |
| ppi b176 | 13.552868981 | phi b176 | 08.75 ~> | 614.875 |
| ppi b177 | 13.592067779 | phi b177 | 08.80 ~> | 615.960 |
| ppi b178 | 13.631379952 | phi b178 | 08.85 ~> | 617.045 |
| ppi b179 | 13.670805827 | phi b179 | 08.90 ~> | 618.130 |
| ppi b180 | 13.710345733 | phi b180 | 08.95 ~> | 619.215 |
| ppi b181 | 13.749999999 A-1 | phi b181 | 09.00 ~> | 620.300 |
| ppi b182 | 13.789768958 | phi b182 | 09.05 ~> | 621.385 |
| ppi b183 | 13.829652939 | phi b183 | 09.10 ~> | 622.470 |
| ppi b184 | 13.869652277 | phi b184 | 09.15 ~> | 623.555 |
| ppi b185 | 13.909767304 | phi b185 | 09.20 ~> | 624.640 |
| ppi b186 | 13.949998355 | phi b186 | 09.25 ~> | 625.725 |
| ppi b187 | 13.990345766 | phi b187 | 09.30 ~> | 626.810 |
| ppi b188 | 14.030809873 | phi b188 | 09.35 ~> | 627.895 |
| ppi b189 | 14.071391014 | phi b189 | 09.40 ~> | 628.980 |
| ppi b190 | 14.112089528 | phi b190 | 09.45 | (One May Begin Using Interpolation Here) |
| ppi b191 | 14.152905753 | phi b191 | 09.50 | *Cool Red to..* |
| ppi b192 | 14.193840031 | phi b192 | 09.55 | (smoothly interpolate btwn last/next value) |
| ppi b193 | 14.234892702 | phi b193 | 09.60 | (smoothly interpolate btwn last/next value) |
| ppi b194 | 14.276064110 | phi b194 | 09.65 | (smoothly interpolate btwn last/next value) |
| ppi b195 | 14.317354597 | phi b195 | 09.70 | (smoothly interpolate btwn last/next value) |
| ppi b196 | 14.358764508 | phi b196 | 09.75 | *Very Cool Red to…* |
| ppi b197 | 14.400294188 | phi b197 | 09.80 | (smoothly interpolate btwn last/next value) |
| ppi b198 | 14.441943984 | phi b198 | 09.85 | (smoothly interpolate btwn last/next value) |
| ppi b199 | 14.483714244 | phi b199 | 09.90 | (smoothly interpolate btwn last/next value) |
| ppi b200 | 14.525605315 | phi b200 | 09.95 | (smoothly interpolate btwn last/next value) |

FIG. 31 continued

Voicing Music with Color Objects:

Basic Use Of Dimensions To Portray Time And Pitch
and other aspects of the music-interval-comprised data.

The x dimension can be used to portray time.

Or vice versa.

A z dimension can be added,
showing additional aspects.

Dimensions can be modified, (such as elongating one dimension relative to the other, twisting the space, etc.), and the desired association can remain, if not overdone. Too severe a modification will break it.

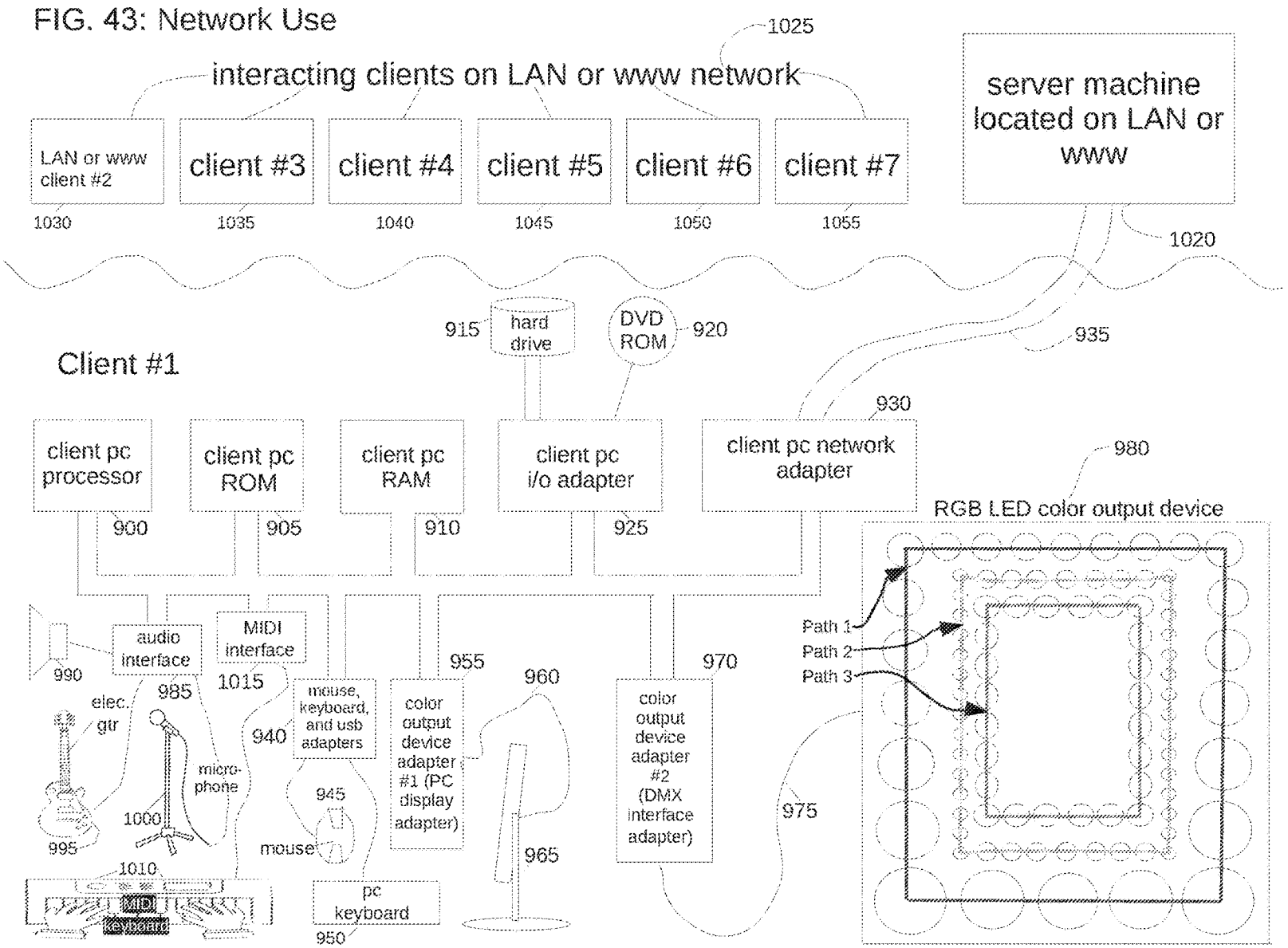
FIG. 43: Network Use
interacting clients on LAN or www network
1025
LAN or www client #2
1030
client #3
1035
client #4
1040
client #5
1045
client #6
1050
client #7
1055
server machine located on LAN or www
1020
935
980
RGB LED color output device
930
client pc network adapter
Path 1
Path 2
Path 3
975
970
color output device adapter #2 (DMX interface adapter)
920
DVD ROM
925
client pc i/o adapter
915
hard drive
960
965
955
color output device adapter #1 (PC display adapter)
910
client pc RAM
Client #1
905
client pc ROM
mouse, keyboard, and usb adapters
945
mouse
pc keyboard
950
940
MIDI interface
1015
900
client pc processor
audio interface
985
micro-phone
1000
1010
elec. gtr
990
995

"Melodic-Interval-Proximity-to-Spatial-Proximity-Along-a-Path" Mapping

"Pitch-Height"-To-Spatial-Size Mapping (pitch measured from arbitrary music interval bottom, or another chosen Pitch Origin.

"Chord-Member-Pitch-Hierarchy-Position-To-Relative-Spatial-Position-Along-a-Path" Mapping "Rhythmic-Interval-Proximity-to-Spatial-Proximity-Along-a-Path" Mapping Major Triad - Formula: 047 (with apprx 5:4 Major 3rd)

Major 7th – Formula: 047b - Major Family I Chord

Dom9 Chord – Formula: 047a2 – V7 Chord

Dom7 - Formula - 047a (5:4 Maj 3rd & barbershop 7th)

Figure 55: Exemplary Color-In Color-Out System
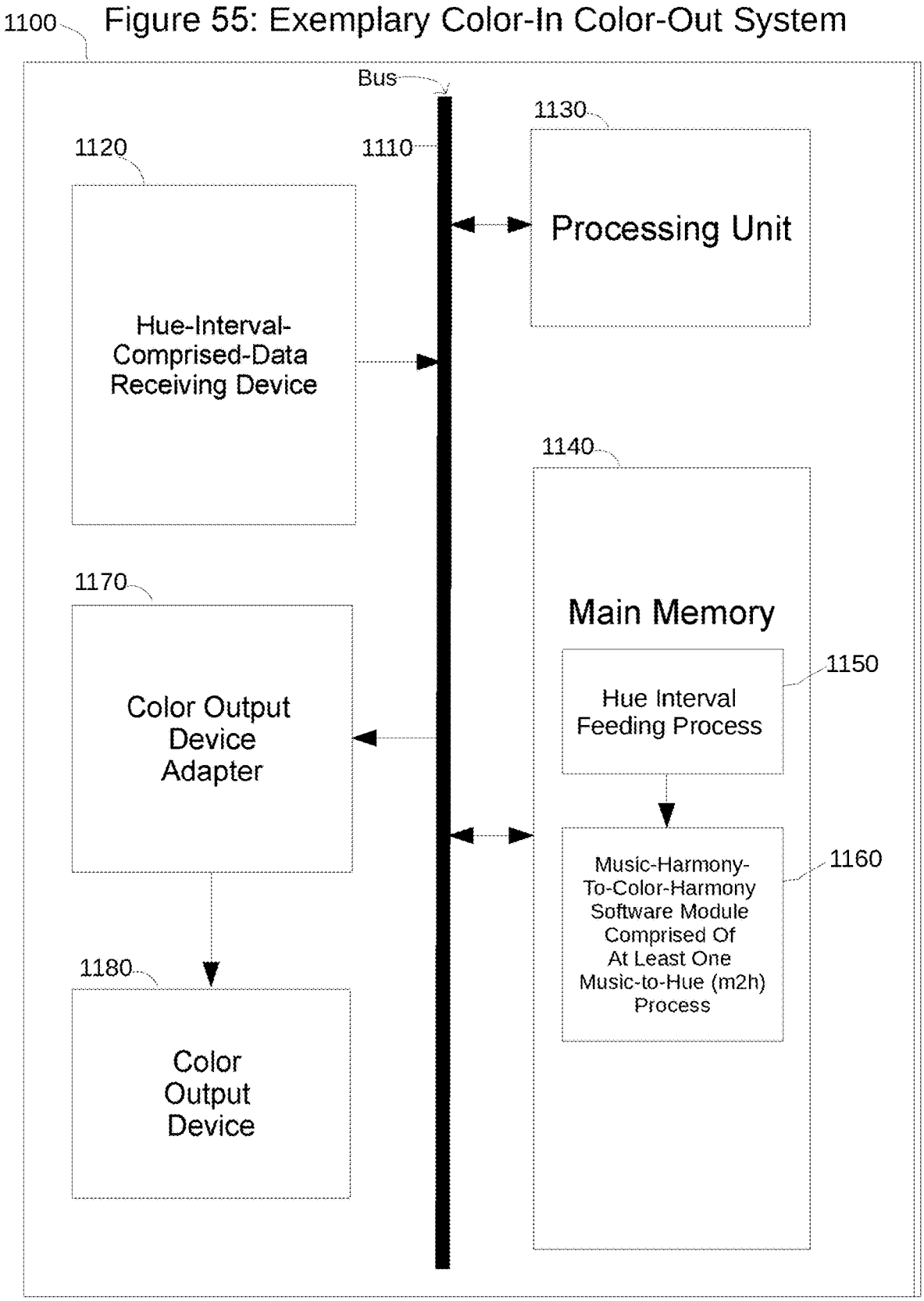

Figure 56: Exemplary Color-In Music-Out System
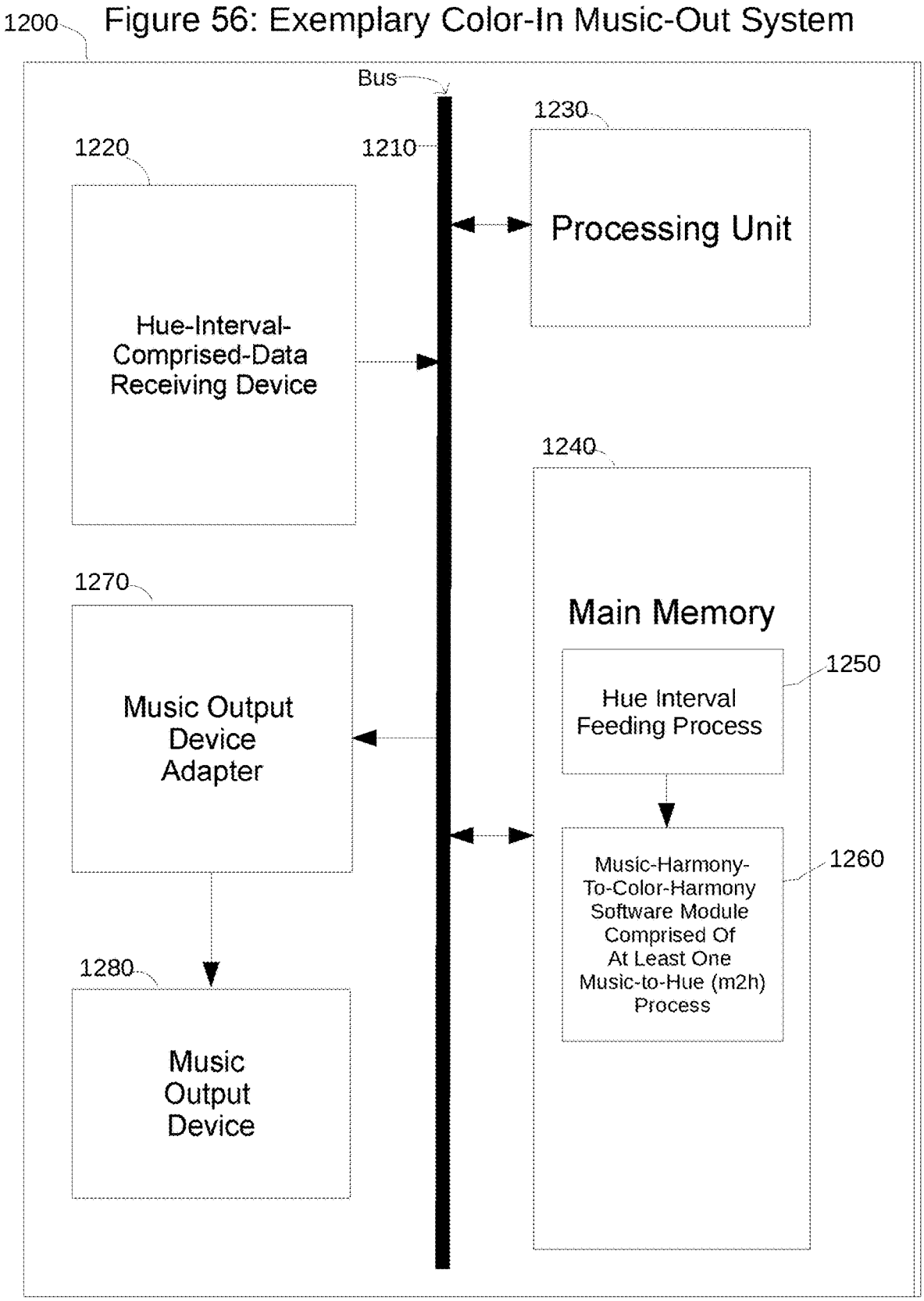

SYSTEM AND METHOD FOR GENERATING HARMONIOUS COLOR SETS FROM MUSICAL INTERVAL DATA

BACKGROUND

The present invention relates generally to a computerized system and method for improved selection and generation of color sets (color series and color combinations) and aesthetic color effects, via the use of music relationship methods and data. Color sets may be selected for viewing simultaneously or in animated sequences. This process is important for a number of fields, including those that employ pigment chemistry for color output, those that employ colored lighting for color output, and those that employ both lighting and pigment chemistry, such as in storefronts and theme parks. With respect to colored lighting output uses, effective selection of color sets is useful for marketing and entertainment purposes, such as for colored signage and colored product display uses, for architectural lighting, casino lighting, and entertainment and theatrical lighting.

Effective selection of color sets for computer games, console games, and virtual media may increase appeal or create intrigue and thereby interest. Effective selection of color sets is also beneficial in music visualization and VeeJay performance tasks. Color set selection is also important in pigment-employing fields including the field of personal beautification (clothing selection, cosmetic color-related decision-making), the field of interior and exterior design, and the field of marketing (e.g. logo design, packaging).

Often in the above cases it is desirable that sets of colors, in series or combinations, exhibit properties and qualities of color harmony along with exhibiting the traits of the individual colors. There is no general consensus, however, on what comprises effective color harmony. Without such a consensus there has generally been implementation of only basic color harmony rules for selection of color sets in software-utilizing systems that output variations of color for aesthetic purposes. Moreover where standardization of such software, including calibration means, would increase functionality and improve economy in certain scenarios (large scale events and theme parks for example) it has not been possible without more knowledge and consensus than what exists in the prior art. Moreover, in favor of use of the prior art "color harmony rules", there is much more often simply the employment of either methods of user direct and tedious selection, or artist-contributed presets. Or in some cases randomization is used. User selection requires skill, which is not always present, whereas obtaining artistic contributions are often expensive.

Apparently a robust and automatable algorithm-driven method appears lacking. Such a method should be capable of reducing the costs and limitations of generating improved color sets, and would provide the possibility of standardization. Ideally, such a method would be comparable to methods and technologies employing music theory which allows musicians and recording to compose and improvise musical pitch material.

Present day color harmony systems often employs methods and principles developed by, or extended from, those of Johannes Itten. Itten is often credited with having originated the term "color chords". He writes in his book, The Elements of Color, that, "Color chords may be formed of two, three, four or more tones, herein referred to as dyads, triads, tetrads, etc." While the term "chord" may bring to mind the chords of music, we were unable to find a record of Itten having a significant music theory background, so we do not know if music rather than geometry was the inspiration for his descriptive choice of "color chords". Over at least the past 500 years or so the functions of music intervals in chords and melodies (seen in discussions of voice leading, counterpoint, chord substitution and re-harmonization, and other music theory methods) have been written about extensively. With the advent of modern music technology, such functions now often receive intricate application by musicians who may not realize how much knowledge and theory they apply, especially relative to what was understood several centuries ago. This knowledge can often be applied independently from the particular pitches and tunings that are to be used, in what is known in music as 'transposition'. How one should compound Itten's "color chords", in contrast, is less precisely defined, although Itten's method does appear on the surface to offer useful music-like 'transposition' of color harmony relationships (whereby any relationship that is 'transposed' remains somehow similar). But Itten did not use the scientific primaries that are in use today when creating his relationships (e.g. dyads, triads, tetrads); rather he used the painter primaries (RYB). And the extensibility of his color chord relationships, in terms of their precise uses with one another, is not described, while in music theory the use of intervals and chords is given such added dimension (chords form progressions; melodies relate to chords, etc.). So, extending Itten's color chord relationships to more involved color sets comes down to artistic sensibility rather than understood processes, whereas musical relationships are quite extensible. The set of the pitches C and G is a good example of the way such extensibility arrives. C is understood as the harmonic root of this pair of pitches, and the function of the G:C relationship includes an understanding of how it relates and connects to other relationships; in the relationship each of the two pitches has a distinct role. Typically, other pairs of pitches (in the comfortably audible range) of approximately the same ratio can be assumed to function similarly. But for the dyads in Itten's theory, and the theory of color complements in general, the key color and complement are in a relative position with one another such that they can be considered interchangeable. If a certain yellow is considered the complement of a certain blue, then that blue is also the complement of that certain yellow; whereas G and C are not interchangeable, regardless of the octave in which each one appears—G is never the harmonic root of C (but F always is). Itten's further relationships of triads, tetrads, and etc. are also not defined in terms of larger constructs (i.e. constructs containing more colors). The rules for the applications of such color sets is simplistic; whereas in music common methods allow working in a variety of ways with a variety of interval types, each with unique attributions and distinctions, that can depend for their function on greater context (especially rhythmic context, such as downbeats versus off-beats). Unlike with Itten's system of dyads, triads, tetrads, etc., in a piece of music a chord's pitches can have different functions (for e.g. root, third, fifth, seventh, color tones). The stronger functions influence the building of melody. Even independent of knowing a chord harmony source, the pitches of the melody can often be distinguished as being particular chord tones, or passing tones, or chromatic tones. Simple melodies like "Three Blind Mice" often exist within understood harmonic contexts that are fairly clear even without seeing what chords should accompany them. In music this precision of contextual definition, with regard to such extensible relationships, exists whether the pitches are displayed in series or simultaneously. This permits one to predictably create pitch progressions of interesting intricacy, extending them into long sequences. Such extensibility would be the hallmark of a music-theory-like color harmony system.

Josef Albers's book Interaction of Color helps demonstrate that in color harmony, context is essential to describing relationships. Meanwhile physiological impact of each specific color in the set is a fundamental influence, added to unique and sometimes predictable psychological and cultural influences. These and other influences have been usefully surveyed in a variety of books, including Color Image Scale, by Shigenobu Kobayashi; Color Me Beautiful, by Carole Jackson; Making Colors Sing, by Jeanne Dobie; Art and Visual Perception, by Rudolph Arnheim; Visual Illusions; Their Causes, Characteristics and Applications, by Matthew Luckiesh; Color Science: Concepts and Methods, by Gunther Wyszecki and W. S. Stiles; and Computer Generated Color, by Richard Jackson, Lindsay MacDonald and Ken Freeman. Such material includes methods that could be incorporated into a robust method of color harmony, that would bring it to a level resembling the more precise nature of applied music theory, in which both interval constructs and the unique contexts and tonal textures are taken into consideration in methods of composition and orchestration. It would be most helpful if rules of music could somehow be incorporated into technologically applied color harmony algorithms.

We note that a fundamental connection between music and color, as had been sought by Isaac Newton and others, has appeared not to exist. Isaac Newton formulated his breakthrough discovery of the nature of light seen in a prism in approximately 1666 (which he published in 1672), and during this period he also documented his concept of a possible association between visible spectrum colors and musical pitches. Although his music-color association was not given merit by the scientific community, his concept of the "color wheel" (connecting the bottom and top of the visible spectrum in a circle) remains a useful visual reference.

More recently, other methods of relating colors and pitches have been offered. But wide adoption has not occurred. One particular method that has been postulated for some time, is referenced by the musical tuning researcher Charles Lucy. In Lucy's method one simply multiplies the frequencies of musical pitches by a high enough number until they reach the frequencies of visible colors. These visible color frequencies are then held to aesthetically correlate to the source musical pitches. This method holds that a color scale directly corresponds with the musical scale. But there are individual colors that have no associated frequencies (e.g., red purple colors). One can obtain these colors only through an admixture of colors. This awkward theoretical approach has not been shown to be effective.

None of the prior art methods of relating colors and pitches have been widely confirmed and widely adopted within technological markets.

Presently there are popular music visualization methods that are quite effective in producing visually harmonious experiences while listening to music, but they do not offer a correlation between generated color sets and the music interval structures that are being visualized namely chord and melody progressions. Instead, the pixels arrangements generated by these methods follow the music's waveform, but the colors are selected via are color presets (called color maps) that are entirely unrelated to the musical content. The music's waveforms, as interpreted by such methods do generate pixel motion that correlates both with the musical dynamics and the music's evolving frequency mixtures. This result is then further modified using a math-aesthetics-based methodology (that is also unrelated to musical input), to provide an aesthetic spatial flow. Again, neither the color maps (of these methods), nor the modifiers (applied to 'move pixels' over time and create the illusion motion) are musically related. So, while these methods could be integrated with a new method that would correlate music interval structure with colors sets (as color series and color combinations), they are presently devoid of such a correspondence.

Meanwhile prior art color harmony often limits the number of vibrant colors to allow it to remain effective, such as by use of monochromatic color harmony themes or analogous themes, or by using split complements. This limitation is acceptable when artistic input is achievable (due to available economics and time). But in certain applications it can be a significant shortcoming to require severely limiting the number of vibrant colors within a color set; for example, in intense multimedia and advertising applications, concert lighting, casino lighting, signage, and music visualization. It is definitely a shortcoming when such applications require or benefit from rapid color changes or benefit from use of a more extensive palette of vibrant colors (or more than one such palette), or when the applications should operate and provide intricate changes in real time.

In summary a consensus regarding color harmony methodology is lacking, and in the prior art there is not a method of color harmony having the extensibility of music theory methods. Nor is there the ability in the prior art to algorithmically offer reasonably intricate and harmonious use of a multitude of vibrant, changing colors. Furthermore, in the prior art there is no widely accepted correlation between music and color, whereby musical interval constructs relationships may be utilized or visualized as qualitatively functionally corresponding color sets. (E.g., major, minor chords, diminished, augmented, and dominant seventh chords, and the like.)

SUMMARY

The present invention relates to systems and methods for generating colors sets based on principles of musical harmony and dissonance. Just as musical pitches may be combined in pleasing combinations and sequences, different color hues may be combined to create pleasant visual experiences akin to those experienced while listening to music. Furthermore, the music listening experience may be enhanced by presenting colors which take their visual harmonic cues from the music being performed.

According to an embodiment of the invention, a system for generating color sets based on concepts of musical harmony includes an input device, a computer processing unit a computer memory and a color output device. The input device is adapted to receive pitch interval data. The computer processing unit is adapted to execute software instructions which are stored in the computer memory. The software instructions include a pitch analysis module for identifying pitches and pitch intervals within pitch interval data received by the input device. The software instructions further include a music-harmony-to-color-harmony module that executes at least one music-to-hue process that identifies one or more color sets based on one or more pitch intervals identified in the pitch interval data. Finally, a color output device is provided which is adapted to generate one or more color objects having a hue belonging to a color set identified by the music to hue process. The music harmony to color harmony module defines a music to hue index that defines a spectrum-like tuned hue gradient that includes a plurality of discrete dominant-wavelength hue notes ordered by increasing wavelength. The hue gradient includes a relatively smaller plurality of interpolated hue notes which mix varying amounts of color from each end of the hue gradient. The interpolated hue notes provide a smooth color transition between each end of the hue gradient. Each hue note, both dominant wavelength and interpolated hue notes, is assigned a unique tuned hue interval variable and a unique tuned hue interval angle between 0° and 360° such that each hue note corresponds to a unique angular location around a tuned hue chromatic circle. The at least one music to hue process includes identifying a pitch interval received by the input device. Such pitch intervals generally include a bottom pitch and a top pitch. The music to hue process identifies an interval angle associated with the received interval. The music to hue process associates a first hue note with the bottom pitch to define a color key and identifies a second hue note separated from the first hue note by a tuned hue interval angular amount equal to the pitch interval angle associated with the received pitch interval. Finally, tuned hue interval variables associated with the first and second hue notes are provided to the output device, which generates color objects the color of the first and second hues.

According to another embodiment, a method of generating a color set calls for generating a pitch index including a plurality of pitch classes. Each pitch class is separated by a predetermined frequency ratio, and all of the pitch classes together correspond to a musical octave. The method then calls for assigning a pitch angle to each pitch class such that the pitch classes represent unique locations around a single octave music chromatic circle. A first pitch class is designated as a pitch root. The pitch root is assigned a pitch angle of 0°. A hue index is also generated that includes a plurality of differently colored hue notes arranged in a tuned hue gradient. A hue angle is assigned to each hue note such that the hue notes represent equally spaced unique locations around a tuned hue chromatic circle. The inventive method then calls for designating a first hue note as a hue tonic and assigning a hue angle of 0° to that hue note. When a first pitch is received the method calls for determining which pitch class the pitch belongs to. Then a first pitch interval angle is identified that is equal to an angular separation between the pitch classes of the first pitch and the pitch root. A second hue note is then identified which is separated from the hue tonic by a hue interval angle corresponding to the first pitch interval angle. A color set is generated that includes the first hue note and the second hue note.

In still another embodiment, a method of generating harmonious color sets calls for creating a tuned music chromatic circle that represents a plurality of tuned pitch classes evenly distributed around the circumference of the tuned music chromatic circle; creating a first tuned hue chromatic circle co-centered with and having a diameter different from the diameter of the tuned music chromatic circle; and creating a second tuned hue chromatic circle substantially identical to and co-centered with the first tuned hue chromatic circle but having a diameter different from the first tuned-hue chromatic circle and the tuned music chromatic circle. The first and second tuned hue chromatic circles represent tuned hue gradients including a plurality of distinct hue notes evenly arrayed around the circumference of the tuned hue chromatic circles. The inventive method then calls for specifying a music root note on the tuned music chromatic circle and a particular hue note as a hue root note on the first and second tuned hue chromatic circles and aligning the hue tonic notes on the first and second tuned hue chromatic circles with the music root on the tuned music chromatic circle. Once the tuned hue chromatic circles are appropriately aligned pitch interval data can be received and analyzed. Pitch interval data includes a first pitch belonging to a first pitch class and a second pitch belonging to a second pitch class. Analyzing the pitch interval data includes identifying the first and second pitch classes and identifying a first interval angle between them. Once the incoming pitch interval data has been analyzed, the method then calls for rotating the second tuned hue chromatic circle by an amount corresponding to the first interval angle and creating a color set that includes a first hue note from the first tuned hue chromatic circle and a second hue note in radial alignment with the first hue note from the second tuned hue chromatic circle.

BRIEF DESCRIPTION OF THE DRAWINGS

FIG. 2 illustrates an exemplary system for generating color sets;

FIG. 3 illustrates an exemplary method for generating color sets;

FIG. 4 illustrates a 240-hue resolution Tuned Hue Chromatic Circle (THCC) along with an exemplary demarcation of the ranges within and outside of the dominant wavelength window (DWW);

FIG. 9 illustrates the necessary 3 criteria for music-to-hue (m2h) functional correspondence in table form;

FIG. 27 illustrates the interval helix, a means of visualizing and providing a graphical user interfacing for simultaneous interaction according to octave-reduced intervals and non-octave-reduced intervals;

FIG. 30 illustrates an example of m2hcmb's in a table (shown relative to their dominant wavelength values if they are within the DWW);

FIG. 31 illustrates an exemplary default table with Prime Pitch Index (PPI) bins and Prime Hue Index (PHI) bins, both of which may have their intervals independently offset via independent Music Tonic Offset (MTO) and Hue Tonic Offset (HTO) interval offset variables;

FIG. 43 illustrates a networked use of an embodiment of the invention;

FIG. 55 is a block diagram of color-in color-out system according to an embodiment of the invention.

FIG. 56 is a block diagram of a color-in music-out system according to an embodiment of the invention.

DETAILED DESCRIPTION

Figure 1:
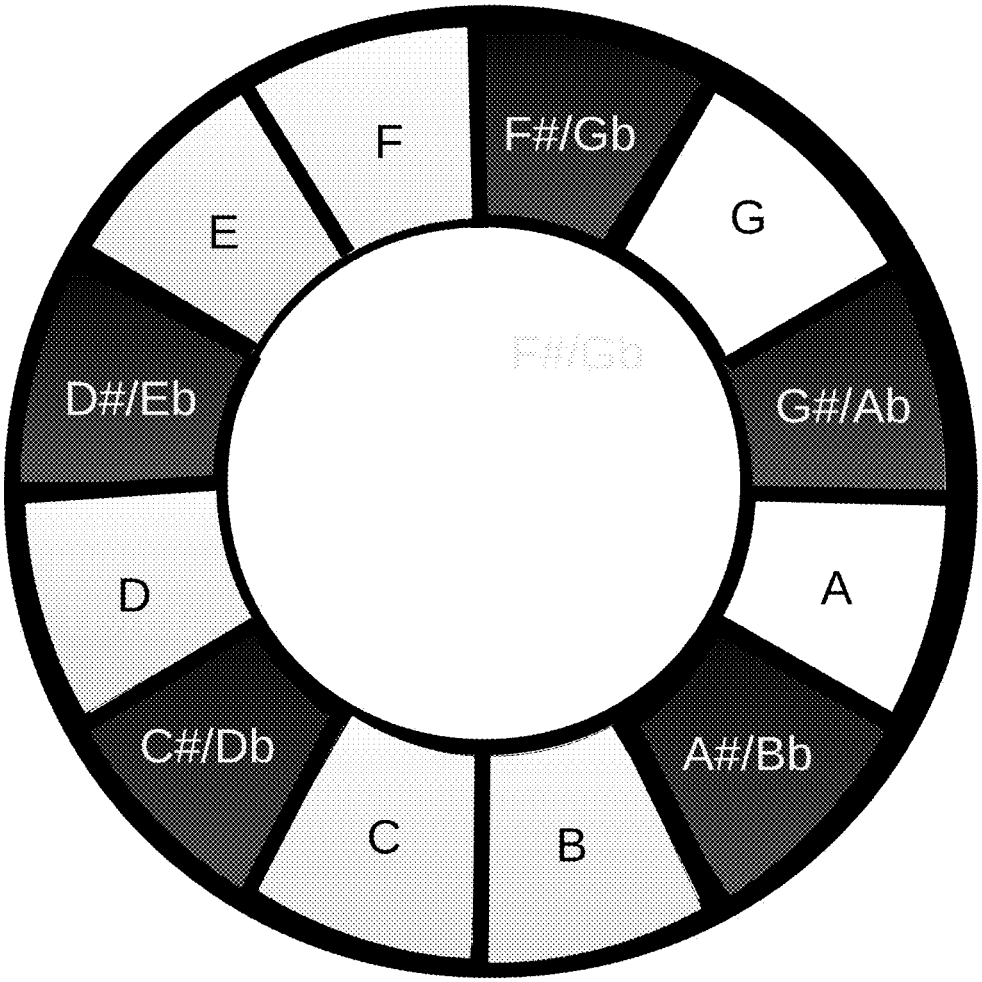
FIG. 1 illustrates a pitch chromatic circle.

Referring to FIGS. 1 and 2, an embodiment of a computerized system 100 and method 200 is disclosed for improved selection and generation of color sets and color harmony effects via use of music relationship methods and data. The music-to-hue process (m2h process) is assumed calibrated so that by definition the hue intervals determined by the m2h process should satisfy the disclosed necessary 3 criteria for functional correspondence (see below). The m2h process is configured to, upon receipt of a set of music intervals, determine a functionally corresponding set of hue intervals in the form of thiv's, and output these via the at least one-color output device adapter on said at least one-color output device as sets of analog colors.

Music Protocol Data

By 'music protocol data' in the present disclosure we refer to data representing music in a non-analog or in more-than-analog way, where music intervals are distinguished in the data; Examples of such data include music protocol hardware interface data and music protocol sequence data (e.g. MIDI or OSC data or similar).

Color Vibrancy

When describing hue intervals, we are most typically referring to color relationships formed of vibrant colors.

While the precision to be obtained can depend upon the purpose of an embodiment, it is assumed per present research that both more precision and greater color vibrancy of the colors being output will markedly improve effectiveness. With respect to vibrancy there are certain hues that may be problematic. When one is attempting to use the full range of possible hue interval constructs, in every hue tonality, as provided by the method, one should take care that these are as vibrant as possible.

As far as vibrancy is concerned the Bluish-Green and Cyan ranges can sometimes be problematic in additive 3-primary systems since it does not use a Cyan primary (images viewed on typical computer displays containing cyan water often appear whitish for example when viewed next to the actual thing), and the Blue range and Warm Green range can be problematic in subtractive 3-primary systems which do not use a Blue or Green primary. Meanwhile unfortunately the Orange range is apparently somewhat problematic in both systems, where when attempting the most highly vibrant Orange obtainable on one of these system types, it can still often appear moderately or slightly brownish. And while apparently we are not used to exceptionally vibrant orange from either 3-primary computer displays or 3-primary print media, for the present method there is a decrease in functional correspondence that comes as a result of this diminished vibrancy (especially notable when attempting to establish a hue tonic of orange). To better appreciate and understand this one can compare certain flowers in nature or compare the orange band produced from Sunlight through a prism or diffracted by the surface of a CD, both of which are known to display intensely vibrant Orange. It bears mentioning that this decreased sufficiency of 3-primary systems with respect to Orange may partly relate to where Orange appears on the Munsell Color Solid. Note that it extends out into the higher Chroma ranges only at high Value levels. These high Value levels require brilliance and intensity not always easy or economical to achieve. The failure may also partly be because, along with that requirement of intensity, Orange in typical 3-color primary systems is itself neither an additive or subtractive direct primary—and the requirement to mix two primaries significantly (each of which have some impurity) may decrease the vibrancy of a target color. (Yellow has an advantage in additive 3-primary use since it is often achieved by full intensities of Red and Green. One must reduce Green to achieve Orange, decreasing intensity and thus decreasing the appearance of vibrancy at the same time).

Thus, when viewing the additive examples in this disclosure, particularly concerning hue tonality, do please note that hue tonalities featuring such problematic colors (particularly Orange and Cyan; since these are the most problematic of the additive-3-primary hues) are less effectively demonstrated, and to demonstrate them most effectively will require the more vibrant hues not always obtained on typical workplace display screens. And note that for the present invention hues will be most appropriate when those that relate to music intervals occurring on downbeats are displayed in the most vibrant state available.

Introducing the DWW

A few basic aspects that relate to color science and color selection will now be delineated. Target colors are often described herein in terms of Dominant Wavelengths and in terms of CIE-based color science. After much experimentation and observation, the present invention appears to be the result of conceptually parallel (but very distinct) functions of human sound and light perception physiologies. But these conceptually parallel functions are not obvious. Foremost, human physiology does not allow human eyes to perceive even an octave's worth of frequencies or wavelengths of light. Also, one might have assumed at first glance that there is a somewhat definite division between the range of visible spectrum colors and the colors outside this (i.e. colors not able to be approximated using monochromatic wavelengths such as red). But actually, one apparently needs a minimum of three ranges to describe the invention. It seems that at the boundaries (borders) of the visible spectrum range our human perception may not abruptly cease. For this reason, in the present disclosure we use a construct we call a Dominant Wavelength Window (DWW) with the intention of excluding colors that may be in a range of gradual cessation of color perception (typically erring greatly on the side of caution). Herein we will define a DWW as ranging from 425 nm to 625 nm. We limit the descriptions involving dominant wavelengths and monochromatic wavelengths to this Dominant Wavelength Window (DWW).

Again, embodiments will vary in terms of color output devices and their capabilities. An embodiment that can produce a full color wheel's worth of vibrant colors will demonstrate the invention more fully. And moreover, many of the perceptual effects of color sets of the present invention are most strongly obtained when colors are highly colorful like their 1-nm-limited monochromatic cousins (if within the DWW). (Using the diffraction properties of a typical CD held in sunlight can also reveal such vibrant colors). When the color is derived from a particular dominant wavelength, if it is less than exceptionally vibrant then it should be found and determined in reference to lines of constant hue (understood in prior art color science). The hue of the color should appear as similar as is possible to the hue of the intended monochromatic wavelength value by which the dominant wavelength is named. (E.g. a vibrant color with a dominant wavelength of 450 nm will appear like a monochromatic wavelength of 450 nm, but a less vibrant color may not, and may need to be adjusted using the aforementioned lines of constant hue as a reference). This concept with respect to lines of constant hue will be elaborated on a bit more later.

Music Theory, the Musical Chromatic Circle & Octave Reduction

Next, to describe the invention requires outlining a few basic music theory concepts, including the musical Chromatic Circle, and Octave Reduction. (Herein 'Chromatic Circle', unless otherwise indicated, refers to the musical Chromatic Circle). We will also describe the "Tuned Hue Chromatic Circle" (THCC), which will be based on the musical Chromatic Circle. The THCC illustrates the colors to be determined by the m2h process (such as in an m2h index and/or by an m2h computation/interpolation process.

FIG. 1 illustrates some of the important concepts of music theory that will be utilized in the present invention and its disclosure that we feel should be explicitly defined to avoid misinterpretation. Most essentially this figure delineates basic interval construct use. Such interval construct use will be further disclosed with reference to the musical Chromatic Circle and the THCC.

We can use the modern plano as a typical Western musical instrument. Musical notes on the modern plano repeat at a rate of every 12 plano keys, and these repeating notes sound similar to, and can substitute for, one another. A handy way of showing this repeating music note relationship is the musical Chromatic Circle. The musical Chromatic Circle is a geometrical space showing relationships between the 12 pitch classes making up the familiar chromatic scale (ordering them around the circle at −30° [as central angles] each as they progress upwards by semitone). We can explain it like this: Starting on any pitch of in the mid ranges of the plano and repeatedly ascending or descending by the musical interval of a semitone, one will eventually land on a pitch with the same pitch class as the initial one, having passed through all the other equal-tempered chromatic pitch classes in between. The musical Chromatic Circle shows this circular relationship among pitch classes.

Details of the Musical Chromatic Circle, Tunings, and Cent-Resolution

Larger motions than a musical octave on the plano (or in pitch space) can be represented by paths that "wrap around" the musical Chromatic Circle, once for each octave. Wrapping clockwise represents going up an octave, and wrapping counter-clockwise represents going down an octave.

Note that though the musical Chromatic Circle most aptly describes the 12-ET tuning, it is also used herein to roughly describe many modern tunings. With generic semitones (not divided into 100 precise 12-ET cents) it can represent most 12-pitch-per-octave tunings (with enharmonic pitches that are tuned so as to equal the same pitch, e.g. Ab, G#, etc.) because it can generically describe how typical semitone intervals behave when combined into chords and melodies, as well as how octaves repeat in such tunings. The present method of working with pitch as functionally corresponding with hue requires this degree of tuning precision. So the generic intervals comprised of musical semitones are achievable in a variety of tunings, and numerous of these tunings can be used to perform pieces of music; so they could be used as a basis for a basic THCC. But more precision is desirable and readily obtainable. To this end we prefer to use a 12-ET musical Chromatic Circle for a descriptive aid and GUI in embodiments of the present invention, and in this preferred 12-ET musical Chromatic Circle we prefer to further subdivide each −30° semitone. We can further subdivide each into one hundred 12-ET cents (a 0.3° central angle for each upward musical cent), or into fractions of cents, to show correspondence with precise cent and semitone intervals per 12-ET tuning, so that interval relationships comprised of smaller-than-semitone values can also be conceived of and viewed in terms of central angles. This enabled the conception and viewing of the nuances of vibrato and pitch bend. It also permits the representation, on both this precise 1200-ET musical Chromatic Circle, and a THCC based upon it, of all octave-based tunings, including non-enharmonic ones. But herein in our examples we will only subdivide the semitones of the musical Chromatic Circle into 20 increments of 5 cents each because it is sufficient to demonstrate the concepts.

In music the pitch classes repeat in octaves, and the repeating notes sound similar to, and can often substitute for, one another. And cent-based intervals repeat and sound similar in octaves as well. So conceptually, and programmatically in terms of music theory-related technologies, pitches and finer interval divisions like cent-based ones may be sometimes treated as being within the compass of a single octave. This conception is called octave reduction. The musical Chromatic Circle can be used to show this conception of octave reduction if one assumes one of the pitches on the musical Chromatic Circle is the interval bottom of the interval construct; this interval bottom need not necessarily be the pitch A, or the pitch C. Simply speaking, to represent intervals in octave-reduced form one is stating them and considering them (often in ratio form) in relation to a specific interval bottom. (The interval construct can be a simple two-pitch interval or it may comprise more than two pitches. If the interval construct is a chord then the interval bottom can be its chord root. If the interval construct is a piece of music, this interval bottom can be the music tonic. If the interval construct is unknown, as with some embodiments of the present invention, then the interval construct is generic, having an arbitrary music interval bottom, aka AMIB) (I.e. the starting pitch that is the bottom of the interval construct is selected as the starting point on the circle. The other octave-reduced members of the interval construct are located on the circle as ray points at various degrees from the interval bottom, and neighboring ray points have negative central angles between them as well. Since by convention the musical Chromatic Circle pitches travel upward clockwise, and by convention clockwise central angles on a circle are described as being negative, central angles for intervals within the single octave of the musical Chromatic Circle will be from −0 to −360 degrees of that starting point. These are referred to herein as 'interval angles'.)

Note that although we use the term 'tonic', the incoming music-interval-comprised data may at a given time comprise a single music chord, and the hue data being processed at a given time may comprise a single hue chord. In these cases the terms music root and hue root may sometimes be more appropriate, but the intended meaning of 'central member of a set of intervals' will be the same.

Invention Best Conceptually Understood as being Represented by Two Circles

With the above music theory understood, next an exemplary conception of the invention is obtained by visualizing two circles that share a common center. Interval angles from the centers of both of these circles are representational of tuned intervals. We can begin such an angle from any arc starting point. The starting point represents the tuned interval bottom. Interval angles on one circle represent music intervals. Interval angles on the other circle represent hue intervals. (Note that specific pitches and colors in this conception are less significant than the intervals formed on the two circles.) One of the two circles is the musical Chromatic circle described immediately above, and it represents pitch classes and octave-reduced music intervals (of analog musical pitch). In our two-circle visualization this musical Chromatic Circle essentially represents the measuring of music intervals.

Introducing the THCC

The second circle will represent hue intervals (comprised of vibrant analog colors). We call this the Tuned Hue Chromatic Circle (THCC), and it visualizes the hue intervals that the present system and method will produce as analog color output. We can visualize the musical Chromatic Circle as being within the THCC for consistency with the later figures.

The THCC forms a tuned hue gradient that is designed to approximately functionally correspond to a one-octave continuum of generic music intervals. For simplicity herein we term this a hue octave (figuratively only; not implying that the range is an actual octave). While some less common variations of the method may alter the THCC slightly, relative to successive octaves of musical pitch (not akin to stretching musical octaves, but to slightly distinguish different octaves of the same pitch) nonetheless the gist of the conception remains the same, in that the THCC approximately corresponds to musical octaves.

The suggested accuracy of the THCC is at least to within 1/24 of the THCC. A special series of 24 hue names is given in FIG. 10 that can help one understand this requirement. As an example yellow is at 577 nm, while yellow orange is at 588 nm. If the hue interval called for included yellow, and yellow orange were substituted for it, the intended result would be less likely.

It is important to understand that the tuned hue gradient being visualized in analog form in the THCC represents a measured ordering of hue intervals. On the one hand it represents the tuned hue gradient producible by the thiv's of a m2h process as analog output if their hues were produced in series (but with the important feature being that the thiv's exist in mathematically predictable positions). So the THCC represents the tuned hues of the m2h process, which provides a hue tuning. The hue tuning offers a parallel effect to what would happen if one a) played a succession of intervals on a tuned musical instrument; wherein the purpose is to provide a similar ability to that of being able to easily trigger musically desirable values on a tuned musical instrument.

In one embodiment a display screen is made available to visualize the THCC as an interface to select and view hue intervals.

Types of Thiv's

Types of thiv's (or types of an m2h process based on them) can be formulated according to the nature of the color output device being used to produce the analog color.

In one type of m2h process each thiv defines a mechanical setting for obtaining the intended hue, such as an orientation for a multicolored lens, or a set of digital lighting protocol controller values (such as a set of DMX color mixture controller values).

In another type of m2h process each thiv stores an electronic state that results in the intended hue.

In yet another type of m2h process, each thiv defines a color mixture value (e.g. an RGB or CMYK pixel value).

In yet another type of m2h process each thiv is a variable value quantifying the hue-component portion of a complete color value, for example such as exists in a hue-component-comprised color space (such as the spaces HSB, HSV, HSL, and more accurate modern spaces of color science where applicable). When this type of thiv is accessed, this hue-component variable value is then combined with any other color-component values needed (in the particular space), as will be defaulted, generated, or accessed from other data sources available in the system, to generate a complete color. (As an example, the last MIDI velocity value on a channel could generate a Saturation level.) This enables achievement of a hue interval that can be adjusted creatively, or to reflect different music note timbres, or to reflect progress through note envelope of various kinds.

In still yet another type of m2h process, each thiv is a variable value quantifying the hue-component portion of a complete color value, which is to be approximated after procedurally including texture components, or texture and lighting components, for cases where the target color object is a texture-based color object (an color object that is generated using texture methods, that permits control of a significant portion of the object's hue property.) In non-realistic lighting scenarios the target color object can be color-adjusted by direct adjustment. In more realistic lighting scenarios the target color object can have its appearance color-adjusted through a test/evaluate process run on a set of pixels so as to approximate a target hue—for instance if a target color object was comprised of a glass or metal texture, to reach a target hue the procedure would require computing the scene lighting onto the glass/metal texture for multiple iterations in order to arrive within a hue range deemed a passable approximation of the thiv hue.

DWW Values as an Aid to "Tune" the Majority of an M2h Process

The DWW-portion of the colors of an m2h process can be formed by the developer according to prescribed dominant wavelength spans between the thiv's. Dominant wavelength values within the Dominant Wavelength Window (DWW) can define approximately 39/48ths of this more precisely tuned THCC. Thiv's for the non-DWW-related remaining approximately 9/48ths of the THCC may then be interpolated from the ends of this resulting range of DWW thiv's to smoothly connect them and add in the non-DWW color range, as illustrated in FIG. 3 (further described below), roughly maintaining the smoothness of the hue gradient. It is preferable that the THCC appears as a visible-spectrum-like hue gradient. [Note that by use of the term "spectrum-like" we do not imply that the method is evident in nature. The method's discovery has been a counter-intuitive. Not only does the visible spectrum not comprise a true mathematical octave, but also the 'hue semitone rate' is not evident, and there is no obvious cutoff at visible-spectrum borders from which to deduce these, or other aspects of a hue tuning rate or method. These matters compound the elusive fact that the functionally corresponding hue semitones within the method operate in the inverse direction to the semitones in music. (E.g. in an upward P5 from C to G, G is increased in frequency over C, whereas in the method's upward P5's, when comprised of visible spectral hues within the DWW, the "interval bottom" is increased in wavelength, not frequency, over its "interval top".) For these reasons the method's tuning principles are not obtainable directly from nature]. At step 270, the music interval feeding process feeds the music intervals received in the music-interval-comprised-data into the music-harmony-to-color-harmony software module. At step 280, corresponding hue intervals for said music intervals are determined by the music-harmony-to-color-harmony software module's m2h process. At step 290, the system outputs the determined tuned music-like hue intervals on a color output device, via a color output device adapter. If the music-interval receiving process has been terminated, decision 300 proceeds to the 'Yes' branch to End at step 310. If the music-interval receiving process has not been terminated, decision 300 proceeds to the 'No' branch to loop back to step 270.

FIG. 4 shows a 240-Res THCC (representing 240 thiv's in a 240-Res m2h index, thus having 240 "color chips" on the THCC). While the musical Chromatic Circle, as was stated above, is for visualizing the measurement of music intervals, the THCC is for visualizing the measurement of hue intervals; and the relationship of the two circles, being offset-able around a common center, is for visualizing the offset-able functional correspondence between those intervals of the musical pitch and visual color domains. The musical Chromatic Circle spans a series of 12 chromatic pitch classes and then wraps (moving up to the next octave if completing the clockwise circle, and moving down to the next octave if completing the counter-clockwise circle.) Similarly, when correlating hue intervals with musical pitch intervals that climb or fall by more than an octave, one performs a "wrap around" (i.e. using modulus) in the m2h index (with the modulus value being the resolution of the m2h index thiv's). This can easily be visualized by continuing on around the THCC (one wrap around per octave).

Resolution of the THCC

The m2h index and THCC may be used in a resolution comprised of as few as 12 hues (A 12-Res m2h index and a 12-Res THCC), but this is not extremely useful. The nuances of music that exist in the finer pitch variations than semitones add a great deal of impact to our musical experience. The approximate minimum resolution that should be employed to achieve functional correspondence with musical vibrato, pitch bend, and also tuning variations is about 240-Res (Humans are said to be able to distinguish about 200-400 hues but these are not distributed in any equal way so actually higher resolutions are preferred). In terms of measurement in 12-ET musical tuning (that the THCC will most often approximately correspond with for reasons stated above) there are 1200 musical cents in a musical octave. 1200 cents/240 color chips=5 hue cents per color chip. In other words each color chip corresponds to a musical interval of 5 cents.

In summary the two circles are a means to visualize offset-able functional correspondence between intervals of the musical pitch and visual color domains. This functional correspondence is actually achieved using the m2h index, which is fed, via a music interval feeding process, music intervals obtained from data from the music-interval-comprised-data receiving device. Once fed into the m2h index by the music interval feeding process, corresponding thiv's for the music intervals are found in the m2h index.

In one embodiment the music-interval-comprised-data receiving device would be a hardware device that provides music interval source data. In another embodiment the music-interval-comprised-data receiving device would be a software device that provides music interval source data. In one embodiment the source data received is stamped to indicate multiple music interval source tracks. In one embodiment the source data is stamped to indicate multiple music interval source channels. The music interval feeding process finalizes the music-interval-comprised data for entry into the m2h index. In one embodiment the m2h index is constructed so as to look up octave reduced music intervals, and finalization includes octave-reduction of the music intervals prior to feeding them into the m2h index.

In one embodiment finalization by the music interval feeding process also includes creation of one or more of the following: time stamps, track stamps, channel stamps, and layer stamps. In one embodiment finalization by the music interval feeding process also includes routing per one or more of the following: time stamps, track stamps, channel stamps, and layer stamps. And in one embodiment, additionally, the music-harmony-to-color-harmony software module includes a distribution process module that will distribute the hue notes obtained from the music intervals, per one or more of their time stamps, track stamps, channel stamps, and layer stamps, onto particular color object arrays, and, in accordance with the time/channel/track information, onto particular color objects within said color object arrays. See FIGS. 44-56. (Note that the music interval feeding process may of course receive intervals that are already time stamped, or already marked relative to their independent input source tracks and channels. But finalization may add additional information to such stamping, or re-configure it in some way, in either case for providing enhanced flexibility or quality.) In the case of music protocol data, e.g. MIDI, there will normally already be MIDI channels that can be parsed and further utilized as needed, and MIDI MTC values can be utilized as usual. In the case of MIDI files there may be multiple tracks in a file (MIDI File type 1), and this information can be utilized, or the track information can be derived from the MIDI channels (MIDI File type 2). In the case of the music-interval-comprised data being digitized audio, it will normally be received via multi-channel digital audio cards, with the digitized music from these channels being processed separately for pitch detection and placed in separate locations or with it being stamped according to source channels. The information as to time stamps, track stamps, and channel stamps can be utilized.

The music interval feeding process, relative to this time stamps, track stamps, and channel stamps information, may allow user configuration to direct such varied input to the specific color object arrays, according to specific mapping methods (see FIGS. 37-49). This can be implemented in a more developed music-harmony-to-color-harmony software module that includes a routing GUI for the user. This can be done by providing, for each track or channel, a default and user editable 1) mapping method and 2) at least one-color object array as the target for the mapping. It can help to also provide a layer value for each track and channel, which can be used to allow multiple arrays to be directed to the same color output device pixels, with tracks or channels with higher layer assignments taking priority or precedence over lower layers (over-writing them, with only the top layer for each pixel "wining" upon output). (There is also a specialized case due to the fact that color can be characterized as having multiple properties. For example color can be algorithmically divided into the properties of Hue, Saturation, and Lightness (HSL). A mapping method can therefore be assigned to a track or channel whereby one of the properties "bubbles up" to take precedence over some designated higher layer; while the other color properties from that channel maintain their assigned priority. One example of using this has been called a "twinkle layer" mapping method. This method utilizes a rhythm pattern in the music, or percussion elements in the music; but simply "lightens up" the existing color of an affected color output device pixel.

A system can have a basic setup that includes a basic music-interval-comprised-data receiving device. More advanced systems can include music-interval-comprised-data receiving devices attached to music interval generating or processing devices. There are many creative music theory processes of music generation and re-composition. Improvisation generators can be used that weigh a group of weighted pattern segments and pleasingly fabricate a resulting music interval output. Chord substitution, harmonization, and re-harmonization can also be used on existing music intervals. These are all well understood and can be accomplished via simple mathematics, and/or simple lookup tables. For example, one can take a group of intervals in one scale (for e.g. C Ionian) and re-harmonize them into a new scale (e.g. C Dorian). If one doesn't know the original scale, or if the new scale has less notes, one can force music intervals into any 'target' mode by simply making the rule to always move out-of-key notes up to the next available in-key note (or down to the next available in-key note).

Other methods in music, such as arpeggiators, step sequencers, and single-note-to-chord tables can also be used in combination with user MIDI instrument performance, or with computer-interface & GUI-aided music sequence entry methods, to originate or creatively enhance the music-interval-comprised data.

The music interval feeding process may be configured so as to accommodate the receipt and coordination of such varieties of possible material. Such configuration may be made to accommodate and appropriately route material indicating (e.g. by inclusion of a "stamp" in the data) that it is sourced from a variety of track types, and/or indicating that it is from a variety of channels, and/or indicating that should be processed onto specific layers. Preferred Correspondence Of The THCC With 12-Et Tuning While a multitude of 12-pitch-per-octave tunings are validly representable as music and hue data with our 2-circle convention, for simplicity and for more precision later we will prefer to use the example of the commonly used 12-ET tuning system. So we specifically use a 12-ET musical Chromatic Circle, and a 12-ET-based THCC intended to functionally exhibit this 12-ET tuning's characteristics.

(Note that within the 12-ET octave the pitch values correspond with successive P5's that are each only about couple of cents sharp, in the order of F, C, G, D, A, E, B. This difference is not easily audible to humans. However musical thirds in the 12-ET tuning system are considered impure and this can easily be perceived by certain skilled musicians. Instruments such as guitars (through note bends) and violins (by virtue of being fretless) are regularly used to access variations of such intervals. Tension between pure and impure intervals has a significant use. From our research we believe that accessing such precision has benefits in the hue domain. Using cent-based increments and a THCC based on 12-ET tuning, any other octave-based tuning may also be visualized, as a deviation from 12-ET tuning. In other words octave-reduced intervals of the other octave-based tunings can be measured relative to the cent positions of this 12-ET musical Chromatic Circle. Furthermore, with modern computing technologies dynamic tonality may be utilized, for instance to enable the use of pure thirds only within portions of a given musical progression where it is deemed appropriate.) On the 12-ET musical Chromatic Circle angles of −30° and −0.3° represent 12-ET musical semitones (half steps) and cents respectively (these are upward-frequency spans). Therefore angles of −30° and −0.3° on the THCC will functionally correspond to these, being called hue semitones (hue half steps) and hue cents (when within the DWW these hue intervals can correspond with upward wavelength spans).

Sorted musical pitches and intervals being received within music-interval-comprised data may be visualized as ray end points and central angles (that we will call 'interval angles') on the musical Chromatic Circle. These will be deemed to functionally correspond (largely) with angle rays (hue note rays) and interval angles (hue interval angles) formed on the THCC. It is significant that the functional correspondence between the interval angles of the musical Chromatic Circle and the interval angles of the THCC is NOT determined by the orientation of one circle with the other. The THCC can be rotated in relation to the musical Chromatic Circle (and vice versa), causing a new orientation between the two circles, but the hue semitones and hue cents will be deemed to continue to function.

So basically, to relate incoming music intervals from music with the hue intervals on the THCC one can simply do the following: 1) Choose a) a static (fixed, unchangeable) orientation, orb) an offset-able default orientation (either of which can be arbitrary) between the pitch domain and hue domain. 2) Octave-reduce the incoming music intervals. 3) Sort these now-octave-reduced music intervals to find the corresponding thiv's. 4) Output the color values of the thiv's on at least one-color output device via at least one-color output device adapter.

The m2h index orientation methods that can be illustrated by the relationship between the musical Chromatic Circle and the THCC will get much deeper and will be described later.

But to conceive of the general system and method of the present invention one can conceptualize a musical Chromatic Circle and THCC, both with the same geometric center, and with one being larger than the other (so as to see what's going on). One can then imagine offsetting the rotation between the musical Chromatic Circle and the THCC to any orientation (resulting in a new set of functional alignments between incoming pitch values and outgoing hue values), i.e. spinning one circle in relation to the other. We find that any orientation can work (this applies to our visualization of musical Chromatic Circle to THCC, and also to the intervals obtained in the music interval feeding process, that may be 'musically transposed' relative to the thiv's of the m2h index). Nonetheless it should be stated that the interval context (and tonics) in a given piece of music will have implications: Our testing indicates that the more relaxing vibrant hues (e.g. violet, blues) are more able to functionally correspond with a musical tonic than the less relaxing ones (e.g. oranges and reds). (Aligning a musical tonic with a relaxing vibrant hue apparently requires no 'set up', whereas aligning the musical tonic with orange or red, for e.g., can be better accomplished by 'set up'. (For e.g. if the hues are displayed after a pause, then 'Set up' means employing an introductory segment. Or if there has been prior hue material shown, then 'set up' means the use of musical modulation techniques to encourage the 'key change'.) When the implementation of the system is per an offset-able default orientation as in b (as given immediately above), then in common practice the default will probably most often be music tonic=violet, and after system operation is initiated, when a user is providing new music-interval-comprised data the user may set the new alignment as desired.

Significance of Interval Constructs & their Members Per Music Theory

In the present invention we use "intervals" to refer to relationships between pitches or colored hues defined according to their spans. An interval construct is any set, of whatever size or span range, of member intervals. An interval construct is designated from a specified point either on the THCC (or Interval Helix which is described later) or in the m2h index. This specified point is known herein as the 'interval bottom'. A music interval construct may have a significant "interval bottom", such as a momentary or lasting tonal center (music tonic), musical chord root, or musical arpeggio root. These are all significant locations in pitch space. And in one embodiment of the present invention, a hue interval construct may have a similarly significant interval bottom location (such as the hue tonic, hue chord root, or hue arpeggio root). Note that music interval constructs may be specific or generic. With generic intervals the placement into actual pitch space or hue space is a separate step from the initial selection or creation of the interval construct. And in one embodiment of the present invention, stored hue interval constructs are specific. And in one embodiment of the present invention stored hue interval constructs are generic (e.g. ii-V-I, figured bass, or by complete hue interval relationships with no specific hue info, but only with any necessary rhythmic relationships. Generic hue interval constructs may be manipulated in generic form (as by adding additional intervals to chords or melody, or applying chord substitution or re-harmonization principles). These generic constructs may then later be flexibly applied in specific analog color form as needed for a particular purpose.

Initial Example Will Use a Simple Static (Fixed) M2h Index, which Aligns Violet to the Music Tonic (the Tonic of the Current Incoming Music Intervals)

Later on we will describe embodiments using the methods and rationale of music interval data transposition and hue interval data transposition. But for the first several music-to-hue (m2h) examples, that will be shown in FIGS. 16-21, a fixed arbitrary orientation between music and hue is all that is required for a working embodiment (that may be conceptualized by some arbitrary fixed rotational alignment between the musical Chromatic Circle and the THCC), where Violet, for reasons cited just above, is aligned with the music tonic, which in our example will be the Key of F Major. (Keep in mind that if a piece of tonal music has been composed as in typical practice, the music intervals will create a sense of 'resolving on the tonic', and per the present invention hue intervals will create a similar sense.) Thus for these first set of examples shown in FIGS. 17-22, the tuned hue gradient of the THCC as shown in FIG. 3 will be approximately determining the remaining correspondences between pitch and hue. Next, shown in FIG. 4 interval angle constructs relative to the THCC first shown in FIG. 3 will be capable of representing the correspondences reached between music interval constructs and hue interval constructs in the form of thiv relationships as measured in the m2h index (e.g. by sorting according to virtual bins). So FIG. 4 illustrates the use of interval angles in the THCC to define the points of interval constructs.

Figure 5:
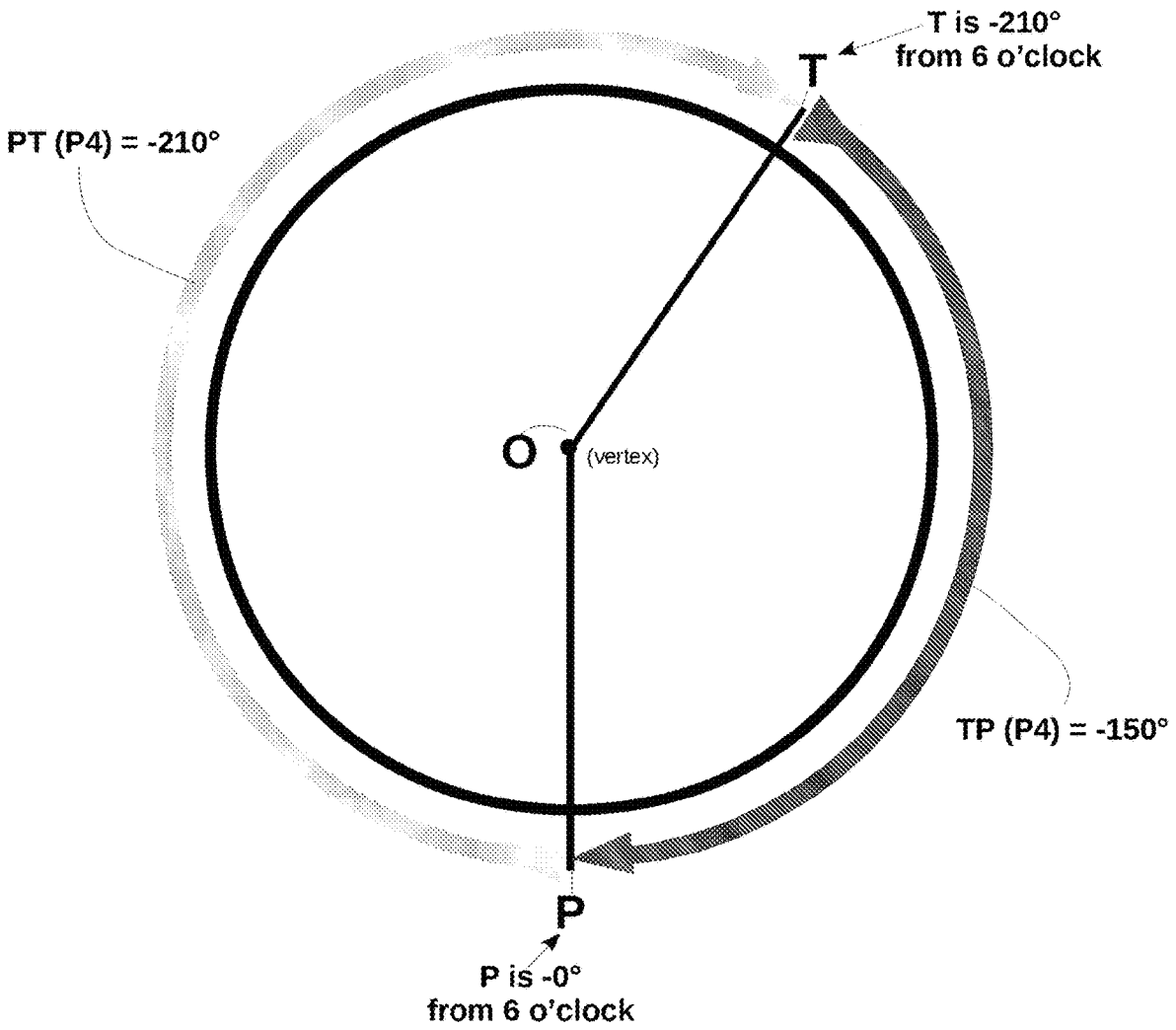
FIG. 5 illustrates central angles on the THCC, for depicting 'interval angle' constructs.

FIG. 5 illustrates various m2h interval constructs, in angle values on the THCC, listed per music interval cent values, and given in generic pitch ratios where appropriate. These are all shown (for purpose of example only) per the hue tonic of 425 nm Violet. FIG. 5 is based on FIG. 3, which was produced using a 240-Res THCC (a THCC in a resolution of 240 hues), in a circle of 360°. FIG. 5 is an example of how hue intervals are computed, using the THCC to illustrate the way that such indexing and computation works in the m2h index. With regard to the 240 hues, given that at present the preferred hue cent is 0.217 nanometers, and there are 1200 hue cents divided within the 240-hue resolution, therefore within the DWW each successive 240th of the circle will comprises a hue interval span of 5 hue cents (equivalent with the same span of musical cents). Each negative degree (−1°) comprises a hue interval span of 3.333 . . . hue cents (equivalent with the same span of musical cents). The hue resolution can be finer than 240-Res or less fine. FIG. 5 calculates intervals using negative angles, from approximately 425 nm Violet. FIG. 5 shows approximate angles for a series of hue intervals from this interval bottom. The angles were arrived at by traveling clockwise. (We describe clockwise angles herein as negative). We will list the angles and their meanings below, but we will skip the 12-ET intervals since their angles and ratios are self-explanatory. For all others, after the angle we list the number of 12-ET cents above the music tonic (the approximate angles were computed from this cents value above the interval bottom, by dividing it by (roughly) 3.333 . . . ). After the 12-ET cents value we list the ratio. Following is the list: [−0°, 0 cents, interval bottom] [−21°, 70 cents, 25:24] [−33.6°, 112 cents, 16:15] [−61.2°, 204, 9:8] [−69.3°, 231, 8:7] [−80.1°, 267, 7:6] [−94.8°, 316, 6:5] [−115.8°, 386, 5:4] [−122.4°, 408, 81:64] [−149.4°, 498, 4:3] [−174.9°, 583, 7:5] [−177°, 590, 45:32] [−210.6°, 702, 3:2] [−244.2°, 814, 8:5] [−290.7°, 969, 7:4] [−298.8°, 996, 16:9] [−305.4°, 1018, 9:5] [−326.4°, 1088, 15:8] [−333°, 1110, 243:128]

Figure 6:
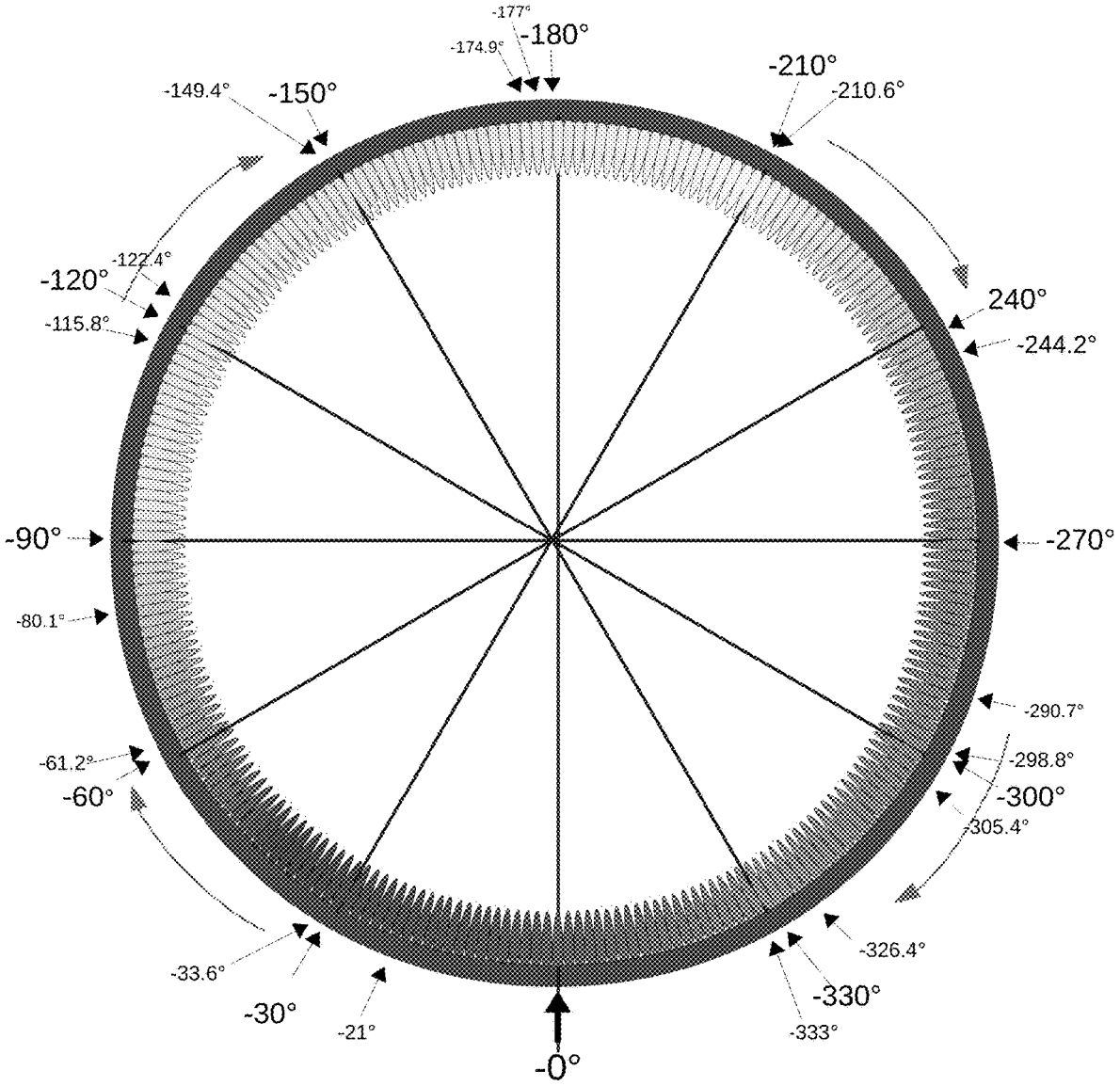
FIG. 6 illustrates a number of significant interval angles (forming color set pairs) relative to the hue tonic of Violet.

FIG. 6 illustrates the introduction of a rotational offset of the THCC from FIG. 5, that does not change the interval construct angles shown in the illustrations. Offset of a set of thiv's in the m2h index is an operation that is here represented graphically (the graphics of which can be used in a GUI), by offset between the musical Chromatic Circle and the THCC. Such offset is similar to musical transposition (not to be confused with mathematical transposition). It doesn't alter the meaning of music interval constructs. Such offset, in terms of color relationships, is fundamental to the method. We could have rotated the complete set of angles of FIG. 5, while keeping the THCC positioned, but we did the reverse since it was easier to do in graphics software. In the case where the thiv's are being looked up in a wrapping lookup table, one simple introduces an offset amount in relation to the resolution of the thiv. For instance in a 240-Res m2h index, with each thiv corresponding to 5 musical cents, to transpose an interval construct by five cents one moves one thiv beyond the original computed position.

As noted, musical notes on the modern plano repeat at a rate of every 12 plano keys, and it was said that these repeating notes sound similar to, and can substitute for, one another. In fact, within the middle range of the plano, sets of intervals starting from one particular 'lowest plano key' can be shifted so as to begin on another 'lowest plano key'—the shifting whole interval constructs (which is called musical transposition). This applies to music intervals and also to hue intervals on the THCC and using the m2h index. We will call a shifting of interval constructs around the THCC 'music-like transposition'. We will call a shifting of an interval construct within a wrapping table of a m2h index 'music-like transposition' as well. This fact of 'music-like transposition' of colored hues allows a multitude of functions in the present method, including allowing hundreds of possible hue tonics, hue chord roots, hue arpeggio roots, etc.

In the paragraphs concerning the DWW it was earlier stated that we are referring, when describing hue intervals, to target color relationships formed from target colors. Optimum target colors may not always be achievable in a particular use or due to particular economic considerations. But optimum target colors create the best functional correspondence. So to specify this we will use 'necessary 3 criteria of functional correspondence'. Satisfying these enables the hue intervals to functionally correspond with music intervals, and preferred values are additionally given below for achieving a higher degree of functional correspondence, including by using 12-ET cent-based interval constructs that may mimic other constructs of non-12-ET tunings; and that may be used with dynamic tonality to mimic pure intervals such as a 5:4 Major Third and 6:5 minor third and 7:4 harmonic seventh. Note that the following m2h index relationships are examples only. To better understand this one may refer back to FIG. 6 & FIG. 7 but should note that the examples do not signify that the specific pitches referenced must correspond with the specific colors shown in that particular transposition. Such a correspondence is not suggested. Interval functionality in music is transposable (very generally speaking). This m2h functional correspondence (accessed via the m2h index) is transposable the way music intervals are transposable. Although the individual colors must be taken into consideration more than individual pitches would be, the present method permits the transposing of a hue chord to a different hue chord root. And it permits the transposing of a hue sequence to a different hue tonic. Additionally it permits the use of chord substitution and re-harmonization practices. It permits any such music theory operation given that the music interval functions are known.

Necessary 3 Criteria for Functional Correspondence

Figure 7:
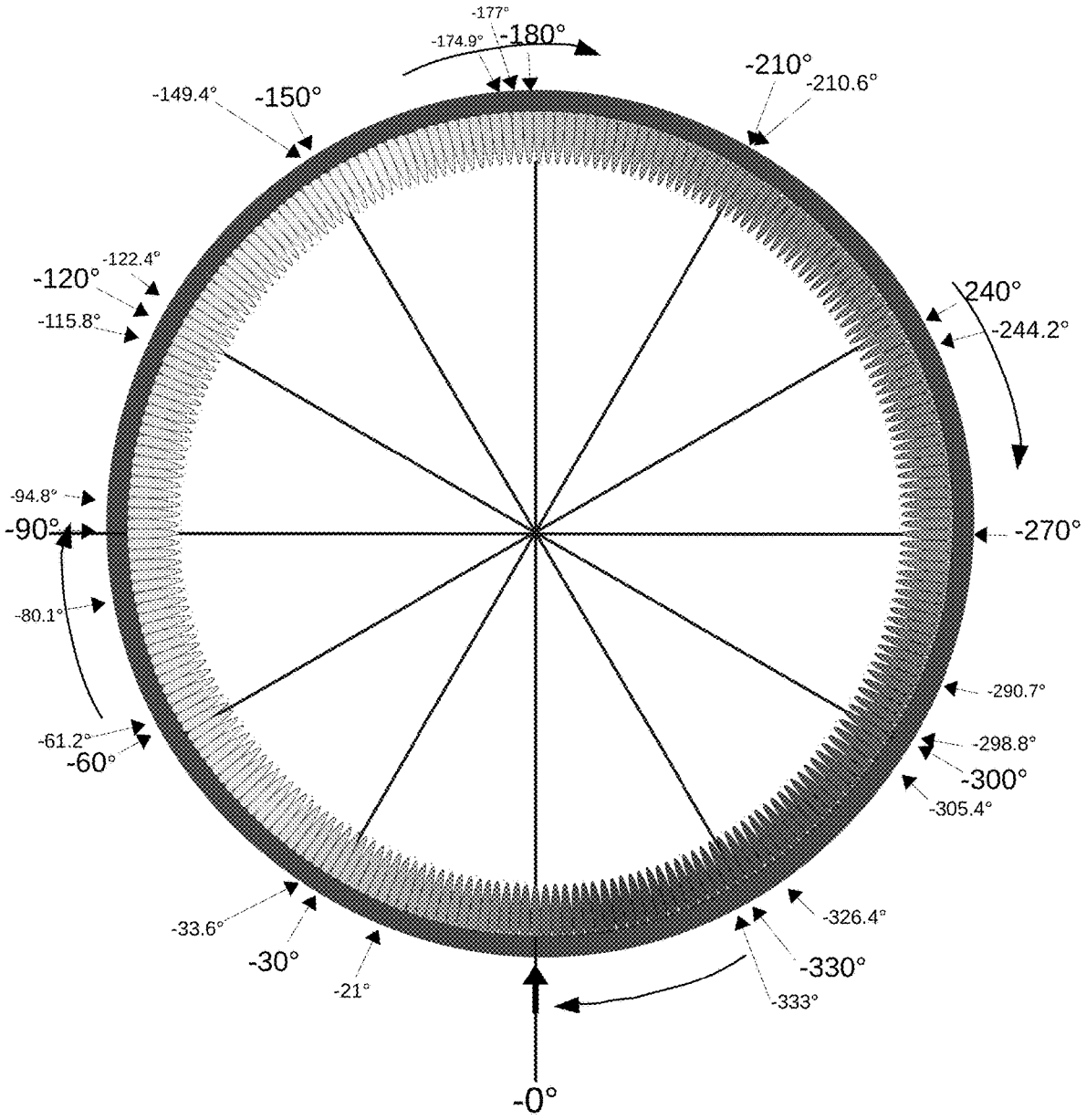
FIG. 7 illustrates the significant interval angles that were shown in FIG. 6, but with the THCC rotated, to illustrate that rotational offsets permit music-like transposition of significant color sets.
Figure 8:
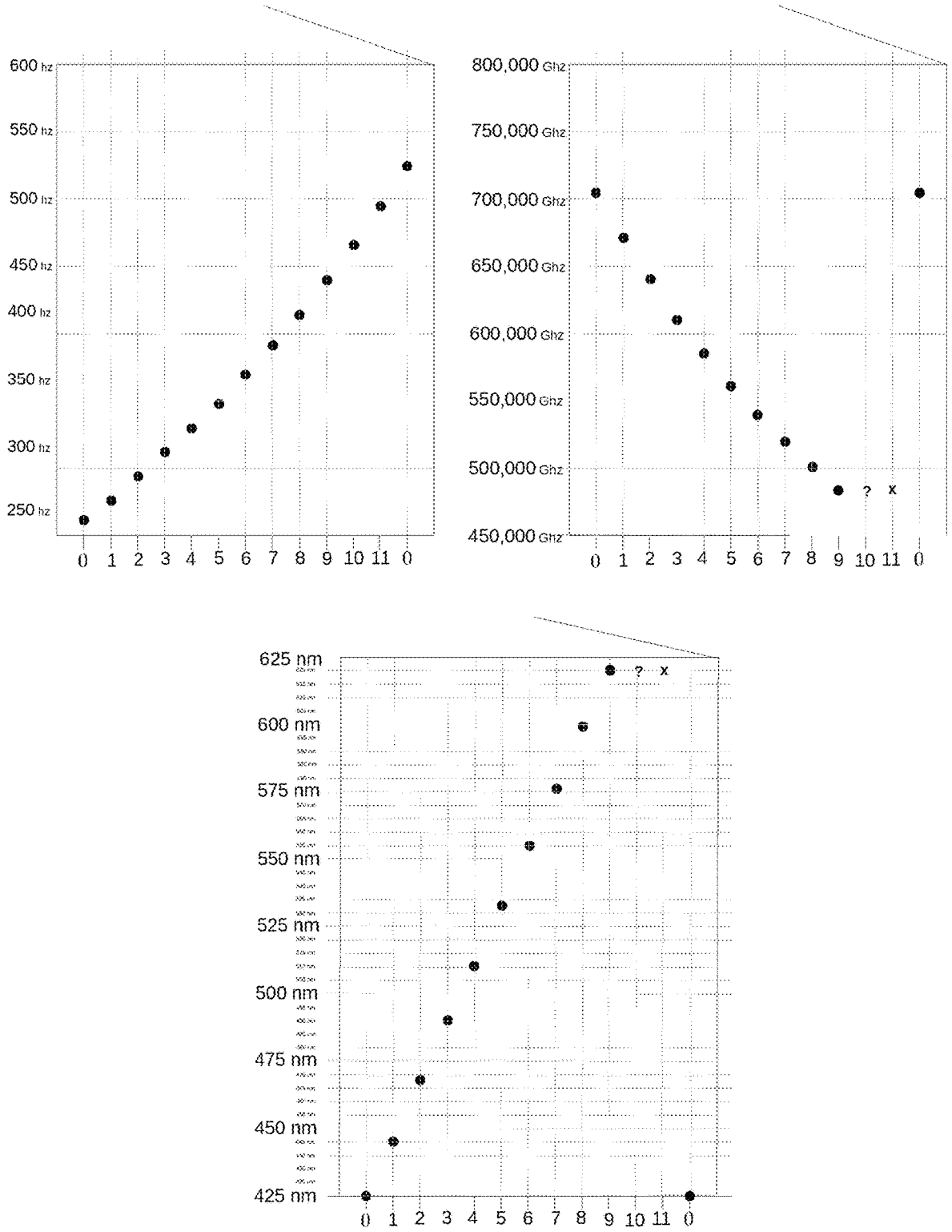
FIG. 8 illustrates the necessary 3 criteria for functional correspondence between music and hue in graph form.

The necessary 3 criteria for functional correspondence are shown by example in FIGS. 7-8. (FIG. 8 is in graph form and FIG. 9 is in table form). Hue intervals of the present invention are indexed in the m2h index in relation to music intervals so that:

1) In the music-to-hue interval correspondence, within the DWW, the music semitones of geometrically increasing frequencies correspond with hue semitones whose dominant wavelength spans have successive values increasing approximately linearly. (Strong linearity is apparently preferred for emulating the function of the equal tempered tuning system of music.)
2) The sum of the dominant wavelength spans of the hue semitones, within the DWW, averages out to a value not less than 19 nm and not more than 25 nm (averaged by dividing the sum by the number of hue semitones). (For emulating the equal tempered tuning system of music, our current preferred value for a dominant wavelength span of a hue semitone, within the DWW, is 21.7 nanometers, with a hue cent being 1/100th of this, or 0.217 nm.)
3) The approximate hue span, in the clockwise direction on the C.I.E. Chromaticity Diagram, from the purple-violet region to the yellow region approximately corresponds with the musical interval span of a P5 (e.g. as from C to G).

Figure 10:
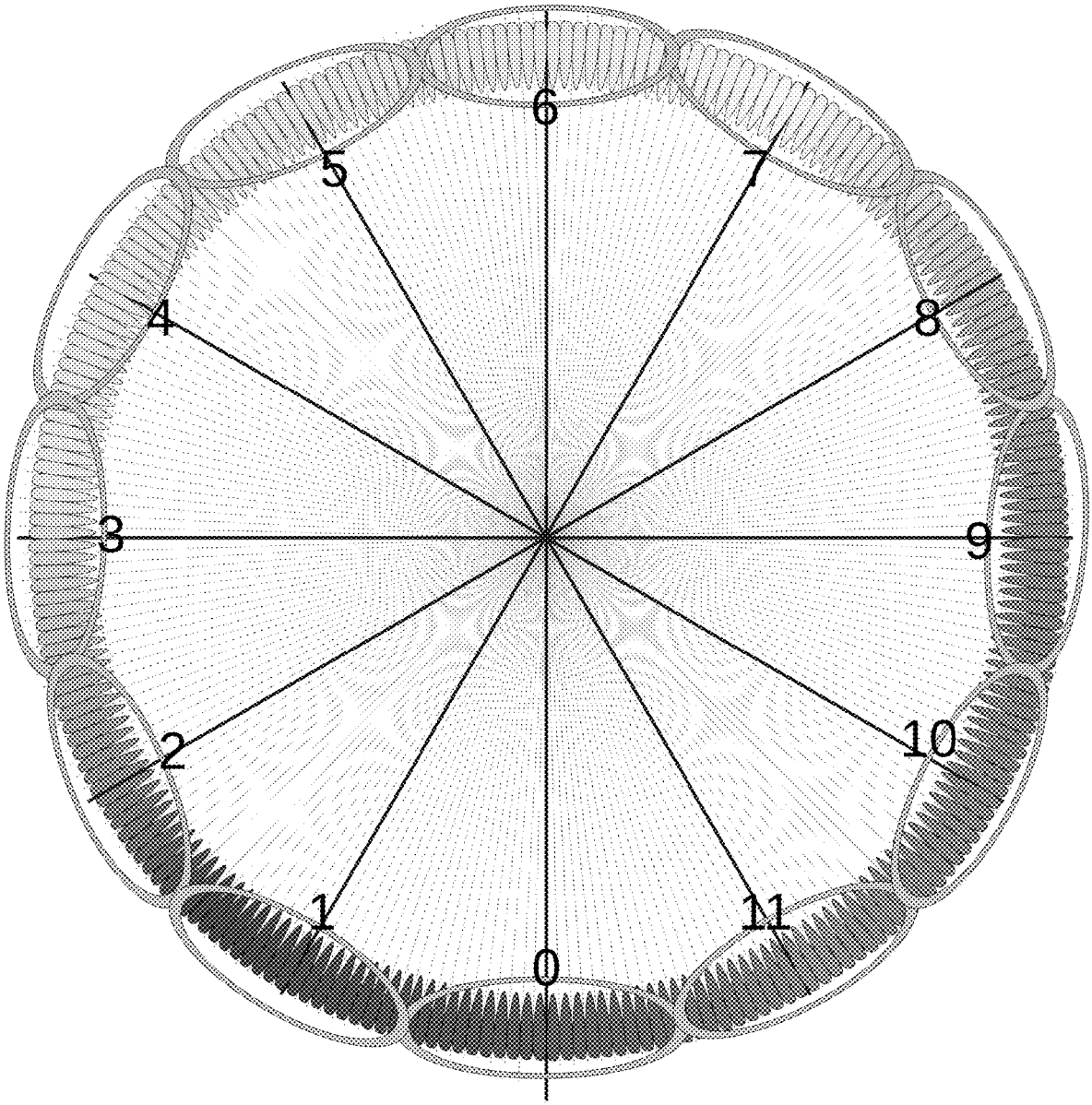
FIG. 10 illustrates relatively preferred hue perfect P5's (perfect 5ths)

FIG. 10 is an illustration of preferred hue P5's, and relative degree of acceptability of hue P5's in the THCC (both according to present research). Its first use is for choosing thiv's for the portion of the THCC approximately outside the DWW. Its second use is in the general design of typical embodiments where the color output device is chosen by weighing between costs and ideal vibrancy. FIG. 10 is provided as a resource for weighing between these two factors, because it will (per present research) indicate relative acceptability. When interval constructs become more intricate (as in jazz, or pieces including at least several instances of non-relative-key modulation) then understandably the use of colors of very high vibrancy and use of the more preferred hue intervals become more necessary. As shown in FIG. 10, along with meeting the necessary 3 criteria for functional correspondence given above, it is acceptable for the m2h index to be configured so that: the clockwise span between a hue from the indigo-lower-wavelength-blue region and a hue from the orange region corresponds with a music P5; and so that the clockwise span between a hue from the upper-wavelength-blue region and a hue from the orangish-red-warm-red region is indexed to correspond with a music P5; and so that the clockwise span between a hue from the cyan region and a hue from the cool-red-blush-red region is indexed to correspond with a music P5; and so that the clockwise span between a hue from the cool green region and a hue from the magenta region is indexed to correspond with a music P5; and so that the clockwise span between a hue from the warm green region and a hue from the purple-violet region is indexed to correspond with a music P5; and so that the clockwise span between a hue from the yellow-green region and a hue from the indigo-lower-wavelength-blue region is indexed to correspond with a music P5; and so that the clockwise span between a hue from the yellow region and a hue from the upper-wavelength-blue region is indexed to correspond with a music P5; and so that the clockwise span between a hue from the orange region and a hue from the cyan region is indexed to correspond with a music P5; and so that the clockwise span between a hue from the orangish-red-warm-red region and a hue from the cool green region is indexed to correspond with a music P5; and so that the clockwise span between a hue from the cool-red-bluish-red region and a hue from the warm green region is indexed to correspond with a music P5; and so that the clockwise span between a hue from the magenta region and a hue from the yellow-green region is indexed to correspond with a music P5.

Figure 11:
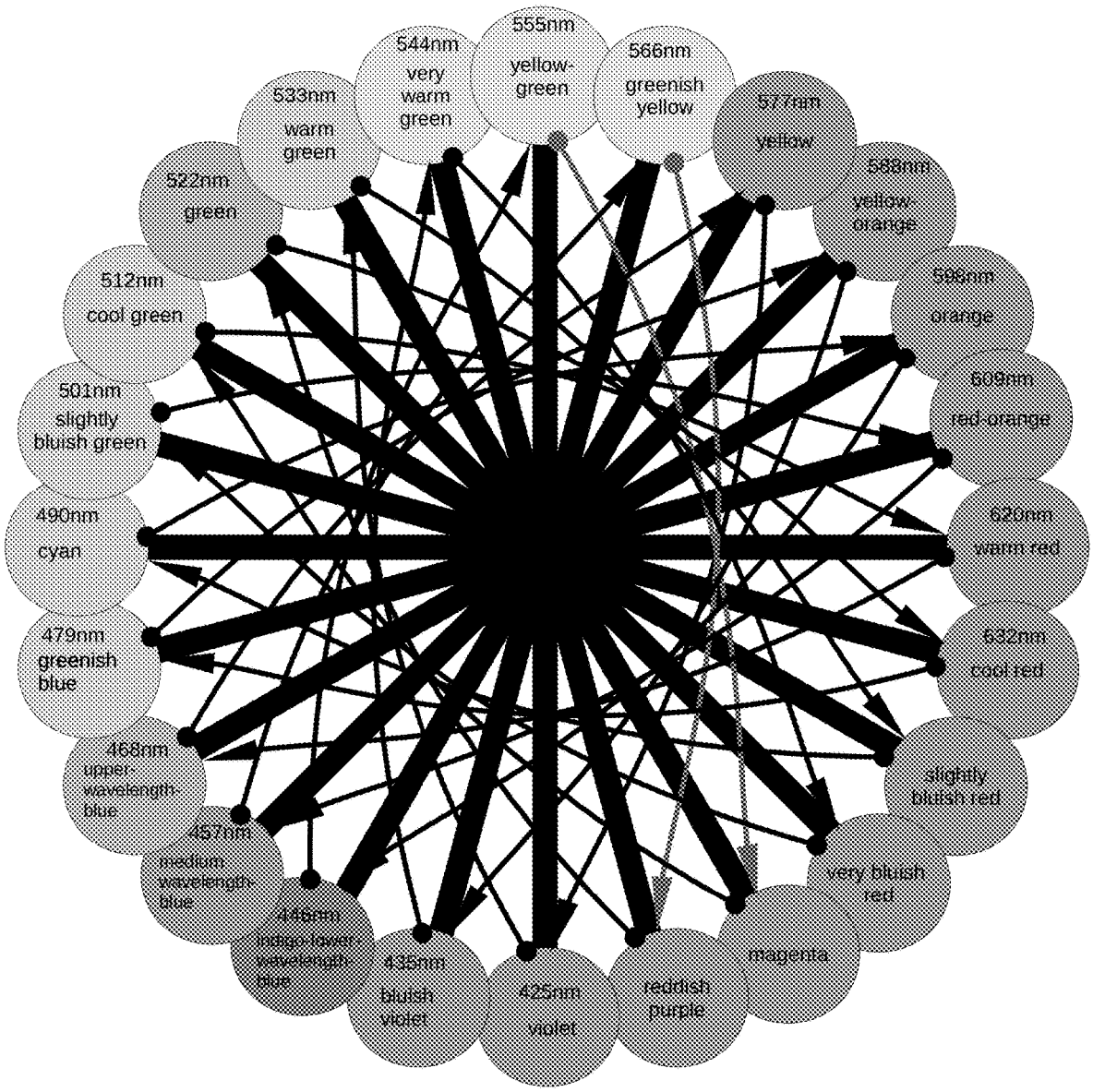
FIG. 11 illustrates a 24-hue resolution THCC in which the tuned hue interval variables (THIVs) have been given English color names.

FIG. 11 provides a 24-Res THCC in which the thiv's have been given English color names, for cases where this may clarify the method for certain readers and users. A m2h index need not include thiv's for every position in the THCC. It only must include enough thiv's to represent the music intervals in the music data one wishes to the color output to correspond with. The m2h index may have thiv's distributed throughout the complete range of the THCC, or more sparsely, only in the needed positions for a particular music tonic and hue tonic (as will be conceptually elucidated below). The meaning of the arrows is equivalent to the relation between C & G on a musical Chromatic Circle, and in an octave-reduced state. From C to G is a P5. From G to C is a P4. It could be said that when one plays the note C and then the note G one creates a bit of harmonious tension. This equates with traveling oppose to the direction of an arrow between two hues in the illustration. In contrast, it could be said that when one plays the note G and then the note C then C feels like a resting place. And it could be said that if one plays C, then G, and then finally C, then the final C releases the bit of harmonious tension created by playing G after the initial C. This description is meant as an approximation only and must be experienced. There is apparently some functional correspondence between the musical experience just described, and the hue experience that is illustrated by the arrows, related by more than several experiencers. (In music the experience apparently has to do with the experience of a musical tone's fundamental and overtones).

Figure 12:
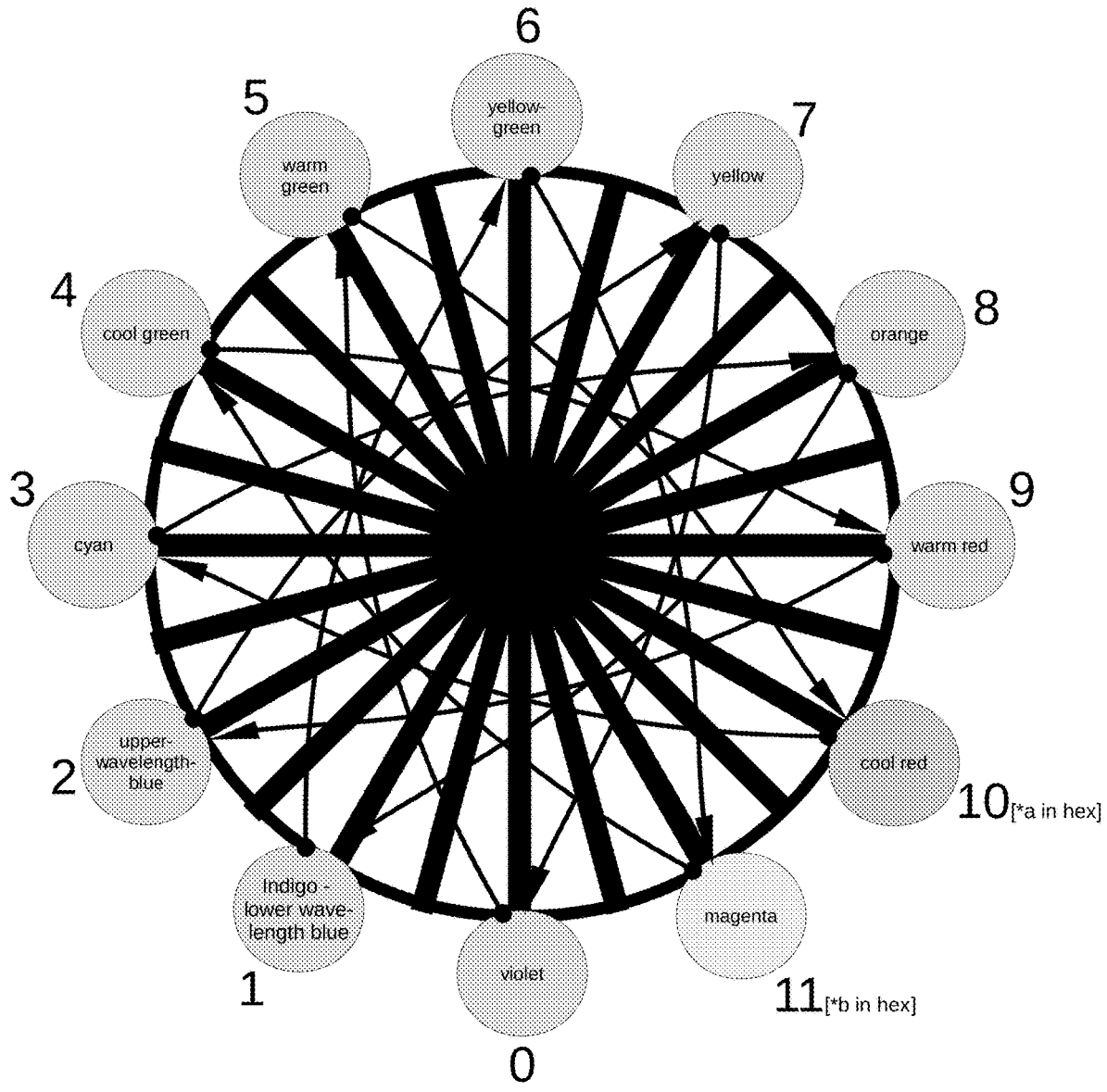
FIG. 12 illustrates a basic 12 hue resolution THCC—a hue form visualization of the common musical Chromatic Scale from approximately 425 nm Violet as an exemplary tonic from which we will block out a musical progression in hue note form.

Basic Embodiment W/Only the Thiv's Represented in the 12-Res THCC of FIG. 12

FIG. 12 illustrates a 12-Res THCC, representing a 12-Res m2h index with 12 thiv's, for demonstration of some basic principles of the present invention as in FIGS. 16-21. Hue Intervals in the THCC operate according to mod12. (Most simply the THCC is considered one "hue octave" and equates with octave-reduced music intervals). As can be observed using FIG. 12 as an example using thiv's based on a 12-Res THCC one can find the hue interval (and functionally corresponding hues) for any octave reduced music interval in typical 12-pitch music. This may be done by simple addition and subtraction at the given resolution, and it may also be done starting with higher resolution angle values that locate functionally corresponding hues in a lower resolution THCC. When a computational result is less than zero on adds 12. When a computational result reaches 12 or more, one subtracts 12. For instance one can simply subtract 7 from any number on FIG. 12 to find the Hue P5 resolution for that hue. For instance 5-7=−2. But −2 is less than zero. So adding 12 to −2=10. So the hue labeled 10 is the P5 resolution of the hue labeled 5.

First Embodiment—Based on Simple Chromatic Scale Hue Intervals of FIG. 12

In one embodiment of the present invention, one sorts an incoming octave-reduced music interval (as may be visualized on the musical Chromatic Circle) against the thiv's of the m2h index (as may be visualized on the THCC), and the thiv located by the sorting process (which will be found at a central angle ray on the THCC representing the interval's top in octave-reduced pitch space) is output as an analog hue interval on at least one color output device via at least one color output device adapter.

Rhythm

Thus far the m2h index and its THCC hue interval angle representation have been briefly described. Now we can look at basic usages for selecting color sets for the generation of color harmony effects. We can briefly state that visual hue correspondence is possible with music in at least 5 commonly discussed aspects of musical harmoniousness, namely rhythm, melody, bass, chords, and tonality. But we need to lay some terminology groundwork.

Concerning visual rhythm, for now we can simply reference a typical, broad definition of artistic rhythm from the American Heritage Dictionary of the English Language (1973): "In painting, sculpture and other visual arts, a regular or harmonious pattern created by lines, forms, and colors." We can add to this that such relationships will factor in as well when apportioned rhythmically within displayed sequences (such as when such relationships are apportioned in a sequence of frames or in a sequence displayed on an LED display screen).

Hue Melody, Bass, Chords, and Tonality

Hue Notes and Color Objects

The prior art has lacked a functional correspondence between sets of colors and music chord types and melodic scale types and modes, and such. In the present method we utilize what we call hue melody, hue bass, hue chords, and hue tonality, all being comprised of sets of hue notes. We understand that musical pitches form music substantially because of their music interval relationships (as evidenced by one's ability to transpose a Beatles song and still retain the mood and flow of the song). And in the present invention hue notes form hue music substantially because of the properties of their hue interval relationships as well. In the present method we will describe these hue notes as being displayed on (or through) color objects. A color object can be a colored light or a virtual object on a display screen. Or it can be an object formed (within an overall image) of colored pigment; such as a printed, stenciled or automatically painted object. Color objects are managed using software, such as in the form of arrays. They can be presented in animated combinations and series or static combinations or series, the latter being possible because a path along a static image can be followed by a viewer, providing the "time" aspect of musical experience in viewing the static image.

Sets of hue note intervals, displayed on color objects (comprised of hue melody and/or hue harmony) have qualities that are understood to correspond with the qualities of comparable music intervals. Music-interval-comprised data of various types can be used as sources for creating sets of hue notes. Per the present method hue notes are empirically and quantifiably connected with musical notes. Music note data and hue note data are interchangeable using the present system. Hue-interval-comprised data from the present method may even be substituted for music-interval-comprised data as input. Further, hue note sets may be modified using known music-theory-based methods and algorithms with the results of such modifications being predicted according to music theory, although it would be completely unexpected. While it is certainly true that individual colors have a great impact on the perceived qualities of any color set, nevertheless the present method allows for selection of color sets that do, to an effective degree, functionally correspond to music interval constructs. Such music interval constructs include chord types and chord progressions, and melodic scale types, modes and progressions, including processes influencing the experience of tension and resolution. Such music relationships have inherent extensibility, and their effect is independent of the response caused by the individual pitches. The same is true for tuned hue relationships, although it has until now been an unobserved phenomenon since particular hues do arguably have a much greater influence than particular pitches. But it is because of this strong effect of the particular hues in a given hue relationship that methods of music transposition, chord substitution and re-harmonization are as useful in the present method, or perhaps even more so, than in the domain of music; because one can transpose or substitute so that a very explicitly desired color relationship can be obtained, via use of simple GUI methods such as palettes and the thiNC interface described below, that also match desired cadential properties from the perspective of an end user.

According to the teachings of the present method we follow the principle that color relationships of less-than-vibrant colors (such as tints and shades) do not have as strong a functional correspondence, and function less and less predictably with less and less vibrancy of the colors. As colors de-saturate we may for now assume they gradually move from operating similarly to musical instruments of definite pitch, to operating more similarly to musical instruments of semi-definite pitch (e.g. pitched percussion), and then gradually, as bluish or brownish grays, whites, and near-blacks, begin operating similarly to non-pitched percussion instruments. Furthermore just as musical instruments of poor quality sometimes produce notes of undesirable timbral quality even though this is not the intent, sometimes less than vibrant color can be unintentional, such as when a new color of paint fails to obscure the prior color. Conversely there can be positive instances such as glazes added to paints or 3D texturing, which offer pleasing variation of wavelength while not significantly obscuring the purity of the constituent colors, similar to so many musical timbres that may have definite pitch, but with unique overtonal 'color' and 'motion' (as from pitch and amplitude modulation) of varying degrees (flutes, saxophones, trumpets, violins, etc.). Of course in terms of both degree of vibrancy and physiological color response, viewer distance (and often angle) will vary the effects of the present method. These variations may both be understood according to the prior art.

Figure 13:
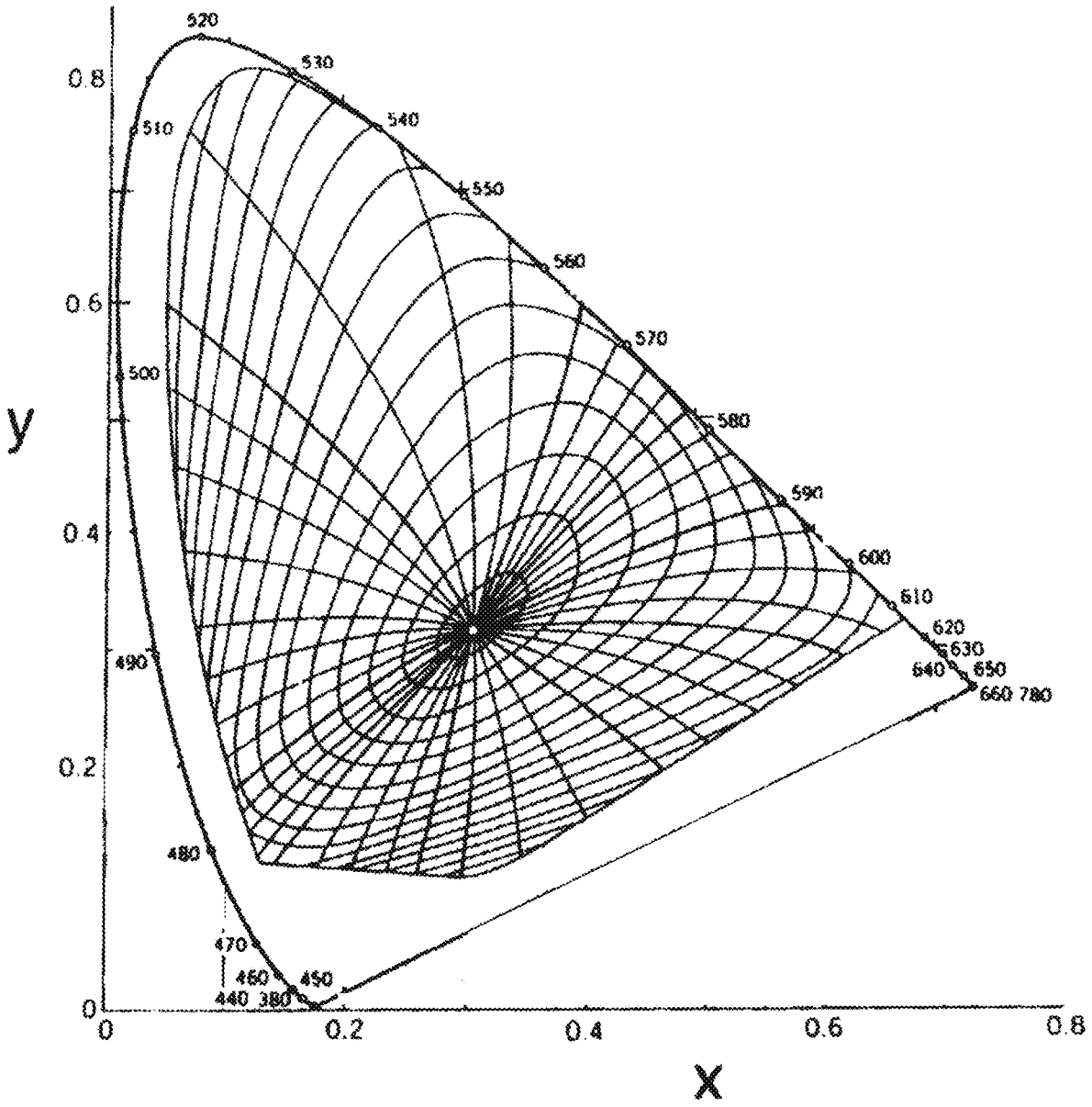
FIG. 13 illustrates 'lines of constant hue' relevant to selecting hue intervals to be determined by the m2h process if perimeter values on the CIE Chromaticity Diagram are economically (or for other practical reasons) unobtainable.

FIG. 13 illustrates lines of constant hue, relevant in selecting hue intervals for the m2h index in cases where reduced colorfulness is necessary, such as for economic reasons. Note that for a basic m2h index, one ideally uses the purest possible colors, nearest the perimeter of the CIE Chromaticity Diagram because these have the highest degree of vibrancy, Chroma, colorfulness and saturation. However approaching this perimeter is not always possible for all color ranges on the THCC. For instance the gamuts of color output devices using RGB or CMYK primaries typically have certain color ranges that are only capable of moderate Chroma, colorfulness and saturation. In such cases there is concern overachieving hues that accurately perceptually approximate the target dominant wavelength near the CIE Chromaticity Diagram perimeter.gtoreq.for there are known factors that cause a color, computed using CIE Chromaticity Coordinates, to appear different than its supposed dominant wavelength would suggest, per Chromaticity Coordinate computation. Known effects such as the Purkinje effect and the Bezold-Brucke shift may be factors. (Perhaps for monochromatic sources with added white the Abney effect may even be a factor). But most generally, FIG. 13 shows that the Munsell lines of constant Hue are distorted when plotted on the CIE Chromaticity Diagram. So, as illustrated in FIG. 13, engineers following the method of the present invention with the goal of high accuracy will take into consideration these matters. The hue intervals of the present method, when described by values within the DWW, may be monochromatic wavelengths themselves (but this is usually impractical), or they may be hues with the highly saturated dominant wavelengths as specified. But they may also be hues that fall along lines of constant hue from these dominant wavelengths. This can be according to the Munsell system's lines of constant Hue, or constant hue values derived using such methods as CIECAM02, CIELAB or CIELUV if appropriate. Of course colorimetry may also be used so as to properly factor in an embodiment's intended viewing conditions to best achieve the intended hue intervals.

A ThiNC Interface Explained

In one embodiment a display screen is made available to view a graphical user interface (GUI) that provides nesting, and independent rotation around a common center, of multiple THCC's so as to form color sets. This GUI allows a user to audition color sets for particular purposes. It should also help us convey invention features, and the present invention's methods of applying music theory to color harmony.

Figure 14:
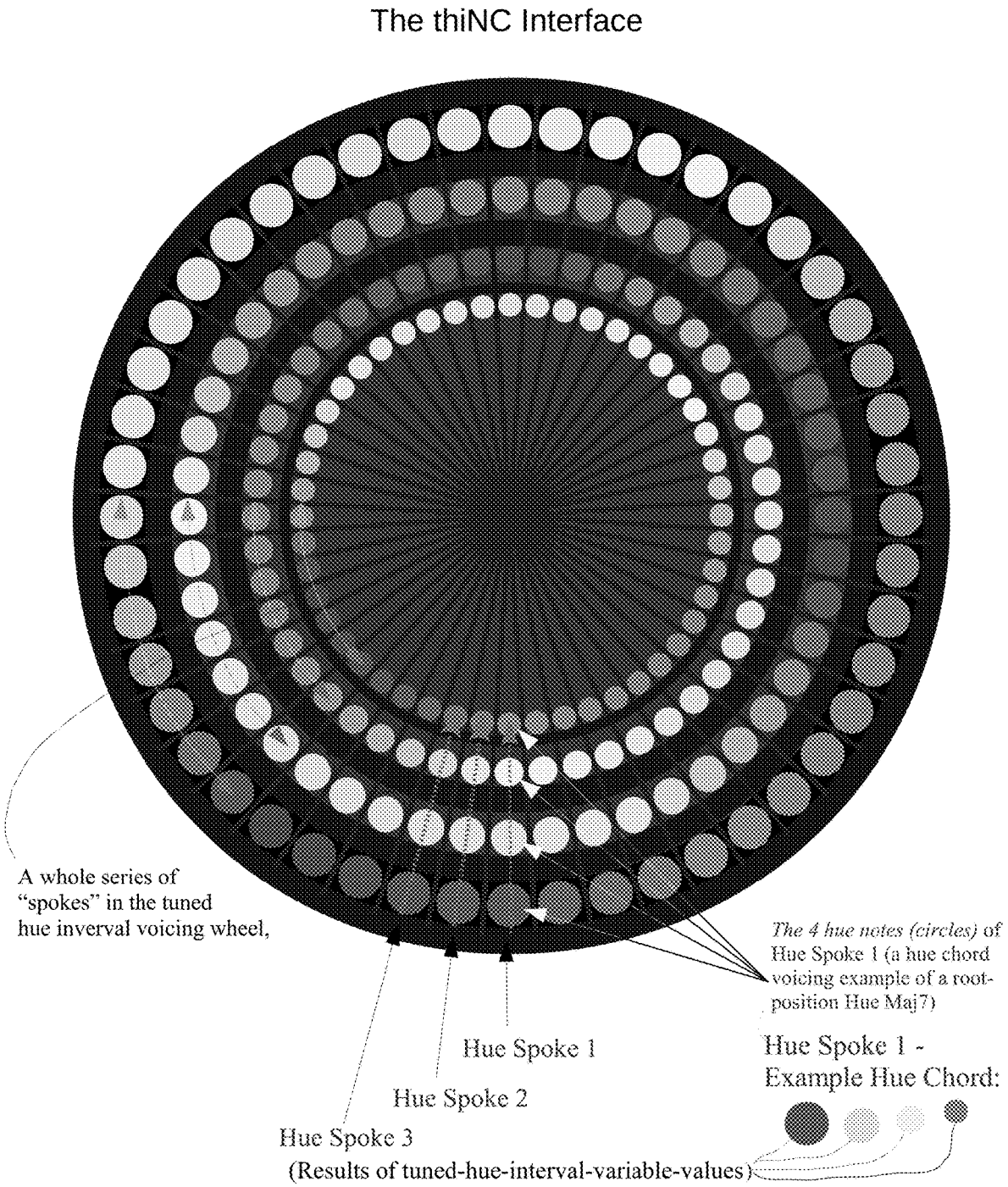
FIG. 14 illustrates a hue interval nested chromatic circle (thiNC) interface.

Herein we call this GUI a 'hue interval nested chromatic circle' interface (a thiNC interface). FIG. 14 illustrates the thiNC interface. It is comprised of n concentrically nested THCC's. Each of the concentrically nested THCC's is independently rotatable by central angular offset, around a common center. As before, the hue gradient of the THCC's (that here comprise the thiNC interface) represents the tuned hue gradient produced by the thiv's of the m2h index.

The THCC's are each in essence a rotatable THCC ring in a color set display mechanism. This color set display mechanism, via producing relative rotation alignments of set of THCC rings, allows the embodiment user to choose and visualize color sets. The concentric THCC rings progressively get smaller from outermost to innermost (according to some arbitrary rate of progressive shrinking). In use typically the outermost, larger THCC ring represents the lowest non-octave-reduced pitch being visualized, and the successively smaller THCC rings represent successively higher non-octave-reduced pitches. The reason for this is explained later. The thiNC interface basically "visually voices" sets of colors and their progressions, and may do so according to the full resolution (Res) of Hue Tonics of the system, or according to a particular Hue Root or Hue Tonic, by way of introducing a cover over the top of it that covers all but one "hue spoke" (see below). A thiNC interface comprises n THCC rings (4 in the case of the drawing), each with n possible hue notes (same number of hue notes in every THCC ring, which is the resolution of the thiNC interface). The hue notes are in the form of colored circles, or color chips, or other colored shapes (n=a multiple of 12; 48 in the case of the drawing; a 48-Res thiNC interface).

In the thiNC each of the THCC rings is like an instance of a THCC as described above, except that it need not represent the full resolution of the m2h index. (Selection of a single specific hue note by human interface device (computer arrow keys/mouse/touchscreen) can be easier when that hue note is larger).

It is not that the specific decrease in size of a THCC ring from its outer neighbor represents a very specific relative increase in pitch (for e.g. an octave, or a M2). Rather it is that we have found that larger hue notes tend to impose some imprecisely known influence on other hue notes in the present hue harmony that acts similarly to the influence that musical notes further in the bass impose on other notes in the present musical harmony. Larger hue notes occupy more space in the visual field, similar to the way bass frequencies spread out more in space in the audio field.

By rotating each ring so the color shapes on each come into angular alignment with one another, the colored shapes (serving as hue notes) can be aligned along straight lines called hue spokes, that can be seen in FIG. 14. The number of hue spokes equals the resolution of the thiNC interface.

In default orientation (called null rotation position) every hue note in each hue spoke will contain the same hue value, akin to a series of "unison" intervals (a series of n−0° angles of rotation). It is preferred that in null rotation position the spoke comprised of the Violet color shapes will be on a radius crossing the 6-o'clock position of the thiNC interface.

The thiNC interface can represent musical interval constructs, such as chords, according to the amount of central angular rotation of each of the THCC rings clockwise.

In the case of representing chords, every spoke represents a voicing of the chord, and each THCC ring each provides one chord voice. One typically represents a series of intervals of an interval construct with the outermost hue note of the spoke representing the lowest pitch; with successively higher musical pitches being represented on successively smaller THCC rings. The thiNC interface can also represent a scale or mode; or an entire music progression. In fact the central angular orientation of each THCC ring can represent one monophonic music sequencer track, with the smaller THCC rings tending to be used for tracks with higher pitches. Generally the angle that each THCC ring is rotated from its −0° position (null rotation position) will be based on the current octave-reduced music interval above the interval bottom, broken into the resolution of the thiNC interface. In a 48-Res thiNC interface each THCC ring would rotate −7.5° for each musical quarter semitone. In a 240-Res thiNC interface each THCC ring would rotate −1.5° for every 5 musical cents. A 1200-Res thiNC interface would advance −0.3° for every single musical cent; not that this would necessarily be practical.

So each hue spoke shows 1 of the n possible visual voicings of the hue intervals being visualized. Shown in FIG. 14 every hue spoke, from outside to inside, is voicing a color set comprised of the series 1) hue root 2) M3 3) P5 and 4) M7. This is a hue interval voicing of a "root position Hue Maj7". Again, for each spoke of thiNC interface, each of the THCC rings serve up one voice of this musical interval construct. The series of hue spoke around the thiNC interface show the chord or interval construct transposed by an angle, and in a series of times, of the thiNC resolution central angle span and resolution number of divisions. (A 12-Res thiNC interface has 12 divisions, each with a central angle span of −30°.) This can be functionally equivalent to a series of different hue chord roots or hue tonics. Also in any given state of alignment the series of hue spokes basically form a hue-spoke-comprised palette (expressing potential color set choices). Using music theory, from such palettes one can be logically audition and select voicings to build more intricate color sets such as chord progressions or music progressions. A single interval construct can be viewed on the thiNC; but a timed sequence of them can also be viewed on it. While the thiNC interface is provides a useful GUI, meanwhile each hue spoke can very effectively conceptually represent what is to be sent, as a color set, to the set of color output device pixels (per the definition of pixel given below) comprising a color object array.

The system can "visually voice" the hue intervals as hue notes on "color objects", along color object paths and within color object dimensions. This is accomplished using arrays. After deriving hue intervals using the m2h index, such use of arrays achieves further correlation with musical aesthetics. By utilizing just a few procedures of storing and updating the hue notes in arrays, the hue note spatial presentation maintains a mathematical correlation to the non-octave-reduced and rhythmic properties of the music-interval-comprised data. These procedures are further illustrated in FIGS. 37-48.

One method of using such a color object array would be: Sort a received set of pitches into pitch order (non-octave-reduced pitch order), converting each into an octave-reduced interval value, using the octave-reduced interval of the lowest pitch to define the thiv of the first element (color object) in the array, the octave-reduced interval of the second-lowest pitch to define the thiv of second element in the array, and so on, until the all the pitches define respective thiv's, with any pitches exceeding the available array elements being "overflowed. There is more to this obviously that will be described later. The thiNC interface, as for viewing in virtual form on a display screen, is best programmed through the use of vector graphics to create the colored shapes. It is useful for viewing a given hue chord simultaneously in all available hue transpositions (within the current THCC resolution). (By hue transposition is meant the corresponding concept to music transposition). These transpositions can be chord, scale or mode transpositions. Viewing them can equate to auditioning them. (For visual clarity, in order to view scales and modes there should be enough THCC rings so that both the outermost and innermost represent the interval of unison for that particular tonic).

In one embodiment a sequence track plays the intervals of a chord progression on the thiNC, with the sequence storing the timing of changing angles of each of the THCC rings. During playback of such a sequence a great multitude of color relationships are in flux, and with such a number of colors one would expect dissonance, but to the contrary, per our test subjects when harmonious musical material is used as input, it is perceived as aesthetic. We can herein call this hue spoke 'polytonal color harmony'. Polytonal color harmony based on hue intervals is a very useful color harmony effect. This effect can be achieved not only using the thiNC interface, but by offset of tuned hue gradients so as to achieve the same patterns, in any geometries in which such tuned hue gradients can be generated. Sequences of polytonal color harmony, as such, can be appropriate for RGB LED-covered casino exterior walls, and theme park and amusement park visuals, and for architectural adornment in cultural gatherings. One can display any musical material as 'polytonal color harmony'.

It was said above that the THCC rings each serve up one voice of a musical chord or progression in a given spoke. In music, transitions on consecutive beat pulses between nearby pitches (usually 1-4 semitones with smaller spans being smoother) are described as having 'smooth voice leading' apparently because they are easy for the listener to follow. In the present method 'smooth hue note voice leading' is achieved when the location of the consecutive-pulse nearby-in-pitch intervals is on hue notes that are spatially proximate. This is one type of 'temporal-to-spatial' translation of aesthetics that we use in the present method. This type is essentially the translation of 'pitch transition smoothness' from the musical domain to the hue domain. Another type of temporal-to-spatial translation has to do with frequency. Frequency in music is in inverse relation to wavelength; with relatively lower pitch frequencies being of relatively larger wavelengths; and with relatively higher pitch frequencies being of relatively smaller wavelengths. As mentioned above, since the color shapes of the outer THCC rings are larger they can often apparently best represent the function of the larger-wavelength lower pitched intervals of music.

Therefore, for example, most typically if a musical progression contains a bass melody voice as well as a series of chord changes, then the bass melody voice may be voiced on the outermost THCC ring. And typically if a musical progression contains a top melody voice then the top melody voice may be best voiced on the innermost THCC ring.

As was stated above, the thiNC Interface provides a means to convey some features and methods of the present invention.

Also, as mentioned above, the angle of each THCC ring (each voice) is based on an octave-reduced music interval from the interval bottom that is being used in the computation. We will now describe the use of a few types of interval bottom. As was mentioned above the interval construct could be a chord. This chord could be input with or without known duration. If the interval construct were a known chord with a known chord root, then its interval bottom would be its chord root. If the interval construct were a music progression of known tonality, its interval bottom would be the music tonic. However, one could wish to input interval constructs that are chords of unknown roots; or musical progressions of unknown tonality. To allow for this, by default, until a chord root or tonal center is known, such incoming music intervals can be treated from an arbitrary music interval bottom (AMIB), for instance in terms of what are called 'absolute cents' by the prior art. Using a default AMIB allows the widest, most flexible use of interval constructs in the system. Music theory structural information on tonal center, scale, and chords (including their roots) can be determined by or provided to the system later. In the case of musical progressions, further structural information can be determined by, or provided to, the system later as well, either be for the purpose of permitting more analysis, or for permitting creative manipulations using music theory rules and procedures. This further structural information may include information about the rooting strength of the intervals making up chords and arpeggios (the relative stability of the intervals expressed by the pitches), and harmonic and melodic rules or weightings, etc.

The THCC rings (each of the voices) will typically be defined from only one interval bottom. The AMIB is an improvement. Using the AMIB as a default provides a consistent interval bottom for all interval constructs, and provides a fallback position if the user changes their mind as to the tonic (or chord root); the data remains referenced to the original AMIB. To provide a convention for this disclosure we have selected for absolute cent zero the approximate frequency 8.199445678 hertz (represented as C−1, i.e. C "octave minus 1"). Again, this is merely a convention to allow multiple systems to communicate.

It will be understood that central angles from these three types of interval bottoms (chord root, tonic, AMIB) can be understood with basic arithmetic. As an improvement the music interval feeding process will receive or convert the data into a format commensurate with the MIDI system, in which note values are known by both non-octave-reduced central angles, comprised of −360° per octave, as well as the octave-reduced version (pitch, aka C or Eb), which falls between −0 and −360°. This is because the system will sometimes use non-octave-reduced intervals in methods for mapping the color sets on color object arrays. One can think of the non-octave-reduced form (MIDI Note #'s from 0-127, also expressed as Pitch plus Octave (e.g. C5 or G#2, etc.) as a helix, and the Chromatic Circle form as having had the octaves 'reduced out' by repeatedly dividing by −360° until the value falls between −0 and −360°. (The result of the division will be rounded off per the resolution of the THCC rings. Note that the number of times one needs to divide by −360° to achieve this is the number of octaves of the original interval bottom pitch). After dividing out the octaves the procedure will be to take the remainder (central angle) and rotate the THCC ring by this amount. In terms of a 12-Res thiNC interface the process is the equivalent of counting intervals on a plano. One could count up (and/or down) to all members of an interval construct from any arbitrary starting pitch on the plano (using it as an AMIB), and then octave-reduce each semitone span (number of plano keys, aka semitones) by dividing the semitone span by 12 until one has a value less than 12. To find the angle one would then multiply this amount by −30° (the central angle for half steps in the Chromatic Circle and THCC, which we could represent as twelve thiv's in a 12-Res m2h index). The intervals in the monophonic music sequencer track, for each THCC ring, will be some octave-reduced central angle span from the AMIB to the interval. It may also be possible to denote this interval as the sum of an octave-reduced central angle span from the AMIB to a current tonic (if known), plus the octave-reduced central angle span from the tonic to the interval. And it may also be possible to denote this interval as the octave-reduced central angle span from the AMIB to a current tonic (if known) plus the octave-reduced central angle span from the tonic to a current chord root (if known), plus the octave-reduced central angle span from the current chord root to the interval.

As mentioned above, the polytonal color sets that can be generated from feeding in musical chords and progressions in this way, function as hue spoke-comprised palettes. Each hue spoke shows one possible example of the interval construct (if the interval construct is a chord, each spoke represents the chord from one particular potential hue root; if the interval construct is a progression, viewing the progression along one spoke only, [covering all but one spoke with a graphical cover] shows the progression from one particular potential hue tonic). The user can audition hue chords and progressions, and choose which hue chord root or hue tonic to use. And a user can create new color set relationships by auditioning music-theory-prescribed chord substitutions or variations for the progression on the hue spokes.

Display of the polytonal color sets (all spokes simultaneously) can be performed as color harmony effect of the present invention as well, such as on LED lights on a casino wall.

More commonly, once a particular hue chord or progression palette is chosen, the user will want to select a single hue chord root or hue progression tonic, and visually voice hue intervals using it (similar to the common case in music, which is not polytonal)

To enable the user to accomplish this, an improvement of the GUI will be to provide a "cover" (preferably black) that can be turned on or off by the user (e.g. made visible or invisible as a vector graphic element) that completely covers all the rings except for in a single sliced-out section, that reveals a single hue spoke (or perhaps a small hue spoke range if the resolution of the thiNC is high enough). With this cover turned on the user may then audition the hue interval constructs according to a single chord root or a single musical progression tonic. By default it is preferred for the visible hue spoke revealed by the sliced-out section to be along a vertical radius (crossing the 6-o'clock or 12-o'clock position of the thiNC interface—with the sliced-out section being vertical).

In typical music chord changes usually occur less frequently than ⅓ times per a second. But melody notes sometimes change faster than this. If the thiNC interface is intended to be covered, so as to visually voice hue intervals with a single hue tonic or hue chord root, and if the innermost THCC ring is to represent a top melody line voice, then it is preferred that a separate cover, a melody cover (with a sliced out section revealing a single hue note) be provided over this innermost THCC, and it is preferred that rotation be handled differently for this top melody voice.

This adaptation of special methodology with respect to melody voices is because they often contain note changes happening at a rate faster than ⅓ sec. Color transitions at a particular constant viewing angle will preferably not happen very quickly, per limitations of typical human vision. Changing the position of subsequent hue notes (or the color object on which the hue note transition occurs) in relation to a viewer's eye pigment helps remedy this. Therefore this innermost THCC ring can remain stationary whereas the interval angle for that top melody line voice can be used to rotate the melody cover instead. Thus the melodic intervals will be displayed 'around the ring' rather than on a spoke. A similar methodology, but on color objects such as colored lights, is applicable for visual display of any melody or bass line with rapid series of notes, including for a bass line, or when a rapid musical "riff" occurs in the middle voices. (Keeping hue notes moving is also applicable when they are "percussive hue notes' such as in embodiments where rhythmic material is visualized as flashing white or non-saturated colored objects, such as tints or shades of color).

This stationary THCC ring can then be considered to represent a special melody color object array (in which the color objects making up the array are based on a form of temporal-to-spatial translation in which relative cent or semitone interval increments are translated into relative spatial position increments according to some viewer-recognizable defining geometry, for instance along a line formed of a series of color output device pixels (per the definition of pixel given below) for viewing hue notes.

As an aside, one thing that may be observed is that as one looks at a thiNC interface such as the one illustrated in FIG. 14, is that not only does each spoke have its own set of colors with their own physiological and cultural effects, but the neighboring hue notes in each spoke vary terms of the relative JND characteristics of the color ranges shown. When neighboring hue notes are both in a range where MacAdam ellipses are relatively very small or relatively very large this can affect color set decision-making by the user. The thiNC interface can be used to aid such user decision-making. These factors are most applicable when neighboring hue notes in a spoke are based on octave-reduced semitones (E.g. neighboring hue tones based on C and B, E and F, or any pitch interval of this octave-reduced span). With narrower JND's the particular functionally corresponding hue semitones become more dissonant than otherwise. With wider JND's the functionally corresponding hue semitones can become less noticeable in function (such as leading tone function or "pull") than otherwise. Logically this can be assumed to vary according to the size of the hue notes concerned (as experienced by a given viewer) and where they occur in the field of view. But our purpose in describing the preceding is that for music-interval-comprised data that contains such octave-reduced semitones, one can notice the influence of these factors on the thiNC, and if necessary weight these factors against the desirability of the actual colors, and adjust the choice as to hue chord roots and tonics to achieve the best overall result.

Prior Art of Color Harmony—Key Color and Complement are Switchable

Figure 15:
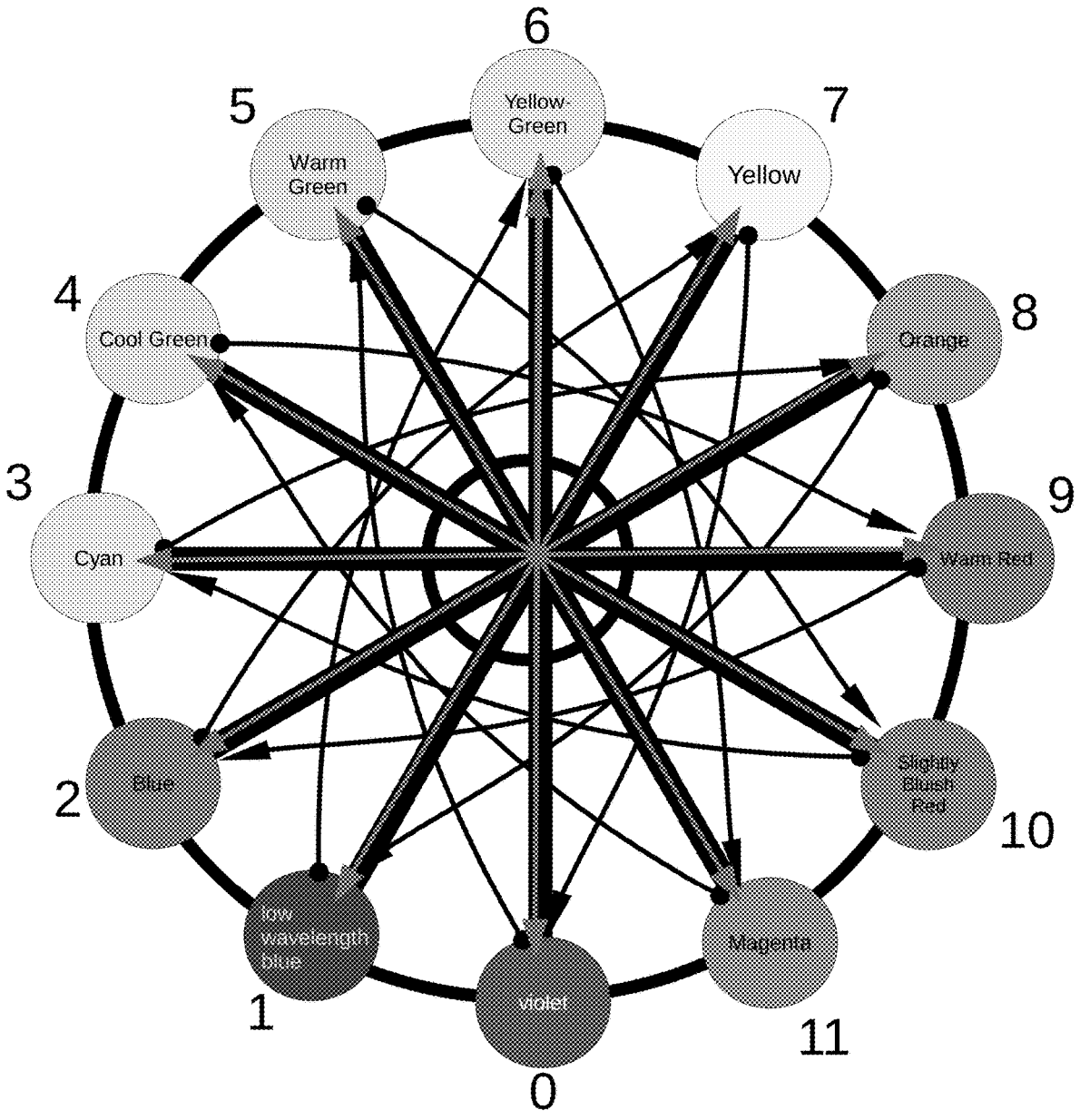
FIG. 15 illustrates the color science key color-to-complementary color pairing versus the present invention's employment of the "slight arc" away from the color science complement to achieve the hue P5 and hue P4 intervals.

FIG. 15 illustrates the color science key color-to-complementary color pairing versus the present invention's employment of the "slight arc" away from the color science complement, to achieve the hue P5 at −210° and the hue P4 at −180° from the 'key color' (hue chord root or hue tonic) as the most significant hue intervals of the present invention. Why does this, along with other comparisons between music theory and color, even matter, since color is definitely not music? In the prior art of color harmony a key color and its complement can be swapped on the color wheel. In the present invention it was realized that diminished intervals in music correspond to this "more energetic, tense, ambivalent and atonal" behavior (exhibited by the colors connected by the red arrows in FIG. 15. It was also realized that the artists who called the relationship of Yellow and Violet "complementary" were using a Red, Yellow, Blue color wheel. But it has been found that colors that are opposite on this Red, Yellow, Blue wheel often are not conforming to the more modern scientific definition of complementary colors. So perhaps artists were capable of sensing that this Yellow and Violet color pair actually was operating as a fundamental harmonic pair. In the present method we have determined it to be operating as a hue P5 with Violet as the root. (This means Violet is capable of serving to create a sense of resolution when displayed after Yellow). In further research we deduced that other hue intervals of the present method, when produced with vibrant hues, should in some manner functionally correspond with their musical counterparts—so that diminished and augmented intervals should produce a feeling of a sense of interesting energy, tension, or uncertainty. (And if placed too close together in simultaneously display or given insufficient vibrancy as hues, the pair can create an unpleasant discord). It was expected that other intervals should produce functionally corresponding effects as well, while normally still conveying, as individual hues, their expected physiological and cultural impact. Meanwhile it was observed that diminished intervals and augmented intervals are responsible for a degree of excitement in modern music if deftly used. For example diminished intervals are essential to Dominant chords, diminished chords and dim7 chords add interest, aid in harmonic movement and help enable modulation in literally countless jazz tunes, and min7b5 chords and min6 chords are key to allowing melodic and harmonic minor cadences and minor jazz sounds. And Lydian-based melody lines (that harmoniously emphasize the diminished interval) have become popular in modern rock and fusion. On the other side of the tracks numerous popular tunes and film soundtracks use progressions dependent on augmented chords, including Stairway to Heaven by Led Zeppelin, Baby Hold On! by Eddie Money, numerous accompanying pieces from Star Wars, the tracks Us and Them and Dogs by Pink Floyd, and tracks by the Beatles such as Michelle, Something, I am the Walrus, and She's So Heavy. These are energetic and often tense music interval constructs, in contrast with the more relaxed and tonality-defining P5 and P4 mentioned above. An example of these are the pitch class set of C and G that can either be a P5 or P4 depending on which pitch is the root. Knowledge of this pair, per timing context and inversion, can enable it to be used to either strengthen the root (as a P5) or create an often-desirable effect of suspension (as a P4). Between the very energetic, ambiguous or tense intervals and the very tonality-defining ones, we have the thirds and sixths. The interval of the major Third and minor third, add a layer of nuance to triads. All of the above nuances can be compounded, by stacking thirds, adding M6 intervals, and ninths, and so on. Then there are more dense interval constructs that add a whole new dimension perhaps better described as 'wondrous' than 'tense'. Suspended chords, such as those employed in The Rain Song, by Led Zeppelin, can help create this sound (The Rain Song also uses an augmented chord and arguably an augmented suspended chord as well.) Another such chord, the Major 7 flat 5 chord, can create a sense of complete mystery. In music the nuances of intervals and stacked thirds and fourths are used like an entire language. But music is apparently based on simple natural patterns called harmonics, present in nature; but reasonably corresponding relationships in the hue sensory domain are unexpected for reasons expressed in the literature of the prior art.

Figure 16:
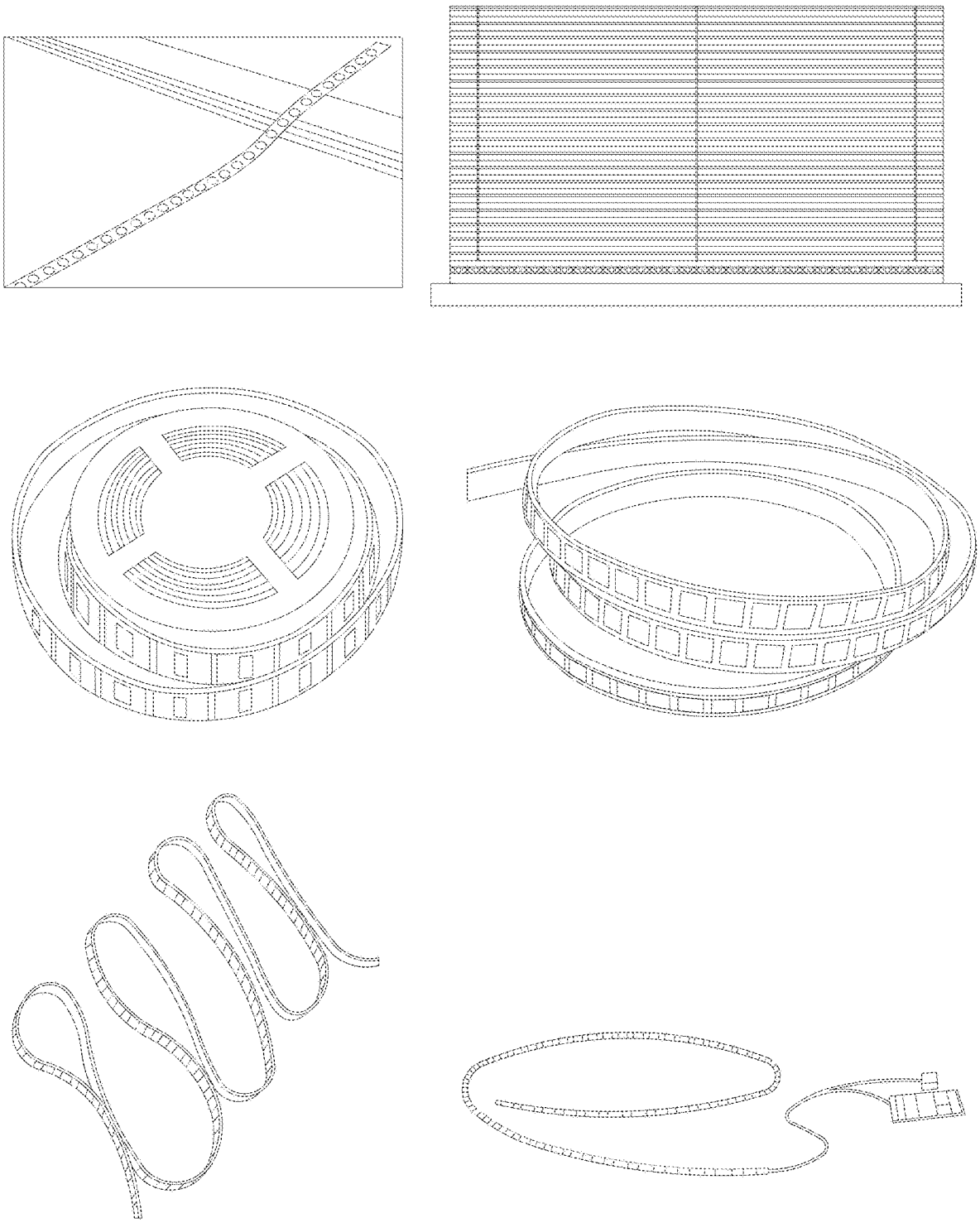
FIG. 16 illustrates examples of LED Strip Lights.

Led Strip Light Examples—Corresponds to the Strip Lights in FIG. 16 Our Use of the Terms Pixel and Pixel Unit Defined FIG. 16 shows some examples of LED Strip Lights. RGB LED strip lights are an example of a color output device. For purposes of our description we will use the term "pixel" to refer to the embodiment, or the theoretical construct, of manipulation of relative power of a set of color-mixture components, such as Red, Green, and Blue (it will be intensity value variables of primary components possibly along with spot color components). For example herein therefore, "pixel" can describe an RGB LED color output device employing just a single iteration of this construct (the construct being the software variation of color mixture components) to achieve a single color from the perspective of a viewer. (Often in such cases, especially with respect to the present invention, a blending means such as a diffusion filter can be used to avoid a viewer seeing the individual color mixture components). A pixel can be a local bundle of LEDs of any configuration. But it also can be a group of such RGB LED light "pixels" that is simultaneously sent the same set of color mixture component values. In this case we call this group a "pixel unit" (since effectively the group only receives one color at a time, just like pixel on a computer display screen). The pixel group can be any size, consisting of any number of LEDs. Alternatively a color output device may be comprised of n number of (independent) pixels and therefore serve as n number of color objects. Nonetheless pixels and pixel units are two of the more simple constructs that serve as color objects. A similar construct exists in the virtual sense, such as when an entire vector graphic object is of uniform color, and is known by its current set of pixel locations. This might be called a virtual pixel unit. And a virtual color object can be more sophisticated than this, involving texturing effects. A color object "instrument" is a construct that can employ manipulation of real or apparent (virtual) spatial location of color objects. We will now give extremely simple cases so that the method is properly construed in its most general light.

Blocked Out Examples in Terms of the 12-Res THCC

Turning now to FIG. 17-22, we will now describe and illustrate examples of working with such track types, including tracks containing melody, bass, and chords (with their chord roots detected as described above.) (In some embodiments a plurality of hue notes for each musical chord would be utilized. For simplicity we do not do so here, simply using the bass note, or the chord root, or both, to harmonize with the melody. This allows us to convey the use of the invention for embodiments using simple RGB LED strip lights as the color output device/s). In the case of our example each of these track types are shown as resulting in a sequence of hue intervals being displayed over time on an RGB LED strip light set. Each RGB LED strip light receives, as a set of RGB components, only a single color at a time (i.e. each serve as one-pixel unit according to our definition above). (Many strip lights allow the independent addressing of each RGB LED or bundle of same, but this is unnecessary here.) Note that one may align the THCC to an octave of musical intervals arbitrarily. In later figures we will illustrate the use of variable alignment between music and hue of the m2h index. Then we will go on to describe the use of independent music tonics (related to input) and hue tonics (related to output).

Above in the section about relating the musical Chromatic Circle with the THCC it was said one could 1) Choose a) a static (fixed, unchangeable) orientation (between music and hue as representable by the musical Chromatic Circle in relation to the THCC), or b) use an offset-able default orientation (either of which can be arbitrary) between the pitch domain and hue domain. Here for simplicities sake, for FIGS. 17-22, we have chosen to use a static orientation. The music we will use for these figures is in the Key of F, so we will use a static correspondence where the alignment between the musical Chromatic Circle and the THCC will be such that F=Violet. In FIG. 15 the value 0 could be placed by any hue, indicating that as the hue tonic. It is based on the interval arrangement of the 12-Res THCC of FIG. 12, which shows 0 (arbitrarily serving as tonic) as aligned with Violet because Violet is actually our preferred default hue tonic. But note that since the actual music tonic is F in the piece of music visualized in FIGS. 17-22, therefore whatever hue we align with F will be capable of becoming the hue tonal center for the hue intervals output by the at least one color output device; that is of course if the interval construct of the piece of music has strong tonality. (Also note that if the actual music tonic were unknown, we could use a 'default music tonic of C.)

Figure 17:
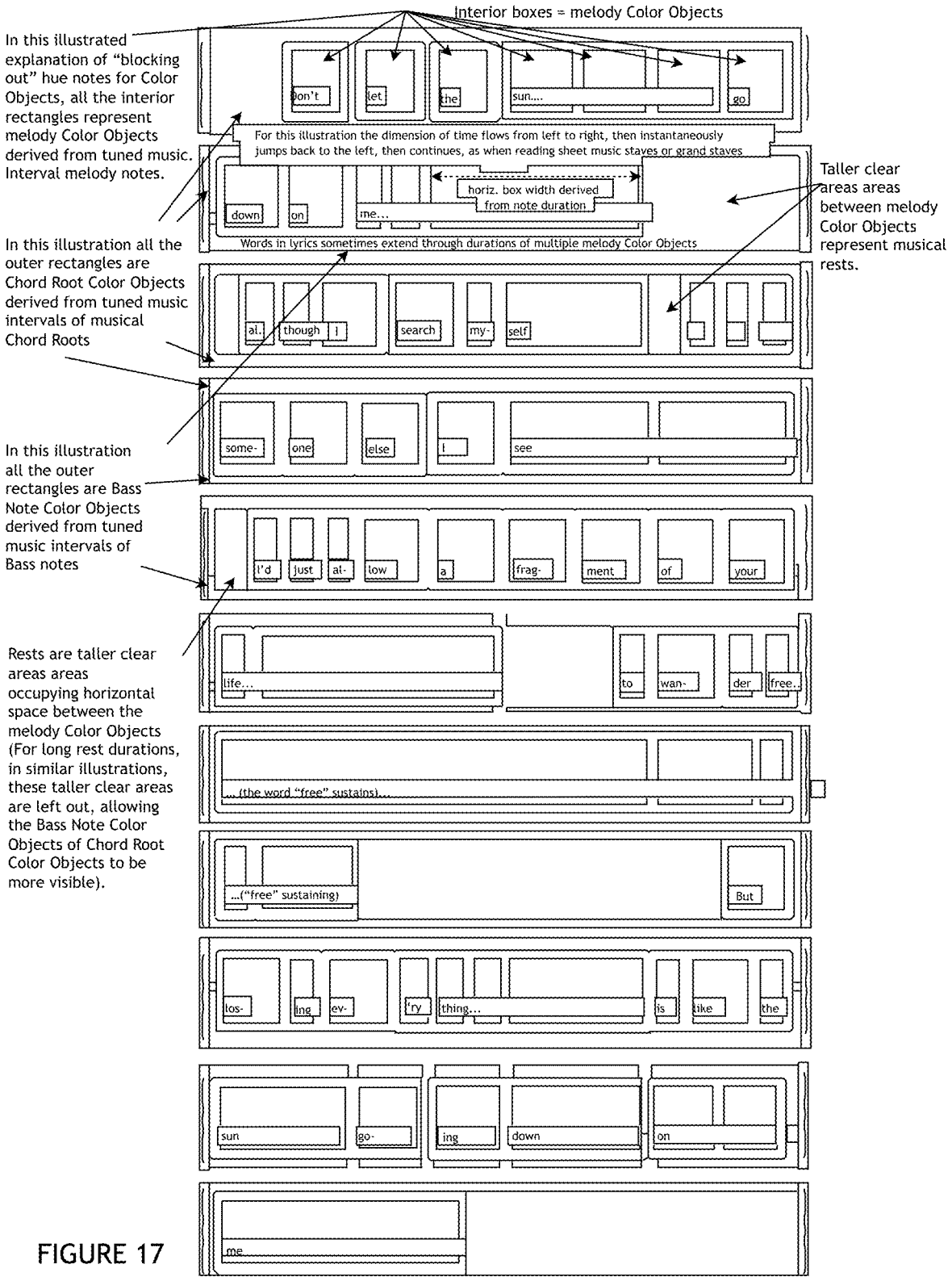
FIG. 17 is a diagram illustrating the various components used to "block out" the various color sets for the upcoming examples of FIGS. 18-22; FIG.

FIG. 17 is a diagram illustrating the various components used to "block out" the various color sets for the upcoming examples.

FIGS. 18-22 vary as to the number of channels, from one channel to 3 channels. The music-interval-comprised data for a channel (as notes of certain durations, along with note rests) for these examples could be entered directly from a lead sheet as octave-reduced values from 0-11. In this process dynamics/velocity info is not mandatory. (Because a generic chord progression can have chord tones that extend for full durations, such as whole note or half note, therefore actual accurate note duration info and note rest info is also not entirely mandatory; So for such chord progressions one can auto-insert Note Offs for each sustaining Note # prior to the end of a given time duration, such as a whole note or half note duration, if a subsequent Note On for that Note # is not found within that span). For each music interval received, the system obtains a functionally corresponding hue interval value as a thiv in the m2h index. We illustrated the results in blocked out hue notes in FIGS. 18-22. Height of the blocked-out hue notes here is arbitrary. Horizontal length of the hue note blocks is determined according to their source note's duration, producing the graphical examples that follow, resulting in the output of the color set arrangement derived from this music.

FIG. 18-22 represent sequences that can be produced on one or more RGB LED strip light color object/s, this would provide aesthetic appeal, attract attention and would be effective as storefront advertising, such as if placed around the outside window of a newly opened shop. The music-interval-comprised data used as input for FIGS. 17-21 is from an 8-bar pop music chorus section from Don't Let The Sun Go Down On Me by Elton John and Bernie Taupin, (copyright held by Hal Leonard Corporation, permission sought for this reference).

Figure 18:
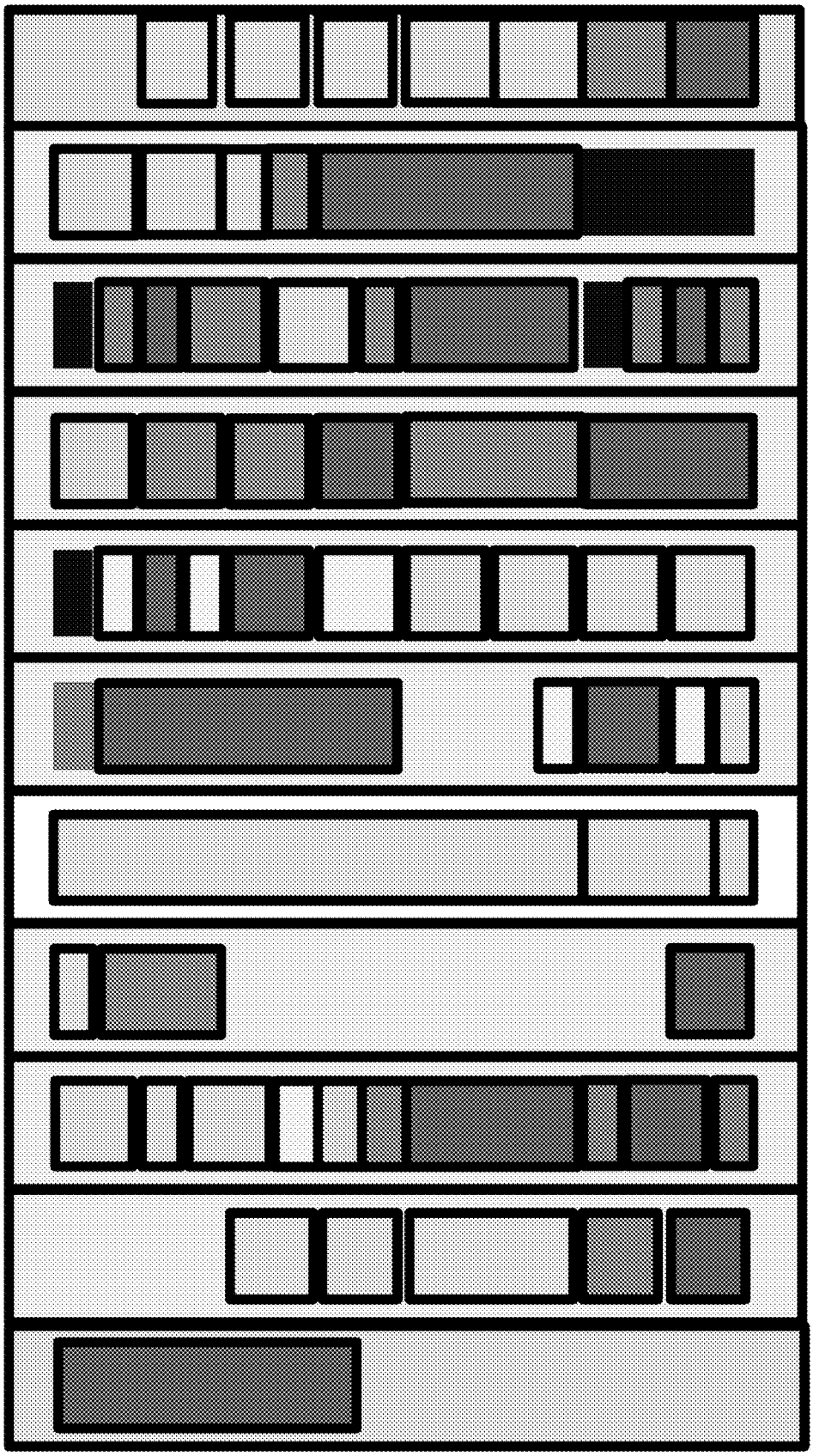
FIG. 18 illustrates blocking out the melody only as sent to one single 1-pixel-unit strip light.

FIG. 18 illustrates blocking out only the melody as sent to one single 1-pixel-unit strip light.

Figure 19:
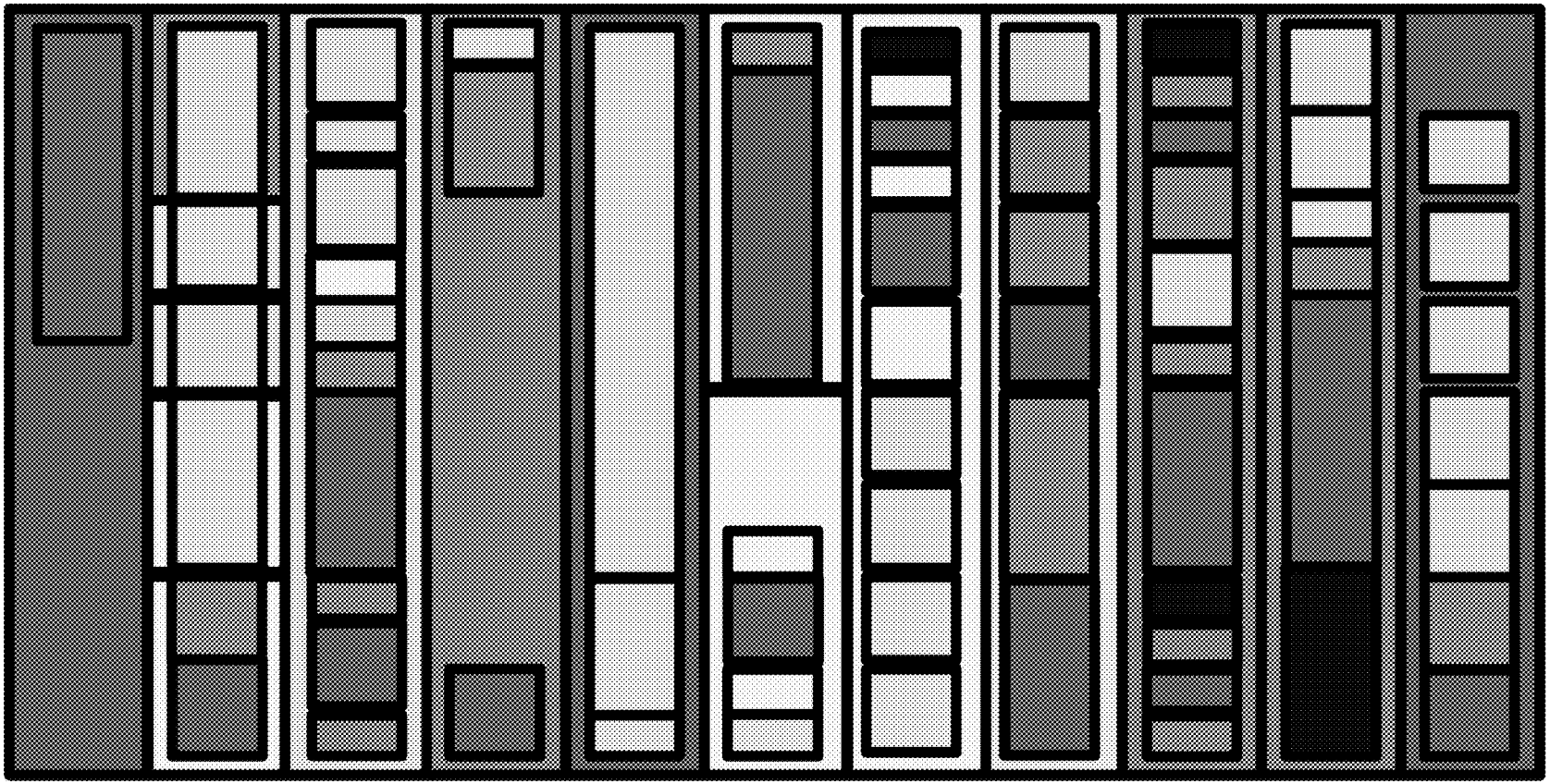
FIG. 19 illustrates blocking out the melody and bass, as sent to two 1-pixel-unit strip lights.

FIG. 19 illustrates blocking out the melody and bass, as sent to two 1-pixel-unit strip lights.

Figure 20:
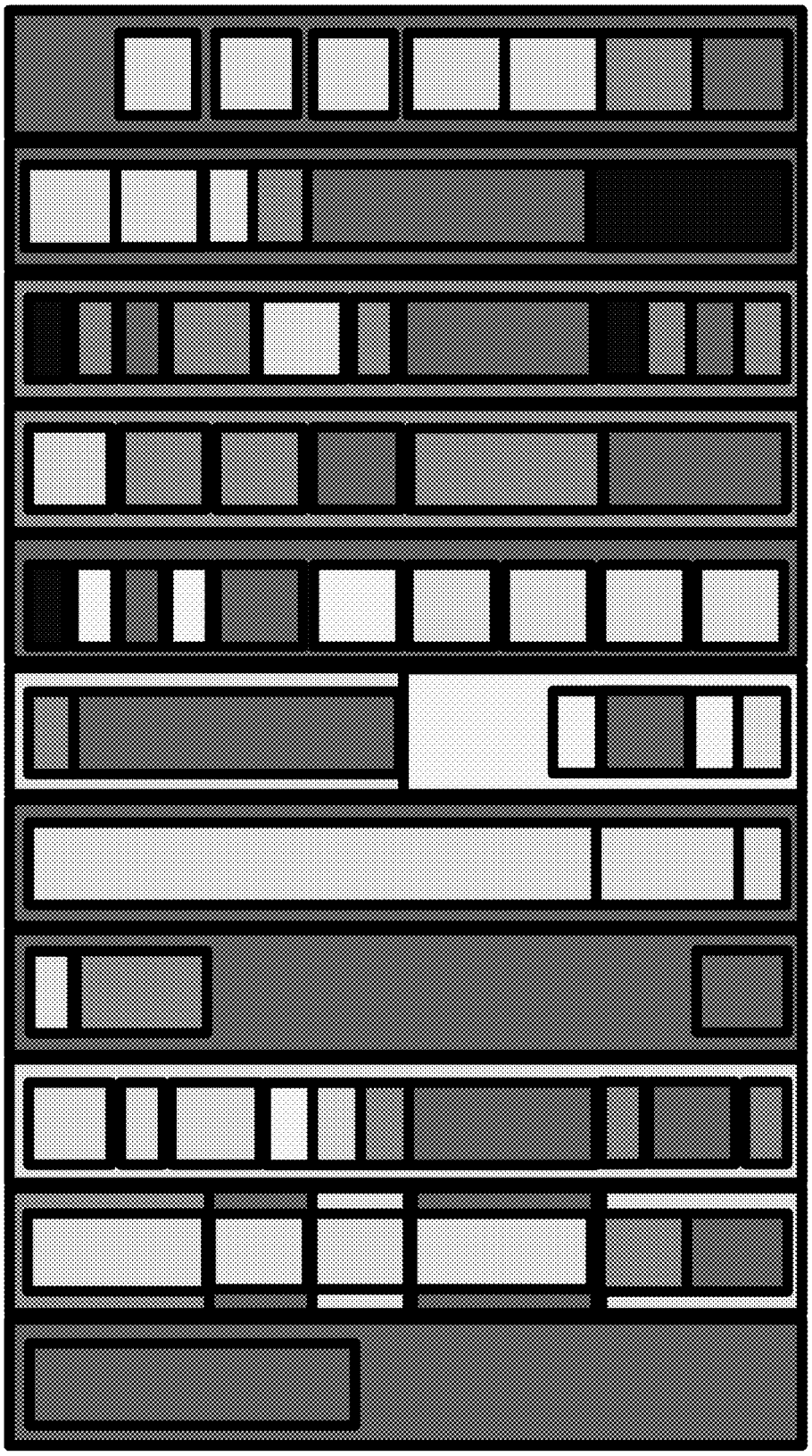
FIG. 20 illustrates blocking out the melody and chord roots, as also sent to two 1-pixel-unit strip lights.

FIG. 20 illustrates blocking out the melody and chord roots, as also sent to two 1-pixel-unit strip lights. The hue notes of melodic lines have an aesthetical flow in relation to their chord roots. This mimics what happens in musical progressions, comprised of melodic and harmonic elements. Most melodies have a "harmony" built into them as the result of the intervals comprising them. There is a sustained influence of intervals over time, whether the intervals themselves are sustained or not. Hence a musical composer can interplay the "color notes" against the chord tones, and the chord tones against the chord root. And there can be anticipation and delayed resolution. The observation that hue notes share this effect is fundamental to the usefulness of the invention. This effect exists whether the hue notes are created in animated form or through static images [with the dimension of time displayed along lines or curves]. Melody and bass hue notes (as in FIG. 19) can aesthetically interweave similarly to the way melody and chord roots do, but with more subtlety. The effect is more obvious when melody is displayed against chord roots.

Figure 21:
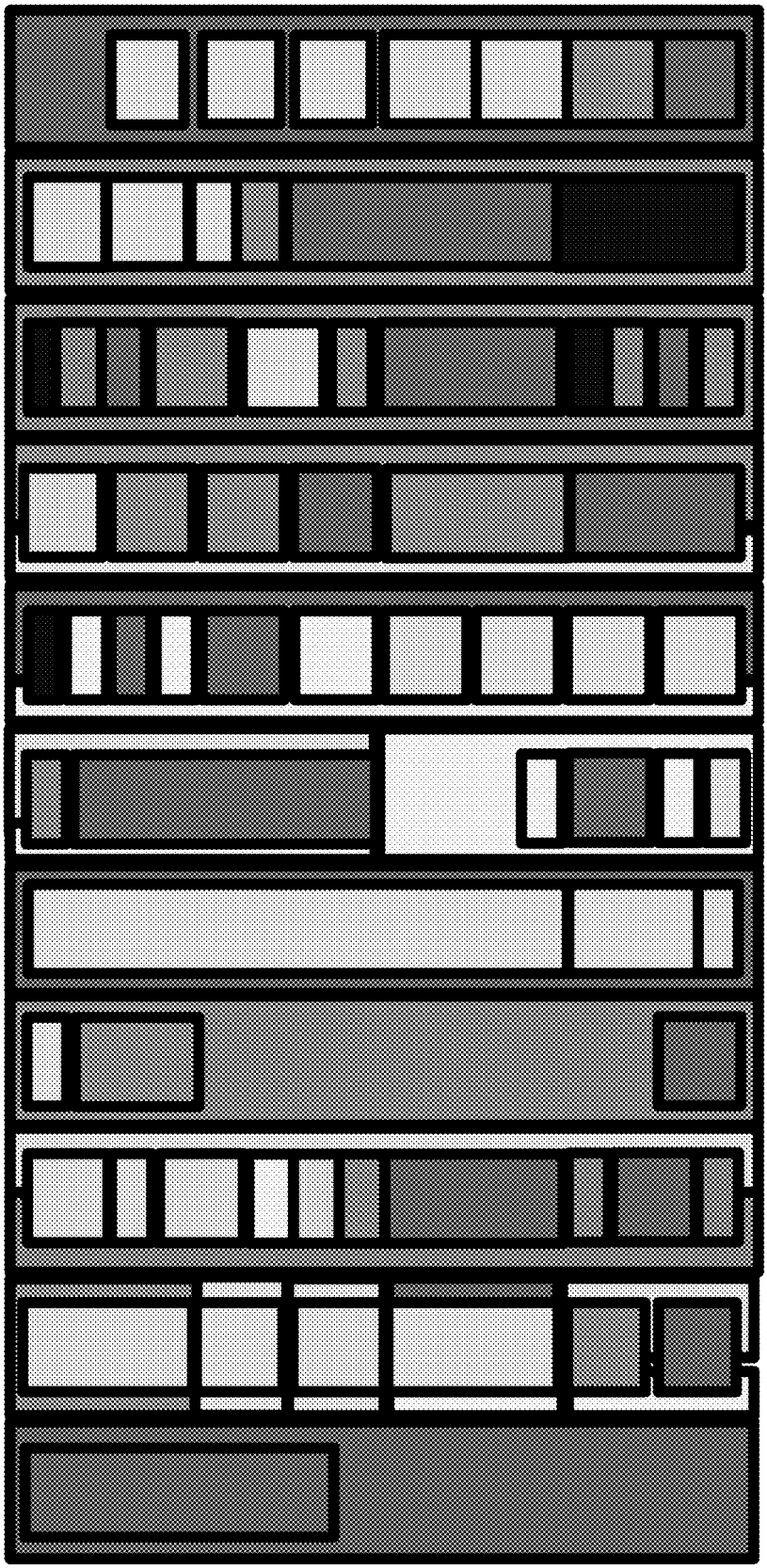
FIG. 21 illustrates blocking out the melody, bass and chord roots, as sent to three 1-pixel-unit strip lights.

FIG. 21 illustrates blocking out the melody, bass and chord roots, as sent to three 1-pixel-unit strip lights.

Figure 22:
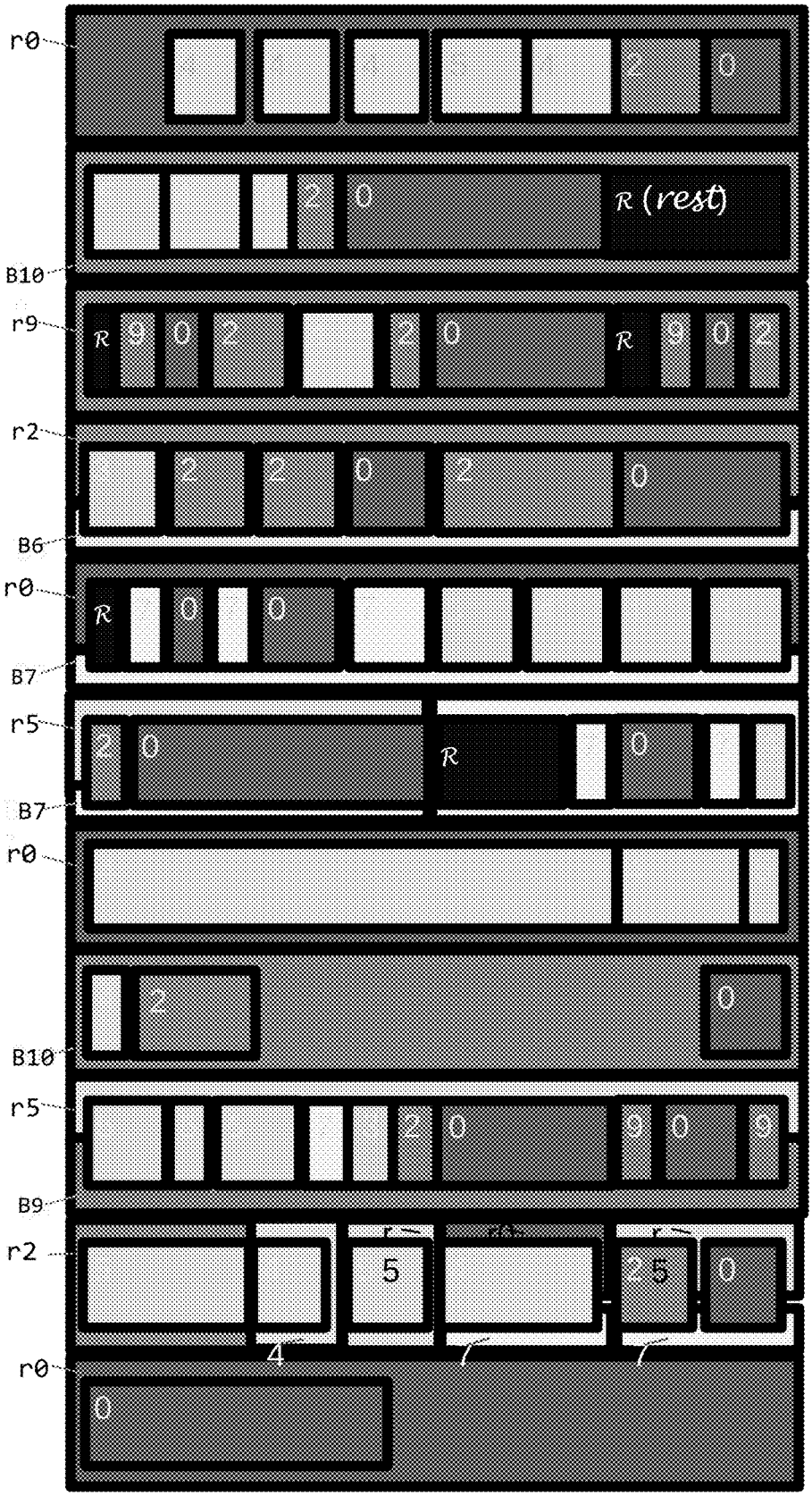
FIG. 22 illustrates blocking out melody, bass and chord roots as above, and shows the numbering of the hue intervals according to the 12-Res THCC.

FIG. 22 illustrates blocking out melody, bass and chord roots as above, and shows the numbering of the hue intervals according to the 12-Res THCC. (We left out numbering on the previous figure so the color in that illustration would represent more simply and clearly the intended hue note sequence.)

Hue Tonality of Iv-V-I

An interval construct may already have a known music tonic, or not. And this interval construct will often be auditioned, by transposition, into a variety of hue keys (with different hue tonics) until the most suitable one is found. So it makes sense to store intervals such that music tonics can be adjusted to best depict the proper Western-music-theory-determined tonality of the construct itself, and ALSO according to the chosen suitable hue transposition that arrives at the most desired color set, relative to the determined music tonic (this is what we call herein the hue tonic). The hue tonic is usually chosen with regard to aesthetic effect. Or it may be set to a desired key color in a logo or stage backdrop. Settings or changes in hue tonics are also occasionally made to arrive at desired particular hues (or their shades and tints). Sometimes experimentation to arrive at these desirable conditions includes a combination of transposition, chord substitution and reharmonization, until the most desirable color set is achieved. Note that while in Western music quite a good percentage of cases are fairly explicit, there may sometimes be ambiguous conditions with respect to what the current tonal center is. And less than absolute tonal situations will affect user decision-making. For instance a real or perceived momentary change in tonality may be a good time to introduce a hue key change. The improvements in FIG. 22 will be extrapolated below.

Hue Tonality of Iv-V-I

Figure 23:
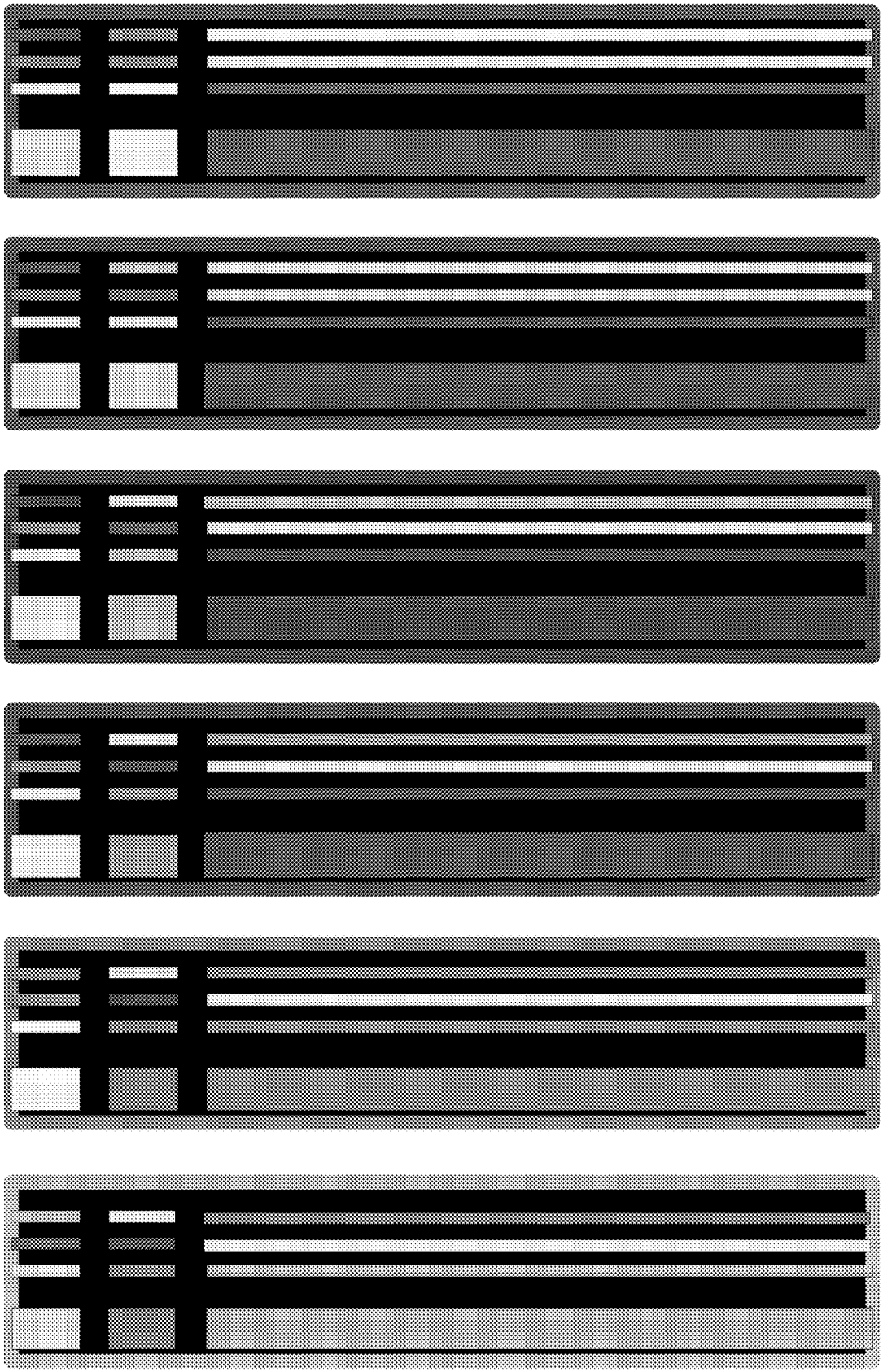
FIG. 23 illustrates hue tonality using the progression IV-V-I over a pedal of the tonic, showing a set of 6 of the 24 total hue tonics.

FIG. 23 illustrates hue tonality using 6 example hue tonics using the progression IV-V-I over a pedal of the tonic, each showing a set of 6 of the 24 total hue tonics. The hue tonics equidistantly progress through the THCC, in essence dividing it into 12 positions. For each set, the color of (1) the box of thickened lines around the progression (acting as a pedal tone) is defined by the interval of the tonic. The other rectangles are defined in hue according to their associated music intervals. Working upward from the thickened line that forms the bottom of this box, there is placed (2) a fat rectangle that acts as if supplying the root of the triad in a bass register. (3) The next lowest rectangle acts as the root of the triad in the treble register, followed by (4) a rectangle acting as its third and (5) a rectangle acting as its P5. Above these is the thickened line forming the top of the box, but it is of the same hue value as the first hue chord tone so we will not re-list it. The IV-V-I chord intervals, according to that very simple arrangement, proceed from left to right. The IV-V-I progressions for each hue tonic proceed downward, from line to line. In our hexadecimal notation mentioned in FIG. 9, this progression looks like this:

TABLE-US-00001

| From Tonic: | From Each Chord Root |
|---|---|
| IV) 05590 | 70047 |
| V) 077b2 | 50047 |
| I) 00047 | 00047 |

Hue Tonality ii-V-I FIG. 27-30

Coincidental Correspondence Re Color Matching Functions

Figure 24:
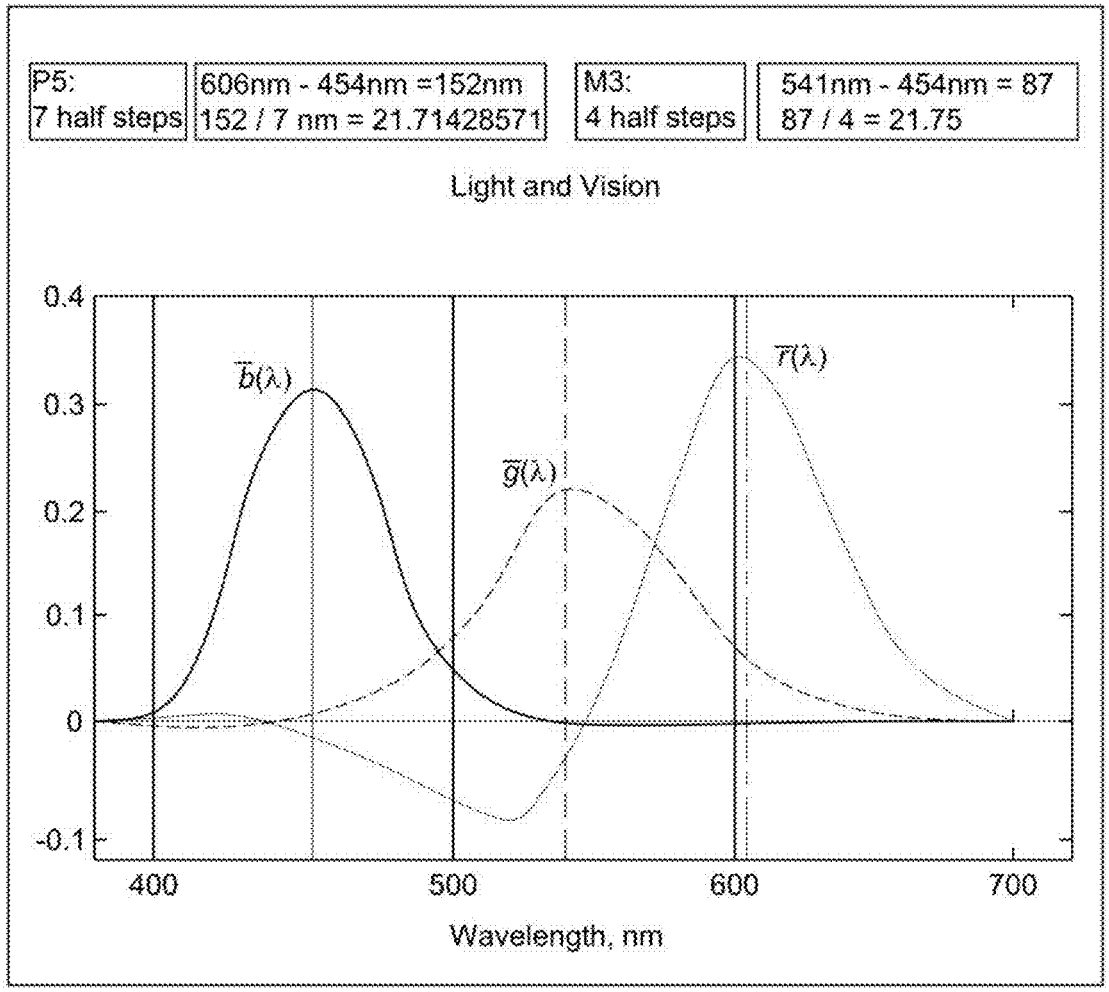
FIG. 24 illustrates the correspondence between the Color Matching Function peaks shown below & the present invention's preferred (linear) Hue Half Step (hue semitone) of approximately 21.7 nm.

FIG. 24 illustrates the perhaps coincidental correspondence between the Color Matching Function peaks shown below & the present invention's preferred (linear) Hue Half Step (hue semitone) of approximately 21.7 nm.

Physiological Research which May Support the Visible-Spectrum-Like

Figure 25:
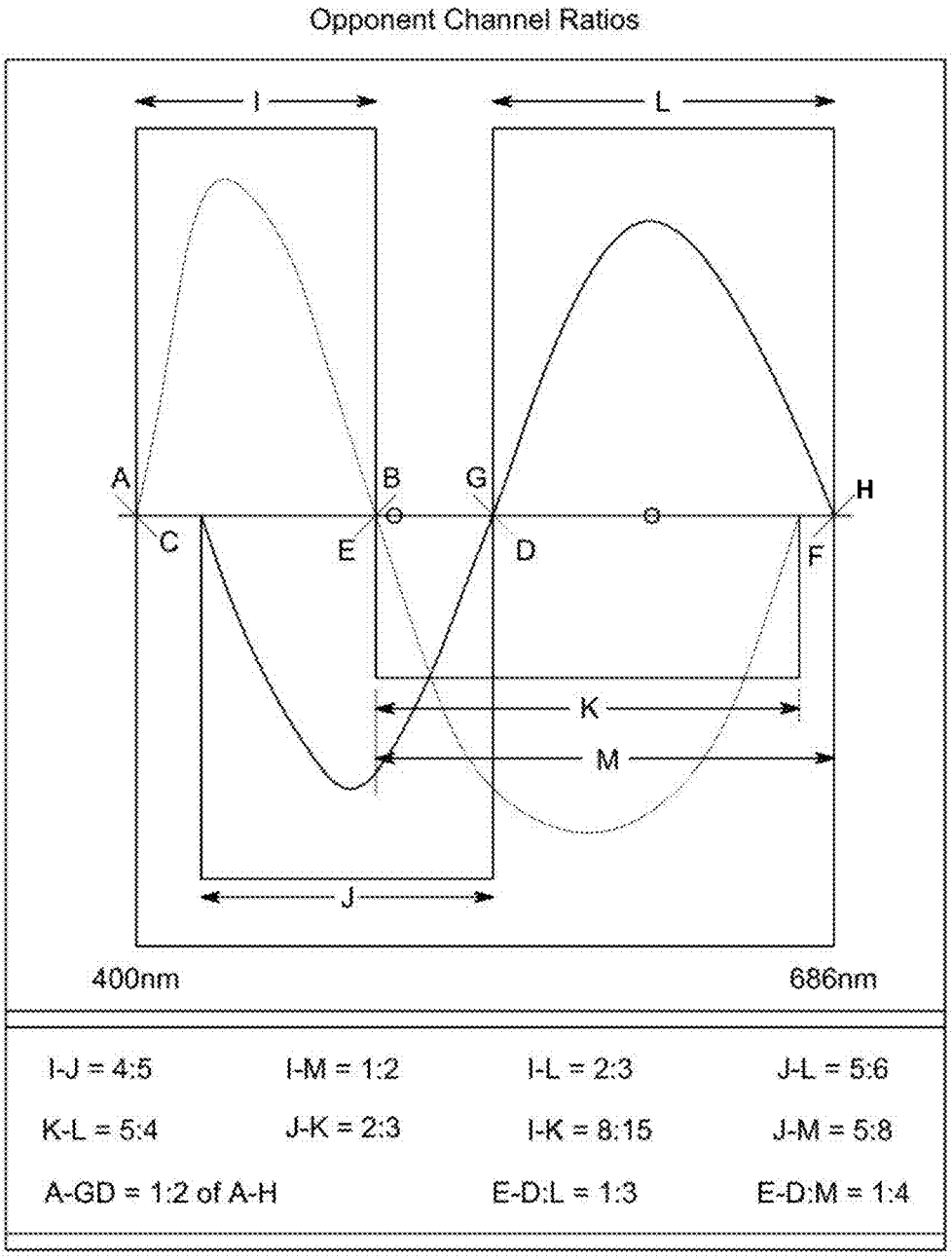
FIG. 25 illustrates ratios corresponding with the opponent channels said to be involved in the human visual system.
Figure 32:
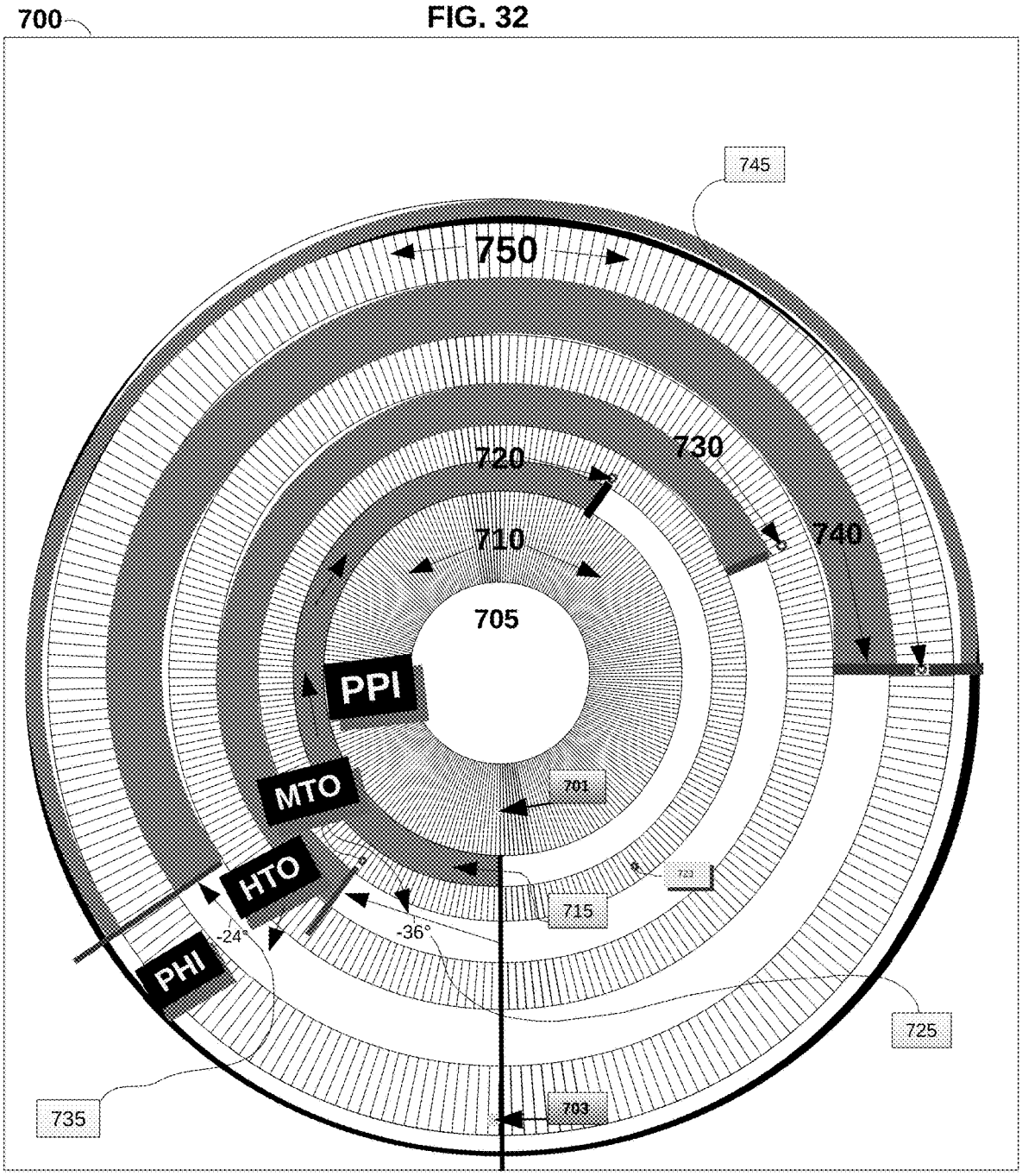
FIG. 32 is an exemplary demonstration, in angular form, of the looking up a music interval in the PPI, then adding the MTO & HTO to the negative central angle to derive the final tuned hue interval variables in the PHI.

FIG. 25 shows ratios discovered during research into the invention, corresponding with the opponent channels said to be involved in the human visual system. It is not known whether these ratios are in some way involved or meaningful with regard to the present invention. Color harmony, to the present invention, may be considered to involve a visible spectrum-like hue gradient. These ratios of the opponent mechanism were noticed to approximately occur along the gradient of the visible spectrum. At least the graph in FIG. 32 is based on a graph appearing in the book Computer Generated Color, by Richard Jackson, showing opponent channel signals by way of electrode recordings from opponent ganglion cells. The book did not indicate a specific source for its graph (human physiology, primate physiology) so unfortunately, we do not have sufficient information to fully speculate but we include this information for completeness.

Chromatic Circle as Base of the Interval Helix

Figure 26:
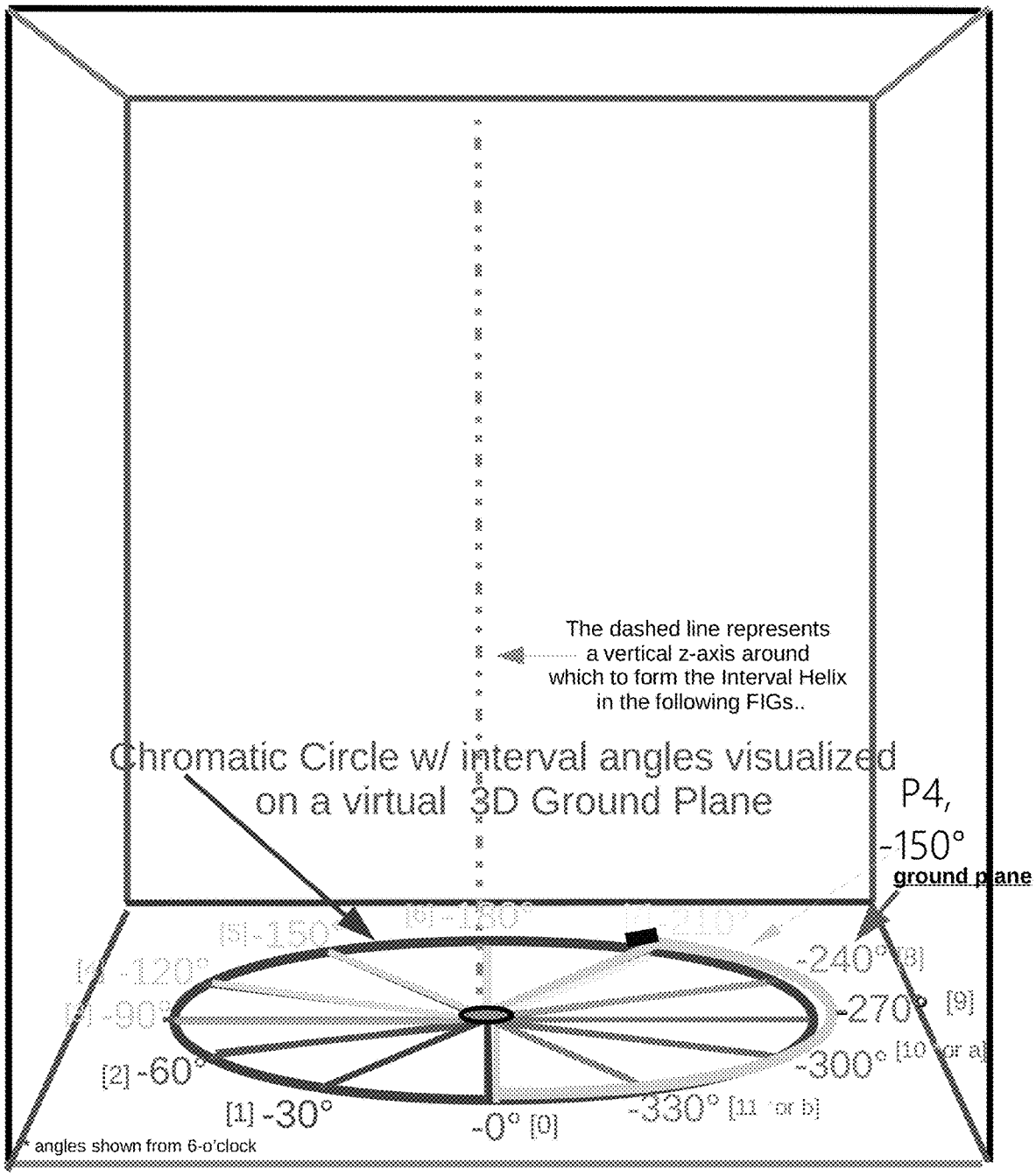
FIG. 26 illustrates the use of the Chromatic Circle as the base of a 3D Interval Helix GUI of the present invention.

FIG. 26 illustrates the use of the Chromatic Circle as the base of a 3D Interval Helix GUI of the present invention.

The Interval Helix

FIG. 27 illustrates the interval helix. The interval helix of the present invention is a 3D helix structure associated especially with music intervals, in which increase in vertical height is associated with decrease in musical wavelength & increase in musical frequency. Relationships between music intervals and correlated hue intervals may be represented as positions in 3D on the interval helix. The interval helix is a useful visualization means because it simultaneously represents octave-reduced and non-octave-reduced intervals. As a convention we have now defined our "arbitrary music interval bottom" (AMIB) on the interval helix as C, Octave="minus one" (C−1), MIDI Note #0, =8.175798916 hz.400, at the bottom of FIG. 22, shows the "music tonic arrow", arbitrarily colored green here. It is an arrow meant to point to the current music tonic (root of the current music key), as defined in sequence files or by direct user input. (In preferred embodiments a music tonic and a hue tonic can both exist for the interval data.) In virtual form it rotates around the center axis of the interval helix, pointing approximately to the cent position on the musical Chromatic Circle of the tonic of the present music key.

Value of Non-Octave-Reduced Intervals—& Use of Intervals from Amib Equiv to Midi Note Number Notation Including Octave as Well as Pitch (For E.G. C5 Or D #3)

The m2h index is configured to look up hue intervals that have functional correspondence with the received music intervals being looked up. Octave-reduction is typically performed on the music intervals in the system prior to routing them to the m2h index, to put them into a form consistent with the one-hue-octave dimension of the THCC tuned hue gradient. In a more preferred embodiment the received music intervals are put into a form comprised of both the octave-reduced and non-octave-reduced values, from the AMIB. This convention is equivalent to MIDI music sequencers that reference MIDI Note Numbers by the pitch name and a number indicating the octave of the pitch. Non-octave-reduced intervals are important in the present invention. Both the octave-reduced and non-octave-reduced intervals should be clearly deducible in a GUI (This is a feature of a plano roll GUI, which shows the pitch relationships against a plano key representation so as to recognize the pitch class of the value against the repeating one-octave black-white-key pattern). Similar to the way that non-octave-reduced voicings play a role in the aesthetics of music, in the aesthetics of color we find a similar role is performed by hue voicings (expressed via relationships of color objects and their sets—as will be described later in FIGS. 38-49) that derive from non-octave-reduced intervals.

Music Interval Helix Inside Hue Interval Helix

Figure 28:
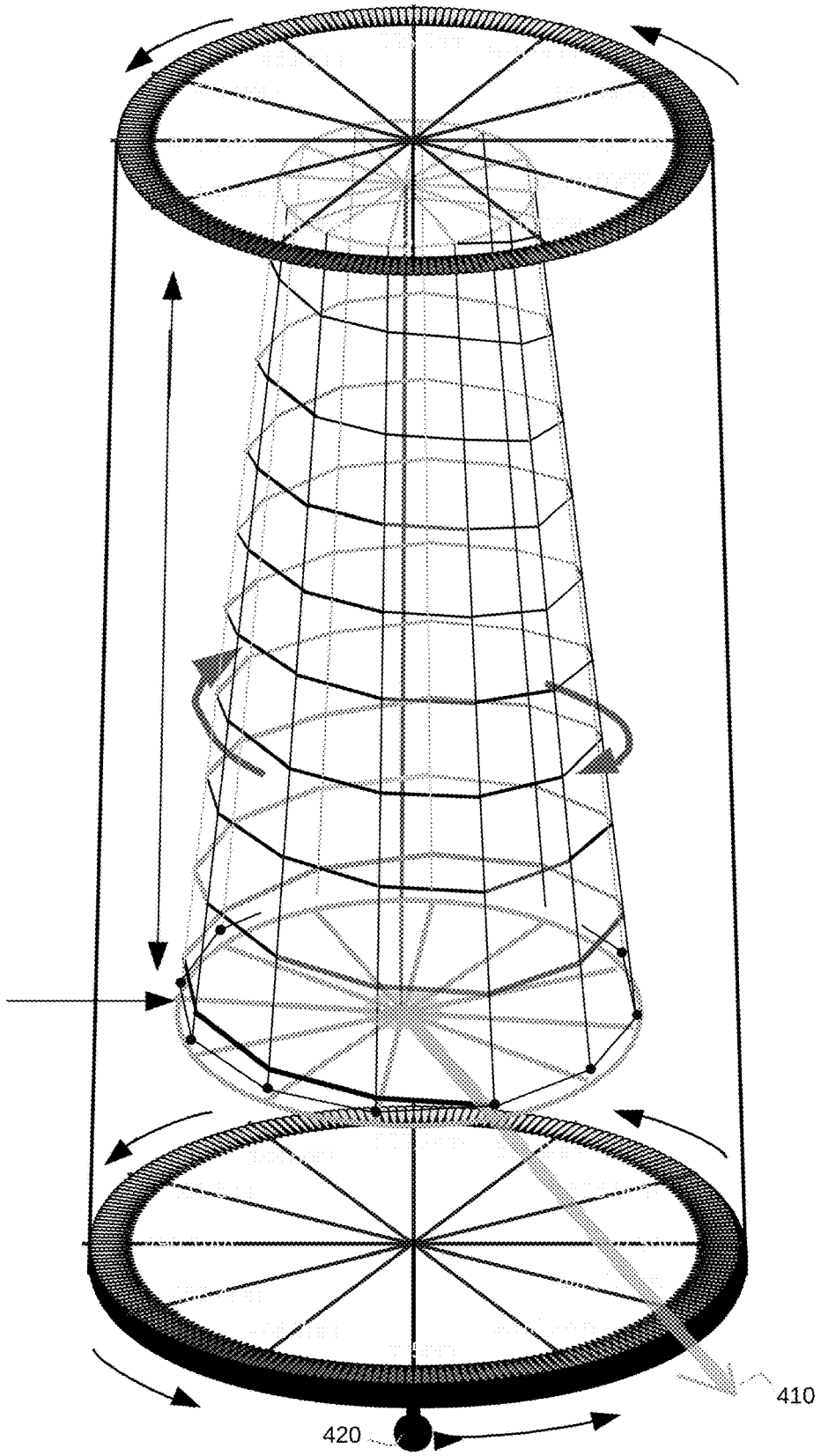
FIG. 28 illustrates a GUI comprising a Tuned Music Interval Helix and Tuned Hue Interval Cylinder that enables visualization of the universe of music and hue construct relationships, including transposition of their tonics, and visualization of the non-octave-reduced music interval voicings that will be used as input data when voicing hue notes on color object arrays, along with visualizing the octave-reduced intervals, and also a hue tonic handle.

FIG. 28 illustrates a GUI form (comprising a Tuned Music Interval Helix and Tuned Hue Interval Cylinder) that enables visualization of the universe of music and hue construct relationships, including transposition of their tonics and viewing the non-octave-reduced music interval voicings that input when voicing hue notes on color object arrays. In the illustration the two circles of the musical Chromatic Circle and the THCC have been extruded upward in relation to the multiple octaves of music, forming a Tuned Music Interval Helix (TMIH) and a Tuned Hue Interval Cylinder (THIC). Visually, as a GUI, this has the benefit of displaying the relationships of the intervals comprising the interval constructs both in terms of octave-reduced and non-octave reduced relationships. Since the "hue octave" can simply repeat relative to every musical octave (whereas musical timbre can change radically as octaves change), the hue dimension is viewed here as a simple cylinder since it will be more helpful in later illustrations. (Each hue octave is a helical cycle thru the THIC following the TMIH). (Height on the TMIH may be used to determine other variables besides hue if desired, including size of color objects, brightness, lightness, Chroma, texturing (e.g. reflectivity or opacity) and so on. No specific rotational orientation (around the vertical z-axis) between the TMIH and THIC is mandatory. Any orientation will work because it is the tuned hue gradient that is fundamental.

Figure 34:
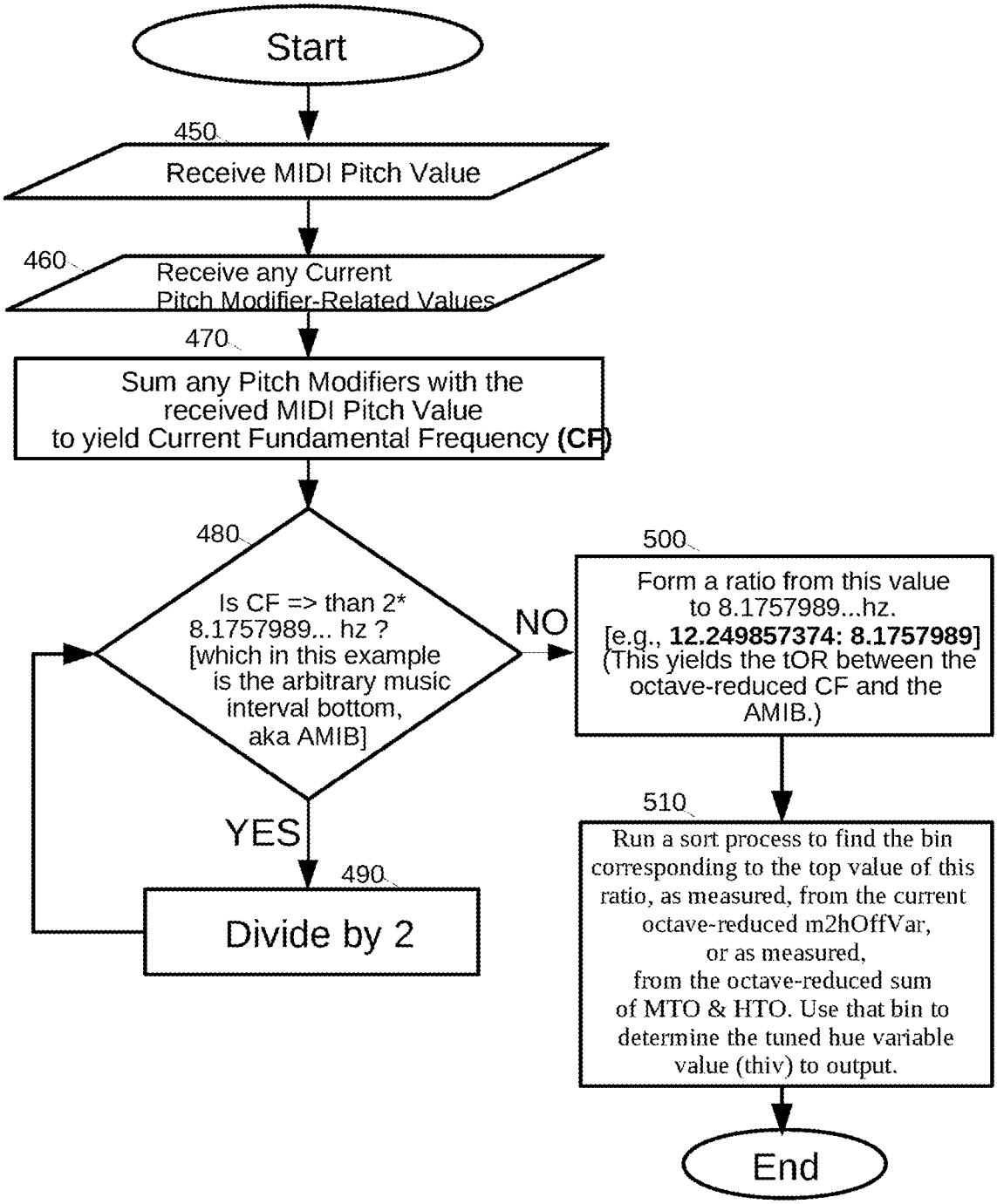
FIG. 34 is a block diagram illustrating an exemplary method of using pitch bend and other pitch modifiers, as is useful when using music protocol data.
Figure 35:
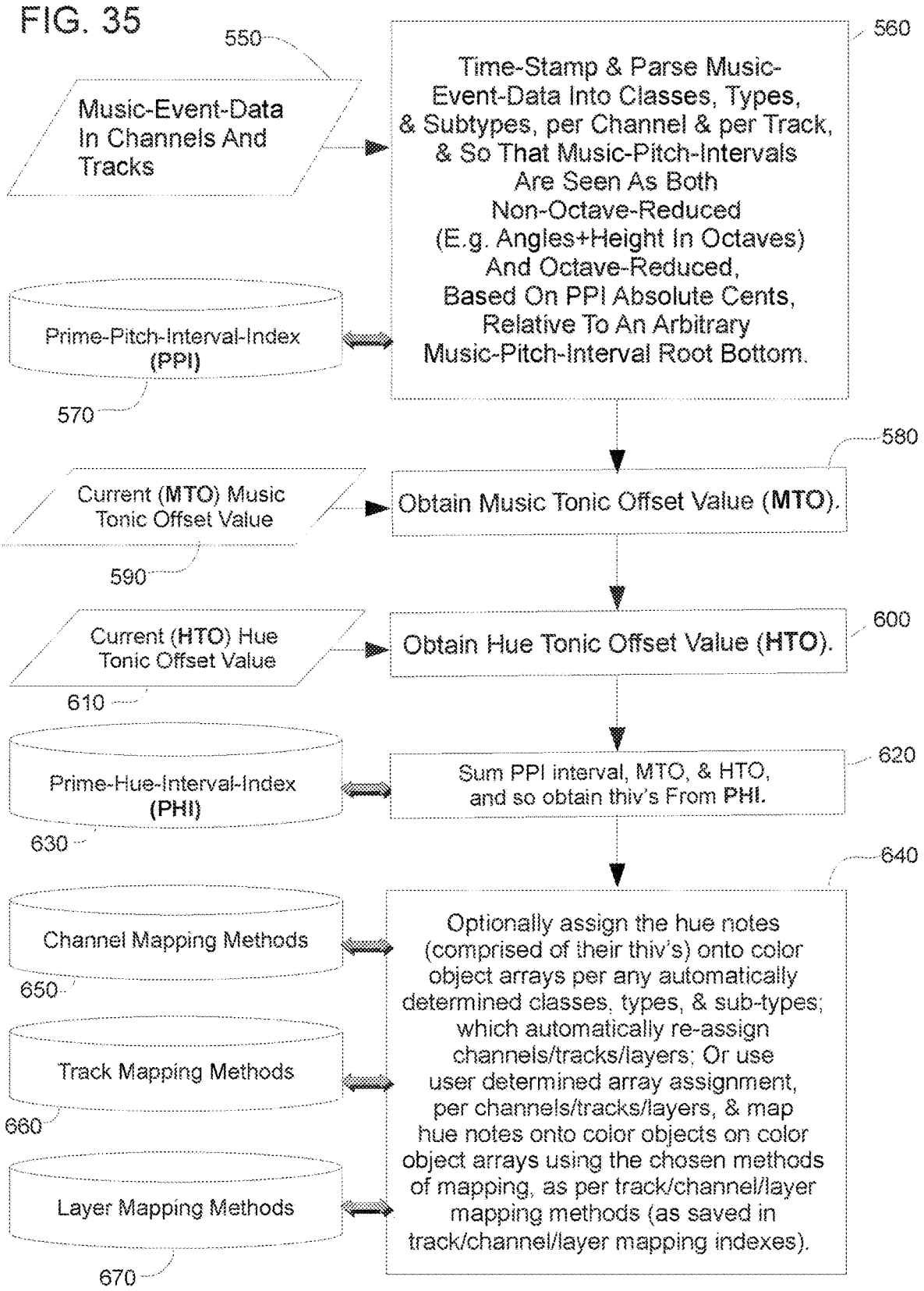
FIG. 35 is a block diagram showing an advanced flow method according to an embodiment of the invention.

As in FIG. 34. 400, FIG. 35, 410 illustrates the "music tonic arrow". The music key arrow will be used as part of an explanation for more preferred Offset methods of the present invention. Offsets and Defaults as Shown in FIG. 22. Introduces M2hcmb's, Ibp's, M2hoffvar, Mto and Hto If the m2h index lookup method doesn't incorporate an Offset Variable, this alignment is an embodiment choice (fixed, non-adjustable to users). But music & hue intervals can both be musically transposed in the present method so normally at least basic offset capability is provided using an m2hOffVar. This permits auto & user-selection of different alignments, with values stored in sequences (written to memory or storage media). More optimally an embodiment will use 2 separate indices (a first for lookup of music intervals & a second for look-up of hue intervals) whose orientation may be incrementally offset, so the hue index may be re-calibrated in case of hardware fluctuations. It is yet more preferred to offer one Offset Variable to set a Music Tonic, & a separate 2nd Offset Variable to set a Hue Tonic. This will be elucidated below.

In one embodiment a fixed, arbitrary orientation is chosen during embodiment design so that an arbitrary musical note is aligned with a functionally corresponding hue; this system has no capability for offset; it is non-adjustable to users.

In one embodiment Violet is selected by the embodiment designer to be in fixed alignment with the music tonic of the source music data (as this alignment is likely to function well). This relationship is fixed and non-adjustable.

In one embodiment basic offset capability is added for the users, using a single m2h Offset Variable (m2hOffVar) implemented in a "wrapping" lookup table consisting of m2h-cent-measurement bins (m2hcmb's) containing thiv's (see FIG. 29 & FIG. 30 below). In preferred embodiments we use the concept of 'absolute cents'. Absolute cents is a useful music theory convention permitting the indexing of cent intervals from a particular, potentially arbitrary point. Based on the present invention's functional correspondence, absolute cents in music will functionally correspond with absolute cents in hue. Hence the m2hcmb's provide this means of measuring correspondences. When the music interval span (the span 'up' from the 'arbitrary music interval bottom' aka AMIB) is obtained it is octave-reduced (per the existing Res) to be within 1 octave up from the AMIB (for an example see FIG. 33), and then the single m2h Offset Variable is retrieved; it controls the amount of Offset to be added during look up of the thiv. (This allows the creation of a new m2h alignment for responding to music tonics or selecting new hue tonics). This is basically no different than offsetting the rotation of the THCC from the musical Chromatic Circle (as a visual analogy). Offset functions, per octave-reduction, become wrap around functions, or modulus functions of the existing Res. For instance in terms of angle they would be mod −360° functions (divisions smaller than a degree are possible of course).

4) In one embodiment members of a subset of m2hcmb's (which are equidistant to one another) that contain the thiv's are made into specialty points called interpolation basis points (IBP's). When one of a neighboring pair of IBP's is adjusted by user input then the program causes automatic re-calibration of points between the neighboring pair. (see FIG. 29 below).

5) In one embodiment use of a constant 'arbitrary music interval bottom' (AMIB) is implemented as a reference point, making music intervals potentially independent from their pitches & tonics (for storage & processing).

6) In one embodiment a convention for the AMIB is chosen of C−1, & MIDI Note #0, =8.175798916 hz, an 'absolute cents' version of an 'arbitrary music interval bottom' (AMIB) that is especially suitable to MIDI input but may also be used with respect to audio input.

7) In one embodiment that offers offset capability, the Pitch C is chosen as a preferred default music tonic because music in the key of C is common, and this music key has no sharps or flats, and as such it is more often simplest to work with.

8) In one embodiment, that allows offset capability, the Hue Violet is used as the default hue tonic.

9) In one embodiment, offsetting so as to compensate for a change in music tonic away from the default music tonic is made possible by a new Offset Var called the Music Tonic Offset (MTO), and offsetting so as to compensate for hue tonic a change in music tonic away from the default hue tonic is made possible by a second new Offset Var called the Hue Tonic Offset (HTO). While one could arrive at the same alignment with m2hOffVar, it is useful to have these two distinct functions because they apply differently, and should be able to be controlled separately, as well as stored separately in memory, in files & on media. This lets users keep track & refine choices, as changes in aesthetic preferences & understanding of interval constructs naturally evolve. In this point [point 9], the MTO and HTO are utilized with a simple '2-step operation' (without dividing the m2h index bins (which have m2hcmb's directly associated with thiv's) into a set of two indices known as Prime Pitch Interval index (PPI) bins (compare m2hcmb's) and Prime Hue Interval index (PHI) bins (compare thiv's) as in the next embodiment. Rather than divide the m2h index into two separate indices, one may simply re-use the same index, after each mathematical action of offset (from MTO and HTO). So in this embodiment the music intervals and hue intervals are provided in the same m2h index (but necessarily there cannot be an independent resolution for music and hue). Herein the system is instructed to find a music pitch interval, add the current MTO, then add the current HTO, and finally locate the m2hcmb# to find the tuned-hue-variable-value. The drawback is that an unnecessary high m2h index resolution is required; and it must be repeatedly used if musical pitch bend and vibrato and portamento functions are to be accurately tracked. This is an unnecessary computational redundancy at times when hue intervals are being applied or re-applied solely in the hue domain, so to avoid it the m2h index is split into the PPI bins and PHI bins.

10) (PPI bins and PHI bins referred to in this paragraph and in this present document are independent cent measurement bins for absolute music cents and absolute hue cents respectively, to treat them separately, rather than having an equal number of m2hcmb's and thiv's). In one embodiment the m2h index comprises 2 indices (or tables within it), comprising the music interval span 'index points' (acting as an absolute-cent music interval map) and the hue interval span 'index points' (acting as an absolute-cent hue interval map). This solves the problem of unnecessary computational redundancy as described in the preceding embodiment and is more customizable for specific color output hardware as well as specific music input means. The one-table m2h index was simply comprised of m2hcmb's, containing the thiv's. In this 2-table embodiment these are now called Prime Hue Interval bins (PHI bins). Among the PHI bins can be the subset of the Interpolation Basis Points (IBPs). Both are shown in FIG. 29. Meanwhile the music interval map is formed of music interval span index points, with values stored in what we will call Prime Pitch Interval bins (PPI bins). Notably in this embodiment the music Res need not be the same as, and is no longer necessarily tied to, the hue Res. The m2h Offset Variable, which is MTO +HTO still shifts the orientation (similar to musical transposition) between PPI and PHI.

(This additionally allows the same basic software to be used with a multitude of color output devices. Thus in the case of some particular color output device that requires a lower hue Res, the music can still be detected in a high resolution (high Res PPI bins), and this information can be used to drive other properties besides hue in high Res, but rounded off for the lower hue Res (sorted via the lower Res of available PHI bins for that specific color output device). A single Offset Variable still shifts the orientation between PPI and PHI (similar to musical transposition).

We will continue to elucidate the points mentioned above as we go forward. First, we will return now to our exemplary visualization described in preceding sections, which was obtained by forming the mental concept of two circles, the musical Chromatic Circle (on the inside), and the THCC (on the outside), both sharing a common center. It was said that central angles (interval angles) from the centers of both of these circles were representational of music intervals and hue intervals. Once the tuned hue gradient is appropriately tuned and the color output device can reasonably produce saturated colors for the required hue notes, any alignment of the THCC with the musical Chromatic Circle will work. In one embodiment a fixed alignment can be used that is designed to match a particular color setting or need. For instance a Christmas Wreath embodiment can be made, and Christmas colors such as red and green can serve as possible color keys to accompany play back of Christmas tunes.

Measurement Bins (M2hcmb's) and Ibps (An Interpolation-Deriving Subset)

Figure 29:
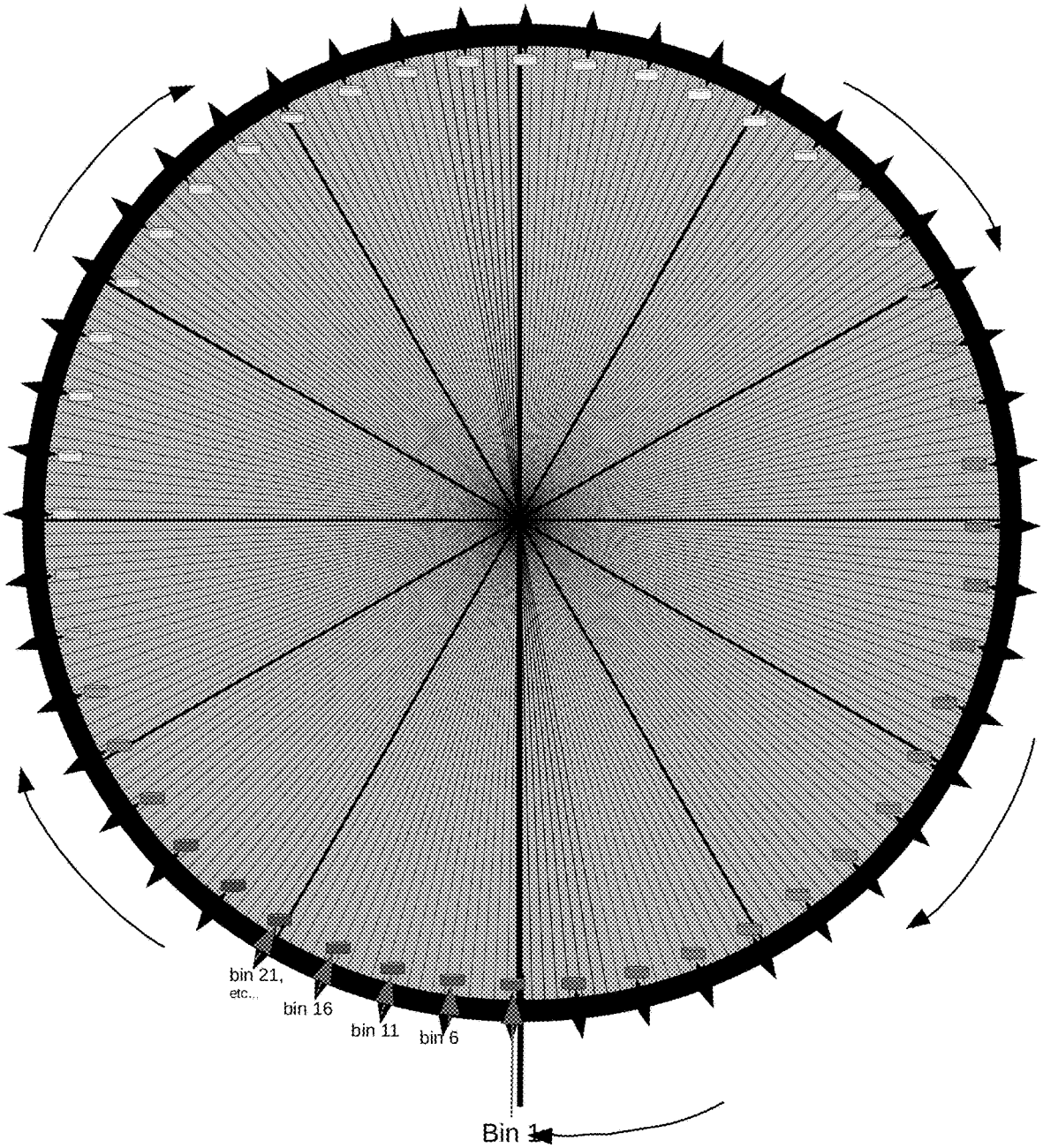
FIG. 29 illustrates m2h-cent-measurement-bins (m2hcmb's) and interpolation basis points (IBP's)

FIG. 29, which illustrates m2h-cent-measurement-bins (m2hcmb's) and interpolation basis points (IBP's). Shown in FIG. 29 are a 5-cent-per-bin resolution of m2hcmb's, for storing one "hue octave" of thiv's (i.e. 240 bins, each corresponding to a span in music of 5 cents, in 12-ET. A span of 20 bins corresponds to the music interval span of one-half step, aka one semitone). Also shown are 48 Interpolation Basis Points (IBP's) at every 5th m2hcmb, shown as short colored cylinders. If implemented, IBP's can act as "Master m2hcmb's", so that editing an IBP thiv would cause compensatory re-interpolation of neighboring thiv's. Implementing this feature enables quicker user re-calibration of the m2hcmb's when needed. In FIG. 29 spans between each of the 240 thiv's (stored in the m2hcmb's) are treated as functionally corresponding to 5-cent spans between 12-ET frequencies. Herein we arbitrarily use 8.175798916 hz as our arbitrary music interval bottom (AMIB), and arbitrarily select Violet to be in default corresponding with this 8.175798916 hz frequency and its octaves, as a default Hue Tonic

Computing the M2h Index

In one method the configuration of a m2h index is done by mathematically defining the bin frequency threshold demarcations using the AMIB frequency as the lower threshold of the first m2hcmb. From this one calculates n number of top threshold demarcations as the nth root of 2. For example if 240-Res is desired (a resolution of every 5 cents, i.e. 240 m2hcmb's per hue octave), then one multiplies the frequency of the arbitrary music interval bottom by the 240th root of 2 (which is approximately 1.00289228786937) to find and store the top of the first m2hcmb, and then multiplies the result (which also acts as the bottom of the 2nd m2hcmb) by the 240th root of 2, to find and store the top of the second m2hcmb, and continues until one has found and stored the top and bottom values of all 240 m2hcmb's. Thiv's are then associated with the m2hcmb's to form the m2h index.

M2HCMB Examples in Dominant Wavelength FIG. 30 Illustrates an Example of m2hcmb's. The Figure Includes their Dominant Wavelength Values (if they are within the DWW)

In one embodiment the m2h index is created in a resolution of 240 m2hcmb's, as shown in FIG. 29 and FIG. 30, with the hue tuning as according to the visible-spectrum-like-hue-gradient shown in FIG. 4, and in arbitrary alignment with incoming music intervals from the arbitrary music interval bottom (AMIB) of 8.199445678 hertz (C−1, i.e. C "octave minus 1"). In an arbitrary fixed alignment relative to the visible-spectrum-like-hue-gradient, the frequency of 8.199445678 hertz [C−1] will retrieve or determine a hue of violet, the frequency that is a multiple of 1.05946( . . . ) from that; i.e. MIDI Note #C−1 according to our chosen convention within this document, will retrieve or determine a hue of indigo; D−1 will retrieve or determine a medium wavelength blue, and so on, and since every octave will be reduced down into this octave that ranges from C−1 up to just under CO, since CO for these purposes will be considered the next octave up.) In FIG. 30, the column with the header marked "m2hcmb #'s" contains a list of m2h cent measurement bin numbers. In each row, a frequency bottom is indicated in the column to the immediate right of the cell containing the bin #. Incoming music intervals are sorted into a particular bin when they are on or above the frequency bottom to the immediate right of that cell, but below the frequency bottom listed in the next row down.

In one embodiment, a frequency is detected in a set of incoming music-interval-comprised data events; that frequency is octave-reduced to a real number; and then a sort is performed to locate the m2hcmb# containing the span within which that real number is be found. The located m2hcmb# is the one that contains the thiv approximate for the interval being measured.

Note, that in FIG. 30 (and it will also be true in FIG. 31) m2hcmb's are shown with a lowest bin minimum amount (aka bottom) of 8.1757898 hertz, implying a lowest bin maximum amount of just under 8.199445679 hertz. The bins have been shown this way for simplicity, though in practice m2hcmb ranges are better configured with the targeted frequency being the center frequency of the bin (approximately 2.5 cents above its bottom in this case), rather than with their minimum relative to that target frequency. For instance, in FIG. 30, m2hcmb #1 (see column 4 for m2h-cent-measurement-bin numbers, aka m2hcmb numbers) the center value of the bin would be 8.1757898 hertz. Approximately 2.5 cents below that would be the minimum value for that bin, and approximately 2.5 cents above that value would be the maximum for that bin.

Thus far we have illustrated how the m2hcmb's might function. We have described the m2hcmb's and the IBP's that one may simply visualize basic offsetting, per the m2hOffVar, as simply rotating the THCC around the musical Chromatic Circle according to the amount of the m2hOffVar. This basic principle of offset, as applied to FIG. 30, means that the bin containing a frequency greater than the m2hcmb Bottom, but less than the m2hcmb Top, will not point to that m2hcmb (and thus will not call up its thiv per the dominant wavelength in its rightmost column), but will increment an offset from that position to find the target m2hcmb, and thus call up that m2hcmb's thiv instead.

Since the music-interval-comprised data being used by the present invention will often have the property of tonality (although note that both the degree of tonality and its stability will vary) the use of offset by a user will often be to either 1) find a more appropriate hue tonic than the default, for the character of the music (if the default is not ideal), or 2) to assume a tonic based on need, such as to match a mood, or the key color in a logo, architecture, or a stage backdrop. Tonality means that a particular pitch will "sound like home", i.e. it will be the resolution of the other pitches forming the music intervals in the music-interval-comprised data. The term tonic is related to the term key, so a music tonic has its related music key, and a hue tonic has its related hue key. (The term key signature is not the same, because a key signature is shared by all of the modes it contains. For instance C Major has the same key signature as A minor, but the pitch 'C' is the music tonic of the former, while the pitch 'A' is the music tonic of the latter.)

Next we must consider tonality and keys. We did not need a music tonic default and a hue tonic default as long as alignment between music and hue were assumed to each be flexible for the same reasons. This assumption isn't true, but if it were then the more subtle ramifications could be ignored. And so in such a system if a certain preference of alignment was desired (such as aligning the music tonic with Violet or some other color) this could be done simply by increasing the offset within modulus (thus 'stepping through' the alignment positions) until the known music tonic of the data (or a test case music tonic) was aligned with the desired hue tonic In this case, in one embodiment the m2hOffVar could be controlled in real time directly by the user. In another embodiment an m2hOffVar could be controlled by placing m2hOffVar "change events" at multiple locations in a sequence.

But because of subtle aspects of hue and music tonality (which do differ both in use and effect), ideal use depends on the capability of the user to independently store, modify, and organize hue and music tonic settings, in the form of MTO and HTO settings and their "change events".

In one embodiment the MTO and HTO may be controlled in real time directly by the user. In one embodiment MTO and HTO change events are placed in sequence locations to create desired changes.

The purpose of assigning a music tonic to files is to allow for control based on the harmonic relationships comprised in the music-pitch-interval data, which in the most common music is easily determinable using music theory algorithms. On the other hand, hue intervals are much more defined by their particular colors (that greatly effect mood and energy) along with their color context (which is akin to, but even more essential to aesthetical decision-making than, a singer transposing a piece to fit within their range or purpose). Because each distinct hue has such unique physiological and psychological impact, selecting the hue tonic is unique and significant as a process. So choosing the hue tonic may be thought of as a primary function, and it may at times be the first function performed.

In one embodiment the choice of a hue tonic is made possible by providing, for a user to view, a set of palettes in potential hue keys from which to make a momentary or permanent hue tonic selection.

Moreover, the significance of hue tonics is that they derive strength from specific music-interval-comprised data that by its nature has a particular "home" position. So to create a "hue tonic" means, with respect to the specific music-interval-comprised data being operated on, to locate a particular hue to be in alignment with that "home" position within a particular set of music interval data. (And in that alignment other hues will serve important functions, such as when comprising a Dom7 type hue chord.) So, as was noted above, in one embodiment the music-interval-comprised data, or sections thereof, can be marked with pre-determined music tonic change events. Further, if a user were to manually change to a new music tonic in the system in real time (such as if the pre-determined music tonic for the section were deemed incorrect), this should immediately re-orient the system, creating an alignment between the new music tonic and the existing hue tonic. The music tonic is often like the music theory-related aspect, of finding the "home" amongst the music intervals, whereas affecting the hue tonic is often done like the singer transposing a piece to fit within their range or purpose or desired quality. But this common approach can also be turned on its head. Nevertheless the MTO and HTO are intrinsically related. In one preferred embodiment the angles causing their alignment are summed together to find the position in the m2h index from which the interval of an incoming musical pitch will be measured. The measurement of this interval will determine the thiv used to color the hue note, and this sum equals the m2hOffVar relative to the default music tonic of the Pitch C (which in non-octave-reduced form is the AMIB. Note that from this position in the preferred embodiment we form an absolute cents index of PPI bins based upon it. In the most preferred system embodiment we will utilize both the octave-reduced and non-octave-reduced values based on absolute cents from the AMIB. The AMIB is also default-aligned with the default hue tonic of Violet, which can act as 'hue cent zero' upon which an absolute-cents-based index of PHI bins may be formed). While changing the music tonic by its nature affects the hue output, doing so must leave unchanged the system's internally defined current HTO (which corresponds with the current hue tonic). And also while changing the hue tonic affects the alignment with musical pitch, doing so must not change the system's internally defined current MTO (which corresponds with the current music tonic).

An m2h index may comprise PPI and PHI bins (independent bins for music intervals and hue intervals). Although shown as a single table, PPI and PHI may be in separate but connected tables. On receipt of an incoming music interval, the MTO and HTO values are summed and the sum is octave-reduced, giving the number of PHI rows to move down from the row position of receipt in PPI. (PPI and PHI are m2hcmb's for measurement of music cents and hue cents respectively).

When an AMIB is implemented, a convention is chosen for it of C−1, & MIDI Note #0, =8.175798916 hz, the Pitch C is chosen as a preferred default music tonic, and the Hue Violet is chosen as the default hue tonic.

To show the relation between the AMIB, m2hOffVar, MTO and HTO to the TMIH and THIC we will use FIG. 28. (These relationships will be further illustrated in FIG. 32).

In FIG. 35 3 items are shown, each of which share a common center. 1) The TMIH, in black, represents the non-octave-reduced musical pitch values and their potential hue voicing aspect, with the AMIB at the very bottom, at C−1 (8.199445678 hertz). 2) The sliced up green pie underneath the TMIH represents the music tonal/key space, which one can think of as being virtually rotatable around the vertical z-axis using the 410 music tonic arrow. 3) The THIC is represented in the drawing by way of showing a top cylinder THCC and a bottom cylinder THCC connected by a pair of lines representing the surface of the cylinder. At 420 is shown a hue tonic handle, in black, with which to vertically rotate the THIC around the vertical z-axis as well. In a default state, with both the MTO and HTO at their −0° default positions, 425 nm Violet, at the hue tonic handle, would line up with the Tonal Center, indicated by the green music tonic arrow, which would be in alignment with the Pitch "C".

In FIG. 28 the −0° position (which in FIG. 26 is at 6-o'clock) is shown slightly off to the right, to add perspective, a ploy that was also used in FIG. 27, that simply allowed the Note values of the TMIH to be easier to represent.

One can visualize using the hue tonic handle, from the state it is in FIG. 28, to rotate the THIC by approximately −338° (or positive 22°) to bring the system into default alignment, so that C aligns with 425 Violet. FIG. 30 and FIG. 31, without any offsets applied, convey this state, where an incoming Pitch C (interval of unison from AMIB) will produce an output of a hue of Violet with a dominant wavelength of 425 nm, and an incoming pitch of C# (interval of minor second) will produce an output of a hue of indigo with a dominant wavelength of 446.7 nm, etc. To keep things simple we will only move the hue tonic handle and music tonic arrow in the positive direction (counter-clockwise). If the hue tonic handle is at default position) (−0° and we move it 30° this means that the pitch C will now produce a hue of indigo with a dominant wavelength of 446.7 nm, C# will produce a hue of medium blue with a dominant wavelength of 468.4 nm etc. (E.g. there is a shift of −30° around the THCC in the alignment between all incoming pitches and all hues. We can consider it HTO−30°) Conversely if the music tonic arrow is at its default position (−0°) we move it 30° (to the pitch B), and this means that the THIC moves 30° as well; because the purpose of changing the music tonic is to cause the new music tonic to align with the existing hue tonic. (So because the THIC and music tonic arrow cancel one another out, the net change is also a shift −30° around the THCC in the alignment between all incoming pitches and all hues; we can consider it MTO −30°) (Of course the purpose of changing the hue tonic is also to cause the new hue tonic to align with the existing music tonic.) Because of this the pitch C now produces a hue of indigo with a dominant wavelength of 446.7 nm (in other words a hue that is −30° further around the THCC). So the MTO and HTO are interrelated, and their sum is the amount of total m2hOffVar. The interval of the incoming pitch above the AMIB is what is being measured, so of course it is what the m2hOffVar, or MTO and HTO are added to find the Hue Angle and derive the thiv (and thus the hue). Below are some examples per use of the 12-Res THCC as shown in FIG. 12, a default hue tonic of Violet, a default music tonic of the Pitch C, and with the Pitch C (C−1) as the AMIB. Step 1 of an algorithm for finding the thiv below is to maintain a current m2hOffVar. (This is described in terms of angle because it is simplest manner for us to describe it. Since there will only be negative angles in the algorithm described below (which is simply based on our Western conventions), these negative angles may of course first all be converted to positive angles to make the below procedure even more simple.) Step 1 is performed upon a change in either the current MTO or the current HTO. This step consists of adding together the values for the MTO and HTO; then subtracting −360 from the sum repeatedly until it is greater than −360 (e.g. in a very high resolution this could be −359.99); the result will be the current m2hOffVar. Step 2 is performed during receipt of music-interval-comprised data, to octave-reduce the pitches in each incoming current pitch set; then for each pitch add the current value of the m2hOffVar, then subtract −360 from this sum until it is greater than −360; this provides a hue angle representing a cent value for that pitch. This is done for each of the current incoming pitches in the incoming current pitch set to maintain the current color of each hue note while the pitches sustain. (Different incoming pitch types require different algorithms for tracking the incoming pitches, detecting when they stop sustaining, tracking vibrato or pitch bend that is occurring for that particular pitch, etc. This is done in accordance with the prior art.)

TABLE-US-00002

| Octave-Reduced Incoming Pitch Angle thiv | MTO | HTO | m2hOffVar | Hue |
|---|---|---|---|---|
| C | (−0) | −0 | −0 | −0 |
| −0 | Violet | | | |
| D | (−60) | −0 | −0 | −0 |
| −60 | Medium Wavelength Blue | | | |
| C# | (−30) | −0 | −120 | −12 |
| −150 | Warm Green | | | |
| C | (−0) | −120 | −60 | −180 |
| −180 | Yellow-Green | | | |
| C | (−0) | −210 | −30 | −240 |
| −240 | Orange | | | |
| C | (−0) | −210 | −210 | −60 |
| −60 | Medium Wavelength Blue | | | |
| Bb | (−300) | −60 | −0 | −60 |
| −30 | Indigo/Low Wavelength Blue | | | |
| D | (−60) | −60 | −60 | −120 |
| −180 | Yellow-Green | | | |
| F# | (−180) | −60 | −330 | −30 |
| −210 | Yellow | | | |
| G | (−210) | −30 | −330 | −0 |
| −210 | Yellow | | | |
| E | (−120) | −90 | −300 | −30 |
| −150 | Warm Green | | | |
| F | (−150) | −30 | −240 | −270 |
| −60 | Medium Wavelength Blue | | | |
| D | (−60) | −150 | −120 | −270 |
| −330 | Magenta | | | |
| Eb | (−90) | −180 | −30 | −210 |
| −300 | Cool Red | | | |
| Ab | (−240) | −120 | −90 | −210 |
| −90 | Cyan | | | |

In one embodiment, m2hOffVar is available as a function along with the functions of MTO and HTO. In this embodiment, changing the m2hOffVar on a pitch-to-hue basis may be done, in case the user forgets or doesn't understand what music tonic and hue tonic is in the system at the time. In this embodiment a user is provided with a hue selection interface; Then, if the user has been playing the Pitch F and seeing Greenish-Yellow, but wants to see a different and somewhat remote hue when playing that pitch—such as Purple-Indigo. The user can store the Pitch F (the pitch to which the user wishes to create the new m2h association), and then touch the position of that desired hue Purple-Indigo hue on that hue selection interface, so that the system will compute the difference between the hue currently corresponding with F, and the desired Purple-Indigo hue. The computed difference will be added to the HTO, and the MTO will remain the same, and the new HTO and MTO will be added together to obtain the new m2hOffVar.

FIG. 31 illustrates an exemplary default table with PPI bins and PHI bins (both of which may have their intervals independently offset from the other as a control method by the system or user via the independent interval offset variables of the MTO and HTO).

FIG. 32 is an exemplary demonstration (in angle form) of the looking up of a music interval in the PPI, then adding the MTO & HTO to the negative central angle to derive the final thiv in the PHI; 700 indicates that this figure also illustrates the use of dual tonic offsets in the look up of a music interval in the m2h index; 701 indicates PPI Bin to the left of 6 o'clock position=default Music Tonic (C), with frequency bottom/top thresholds of our arbitrary music interval bottom (octave-reduced C−1). Negative angles from the center of this bin represent upward music-pitch-intervals. 703 indicates that the PHI bin immediately to the left of 6 o'clock position equals the thiv of the default hue tonic (Violet 425 nm). (Negative angles from the center of this bin represent hue intervals as measured from this default hue tonic); 705 shows a music interval (an octave-reduced 12-ET P5 above the arbitrary music interval bottom) being fed into the m2h index by the music interval feeding process; 710 shows a PPI containing 240 PPI bins; 715 illustrates use of the PPI to locate the position (within the resolution of PPI) for the received octave-reduced 12-ET P5; 720 shows the −210° span/negative central angle resulting from the received music interval of an octave-reduced 12-ET Perfect Fifth (P5) (This will depend on the resolution and the nature of the audio or music protocol file.) 723 represents the current music tonic, The Pitch Class of "B", 0.2 semitones flat (such as for an inexactly tuned band, as is common previous decades); 725 shows a −36° MTO being added to said initial span/negative central angle; 730 shows the Span/negative central angle resulting from the MUSIC TONIC OFFSET (MTO) Variable Value of −36°; 735 shows a −24° HTO being added to the span/negative central angle computed at '730'; 737 shows the current hue tonic position, −60°=result of MTO (−36°) +HTO (−24°). The corollary to this is that subtracting the MTO from the hue tonic gives the HTO and subtracting the HTO from the hue tonic gives the MTO. In one embodiment, the total offset is always available, not just to the system, but also to the user, along with the two Offset variable values. If a user is unsure of the music tonic and fixes it, then later decides to re-create a pleasing color set based on the prior conditions, he can enter the stored prior hue tonic directly; 740 illustrates the span/negative central angle resulting from a Hue Tonic Offset (HTO) Variable Value of −24°; 745 shows that the final span/negative central angle being looked up (sum of −24°, −36° and −210°) finds a thiv in PHI (−270°); and 750 illustrates a Prime Hue Interval index (aka PHI) containing 240 PHI bins.

Figure 33:
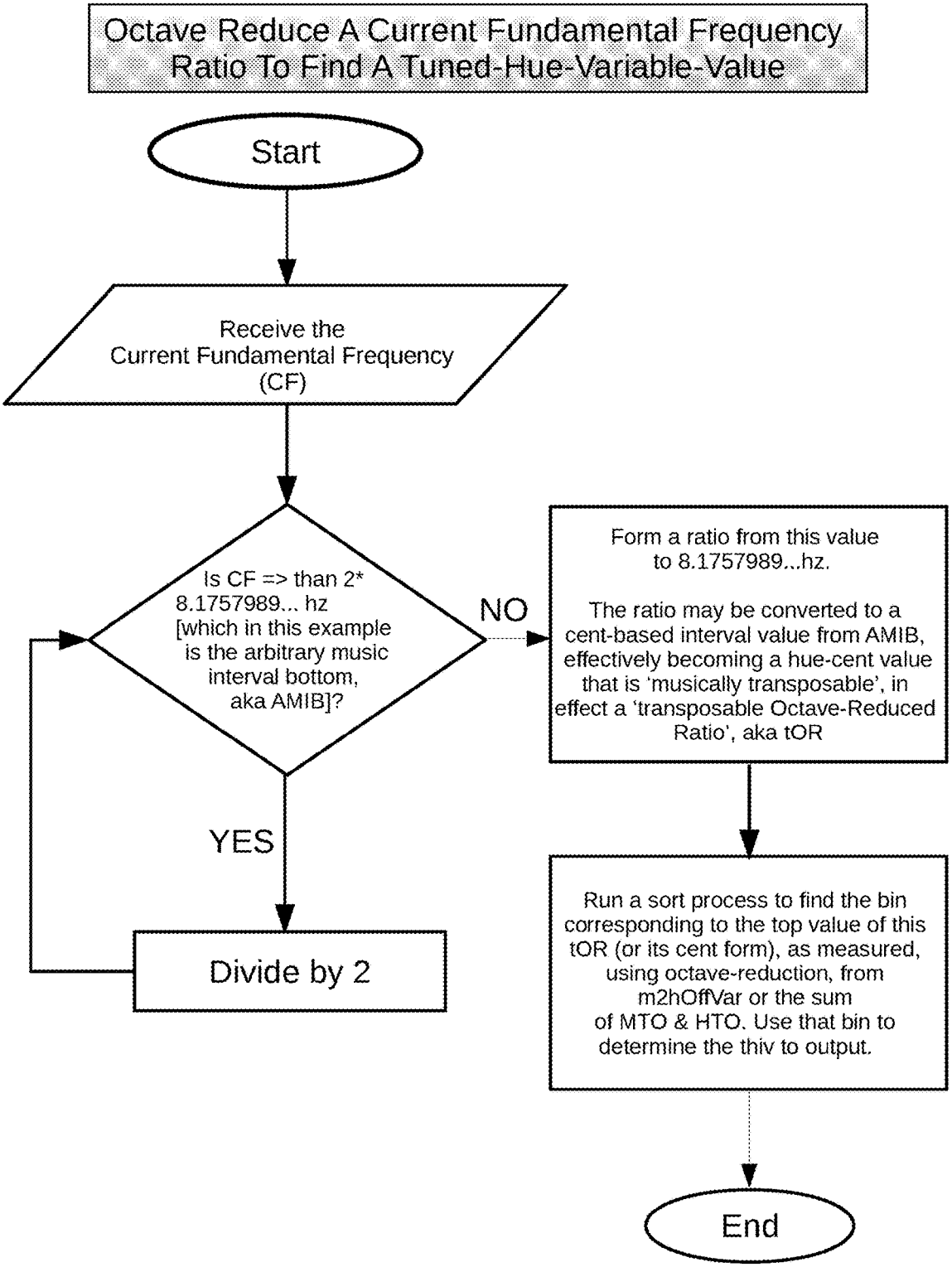
FIG. 33 is a block diagram of an exemplary method of a tuned hue variable value using octave-reduction.

FIG. 33 is an exemplary illustration of using octave-reduction.

FIG. 34 is an exemplary illustration of using pitch bend and other pitch modifiers, as is useful when using music protocol data. At step 450 receive MIDI Pitch Value. At step 460 receive any Current Pitch Modifier-Related Values. At step 470 sum any Pitch Modifiers with the received MIDI Pitch Value, to yield Current Fundamental Frequency (CF). A determination as to whether CF=>than 2*8.1757989 . . . hz [which in this example is the arbitrary music interval bottom, aka AMIB] (decision 480) If CF=>than 2*8.1757989 . . . hz then decision 480 branches to the 'YES' branch to step 490 where CF is divided by 2 which loops back to step 480. This looping continues until CF<2*8.1757989 . . . hz, at which point decision 480 branches to the 'no' branch exiting the loop to step 500 to form a ratio from this value to 8.1757989 . . . hz [e.g., 12.249857374: 8.1757989] (This yields the transposable octave reduced ratio (tOR) between the octave-reduced CF and the AMIB). At step 510, A sort process is run to find the bin corresponding to the top value of this.) Run a sort process to find the bin corresponding to the top value of this ratio, as measured, from the current octave-reduced m2hOffVar, or as measured, from the octave-reduced sum of MTO & HTO. Use that bin to determine the tuned hue variable value (thiv) to output.

FIG. 35 shows an advanced flow of the present invention. In 550 Music-Event-Data is fed into the system in channels and tracks. In 560 these are time-stamped and parsed, per input sources such as per channel and per track, into classes, types, and subtypes. Any music intervals found in the Music-Event-Data are parsed as relative to the AMIB, and then octave reduced, and the octave value appended (which equals 1+the number of times the Current Frequency in FIG. 33 must be divided by 2 to yield a value that is less than 2*). As an octave range in this example we are using 240 bins representing 5 musical cents each, and we are appending a value indicating the total number of octaves that this music-pitch-interval contains, for future use (equivalent to designation of a MIDI Note # as pitch+octave (e.g. C2, G5, F#7, etc.). Both octave-reduced and non-octave-reduced intervals from the arbitrary music interval bottom are useful, so it is ideal to store interval data in a format from which both octave-reduced and non-octave-reduced intervals are immediately obtainable. In 570 the octave-reduced value is located in PPI; in 580 the MTO is obtained from 590, in 600 the HTO is obtained from 610; and in 620 the PPI interval 630, MTO and HTO are all summed, yielding the thiv/s. In 640, optionally hue notes (comprised of their thiv's) are assigned onto color object arrays per any automatically determined classes, types, & sub-types; which automatically assign/re-assign channels/tracks/layers; Or alternatively the system may use user determined array assignment, per channels/tracks/layers, & map hue notes onto color objects on color object arrays using the chosen methods of mapping, as per channel/track/layer mapping methods (as saved in channel/track/layer mapping indexes, shown in 650, 660, and 670).

Pitch Detection and Chord Root Detection and Beat Detection of the Prior Art

There are instances when the present invention benefits from pitch detection and chord root detection. (See, e.g. FIG. 20 and FIG. 21, note that detecting the root of a chord might be taken as being synonymous with detecting the chord, since the other pitches of the chord are thereby generally defined in terms of music theory function). While the prior art has numerous Pitch Detection and Chord Root Detection methods and algorithms, we wish to note that the functions of pitch detection and chord root detection are most effectively accomplished in combination with a Beat Detection algorithm. Some Details About Color Object Arrays, Note Bucketing And Clip Bucketing Color object arrays are made up of some polyphony of array elements. A helpful method of determining distribution of the hue notes of musical chords and melodies into such array elements (that may have very limited polyphony in some cases) is to use triggering methods. These can be used in real time, as is the case of "trigger mode" within Spectrasonics' Omnisphere. Ableton Live refers to a related method that we will call 'clip launching'. In the case of 'trigger mode' in Omnisphere, this is used in real time and affects notes being played into the MIDI stream. It depends on the internal clock pulse (MTC in this case), which continuously defines tempo and temporal beat locations. To use 'trigger mode' a user sets a 'triggering pulse', such as 8th note, quarter note, or bar. Say that a user selects a selected pulse, such as one 8th note. Between pulses the notes are "bucketed"; they are then sounded when the 'triggering pulse' (for e.g. 8th note) is reached (thus the next 8th note becomes the 'activating pulse'). This allows non-musicians and keyboard players to more easily create music, by freeing them from the concern of being "off the beat". This use of Omnisphere trigger mode also permits the present invention to wait and 'finalize' the distribution of the hue notes of hue chords on the 'activating pulse'. This means that non-keyboard players could use a keyboard and trigger very rhythmically precise lighting performances, but also it means that voice leading can be better transferred to the color object arrays (see below). Similarly, use of the method exemplified in Ableton Live's clip launching will also help the present invention to obtain with rhythmically precision. But in this case, it would be to cue the triggering of pre-existing clips of lighting material. At the 'activating pulse' these would then be triggered (aka "launched", as a "clip"). In either case the 'triggering pulse' setting is present, even though it may be "off" or "on". IF it is "off", the clip will be triggered immediately. If it is "on" the clip will be triggered at the next pulse occurrence. (Clips would contain hue note events, or "continuous controller" messages, and the clips would play these events when triggered). (The 'triggering pulse' for either 'trigger mode' or 'clip launching' could be anything useful, including 16th, 8th, quarter note, half note, and whole notes, etc. In the case of 'clip launching' the 'triggering pulse' could also be, two-whole notes, four whole notes, 8 whole notes etc. Clip launching is a bit like launching "Lighting Chase Sequences" that subsequently follow MTC (which can be adjusted in real time by knob or by performing repetitive hits on a MIDI instrument); but when combined with the method known in Omnisphere as 'trigger mode', it will permit emotive performances by lighting performers whose rhythmic capabilities are limited.

Regarding color object arrays, bucketing the live-performed notes until the 'triggering pulse' is reached, as in trigger mode, or clip launching (of a "lighting material clip") is most helpful. It is not just a way for rhythm-challenged lighting performers to obtain more rhythmic precision. It also provides a means for more predictable distribution of hue note melodies and chords onto array elements. For example imagine that a lighting performance is being triggered on a MIDI keyboard. Since keyboardists often play chords in slightly broken tempos, if distributed in near-real-time, the temporal ordering of the chord notes performed will often differ completely from their ordering in pitch height, and if a color object array has far less available color objects than the number of musical notes in the composition (its complete multi-octave range), to follow the keyboardist's ordering requires complicated and imperfect methods to help distribute the hue notes so pitch height of the music notes does correspond to the position of hue notes on the color objects. The 'activating pulse' provides a good rhythmic time when the ordering of chord notes according to pitch height can occur (benefiting from good voice leading of existing music compositions is aided by maintaining significant correspondence between pitch height of the compositions and 'hue note display location' on the color objects). The selection of shorter 'triggering pulse' settings can be made as the performer's rhythmic precision becomes greater.

In one embodiment of the present invention, just prior to the 'activating pulse', the "bucketed" hue notes are 'finalized' into pitch order up to the polyphony of available array elements of a chosen array (pitches exceeding the polyphony of available array elements may simply be 'overflowed'), the number of remaining pitches is divided by the number of available array elements. If there is a remainder percentage this is divided in half and approximately this portion of color objects is used as a buffer at the front and end of the color object array. In this very rough method the hue notes are kept in pitch order and are distributed into successive array positions roughly in the middle of the series of array elements. This does avoid the case of hue chords 'seeming to clump' on one side or the other of the color object array. In one embodiment a more sophisticated, 'proportion-based' method of distributing bucketed notes is used, of 1) obtaining bucketed notes within the pre-established pitch range and polyphony limit, and 2) determining the proportional pitch height within that pre-established pitch range for every pitch in the bucket. Then, when the next occurrence of the selected pulse occurs the hue notes are distributed on the color object array so as to approximate that music pitch proportionality (rounding up or down to whole numbers [whole numbers represent the array elements] as necessary). The intent of this method is to more closely approximate the music's voice leading. (Voice leading in this particular context does not actually refer to "voices" as separated by channel or track. Rather it refers to apparent voices. Transitioning, successive notes in a chord can be presumed likely to form apparent "musical lines" to a listener, from one note to another, when the successive notes are relatively closer in pitch to one-another than to other successive notes transitioning at approximately the same beat. In the prior art, the closer a pair of successive notes is, the more weight it is given in a "voice-leading weighing function". In this embodiment of the present invention a visual correspondence to this "apparent voice leading" is achieved by distributing hue notes in a similar proportionality to their distribution vertically on a music staff (very compact forms of this method can be used in which only a hint of the proportionality still exists, but it is nonetheless often helpful for the visual correspondence.)

In another embodiment of the present invention the prior art's method of "latching" notes is used to latch hue notes (as in Omnisphere "latch mode").

Figure 36:
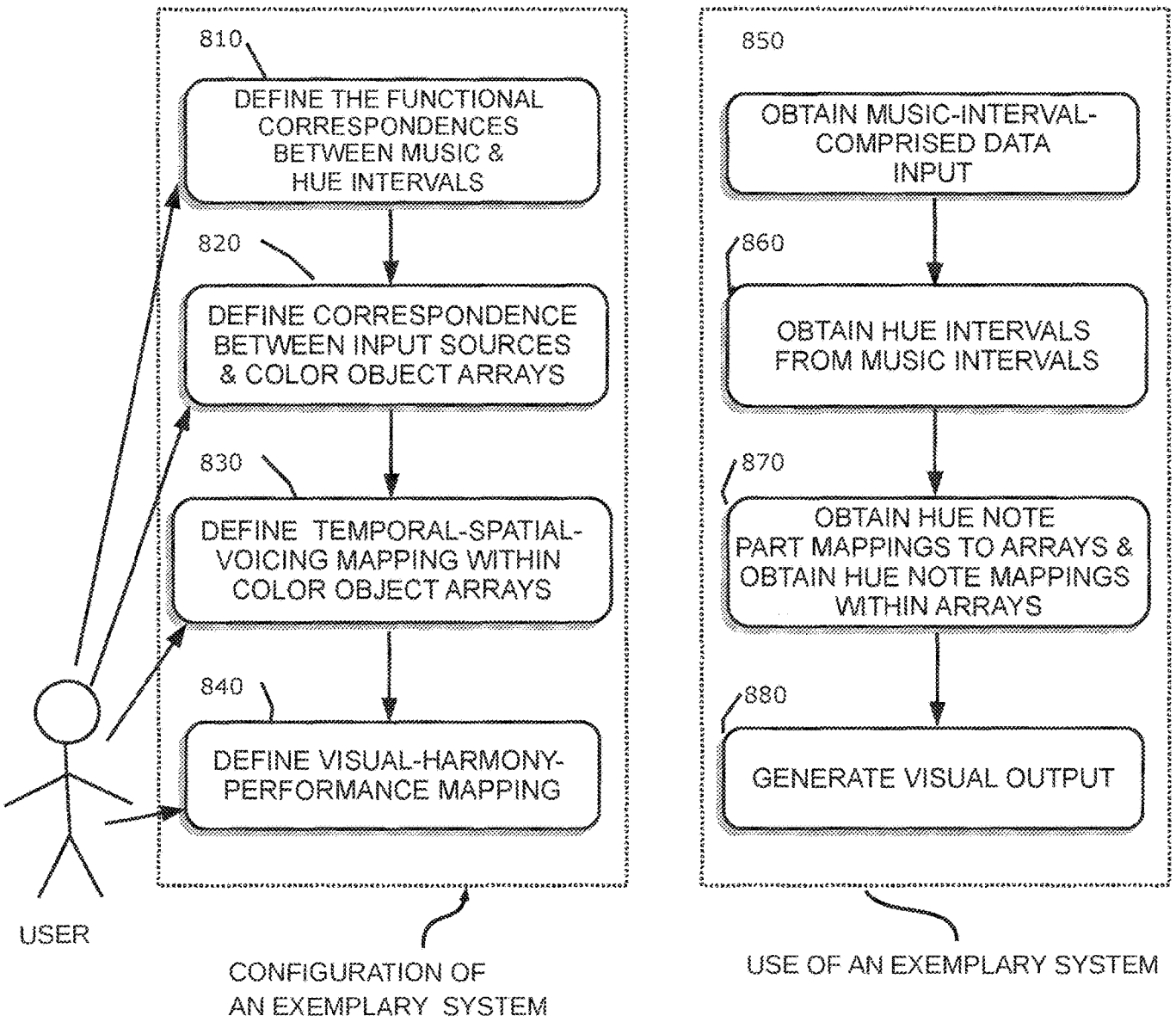
FIG. 36 is a block diagram illustrating the configuration and use of an exemplary embodiment of the invention.

FIG. 36 illustrates the configuration and use of an exemplary system.

To configure the exemplary system, in step 810 are defined the functional correspondences between music and hue intervals (typically with hues based on the incoming octave-reduced intervals). In step 820 is defined the correspondences between input sources and color object arrays, which will typically define a filtering of the incoming non-octave-reduced intervals (as per track, channel, pitch filter, etc.), thus defining what will be received by the separate color object arrays (aka "visual voicing arrays". In step 830 is determined the temporal-spatial-voicing mapping, meaning the mapping of the incoming non-octave-reduced intervals within their "visual voice arrays" (as determined from step 820), e.g. to map hue notes to the array elements relative to actual melodic interval if comprising a solo or melody, current chord member pitch height position if comprising chords, or position within the bar or beat grouping, etc. such as if comprising percussive notes. In step 840 is defined the visual-harmony performance mapping, which can call up preset variations of steps 810, 810, and 810. In systems with virtually modifiable color objects and color object arrays, step 840 can involve modulating the position and rate of flow of the virtually modifiable color objects (e.g. onscreen) and virtually modifiable color object arrays (e.g. onscreen). For use of the exemplary system, in 850 music-interval-comprised-data is obtained. In 860 music intervals are obtained from said music-interval-comprised data, and hue intervals are obtained from them. In 870 based on track, channel, pitch filter, etc., the system obtains 'hue note part' (i.e. chord, solo, bass, etc.) mappings to arrays, and based on non-octave-reduced interval relationships (depending on mapping methods being employed on that array) obtains the hue note mapping within each array. I.e. in step 870 is obtained the current mapping logic for the music-harmony-relationship events (this mapping logic directs the hue notes [based on non-octave-reduced musical intervals] to their determined color object arrays, and then directs the individual hue notes onto the color objects within those arrays). And in step 880 visual output is generated.

Bass Emphasis

In describing the thiNC interface above it was mentioned that in our research we have found that larger hue notes tend to impose some imprecisely known influence on other hue notes in the present hue harmony that acts similarly to the influence that musical notes with pitches lower in the bass impose on other notes in the momentary musical harmony (perhaps because larger hue notes occupy more space in the visual field, similar to the way bass frequencies spread out more in space in the audio field). When music composers do their work, they are aware of this influence. In one embodiment of the present invention relatively lower pitches are placed on relatively larger color objects. Music composers are also aware of the way that rhythm and harmony interrelate such that the roots of chords are often played in the bass register on the downbeat. For this reason, in one embodiment of the present invention the chords of a music file can be "mined" for their chord roots, and these chord roots can be displayed on a color object array comprised of relatively larger color objects.

Figure 37:
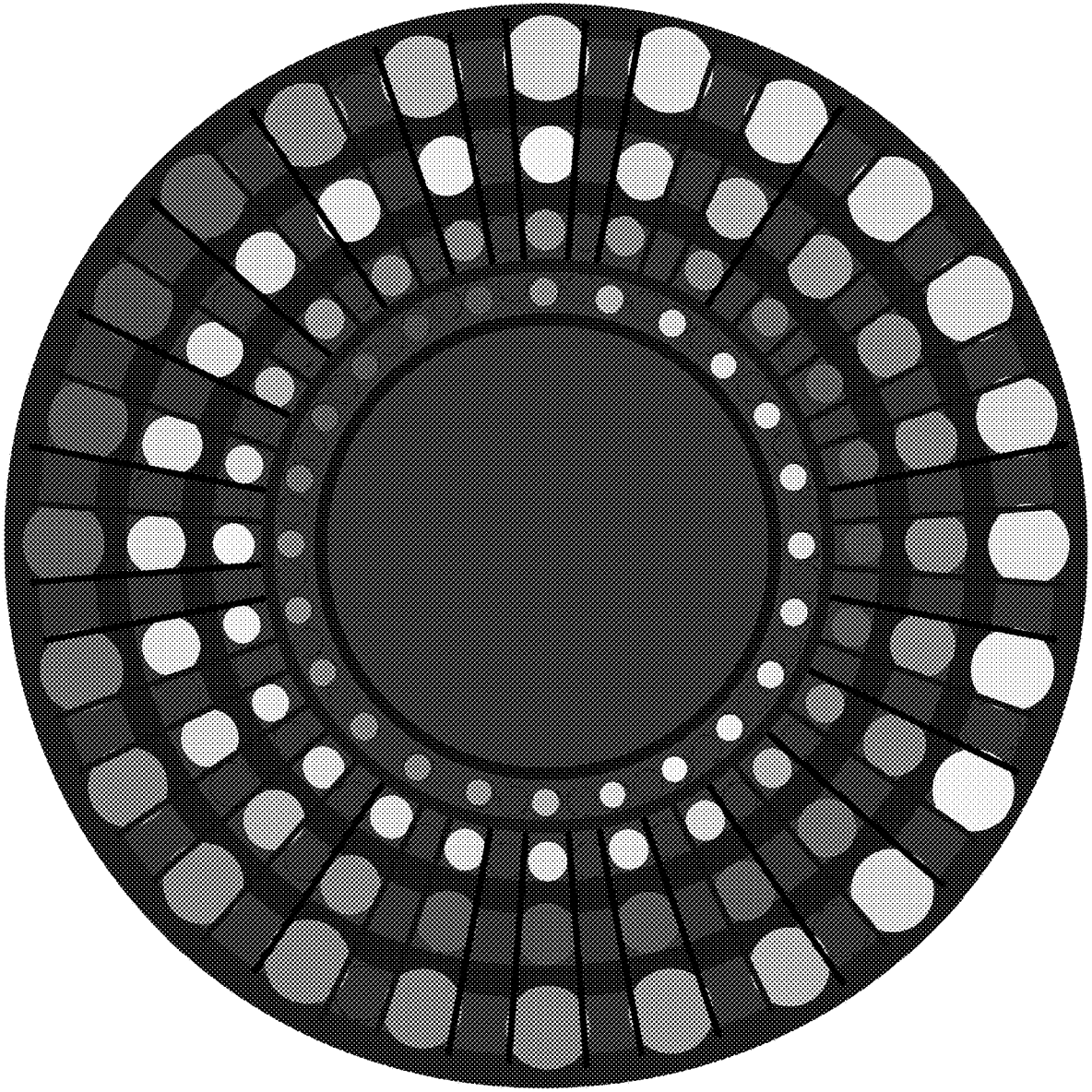
FIG. 37 illustrates 'bass emphasis' on the thiNC Interface.

FIG. 37 illustrates 'bass emphasis' on the thiNC Interface. In this example the resolution of the concentric THCC's is reduced to 24 to allow greater increase in hue note size from the inner to the outer THCC rings, which in the present invention can correlate with greater difference of pitch between the available THCC "voices".

Figure 38:
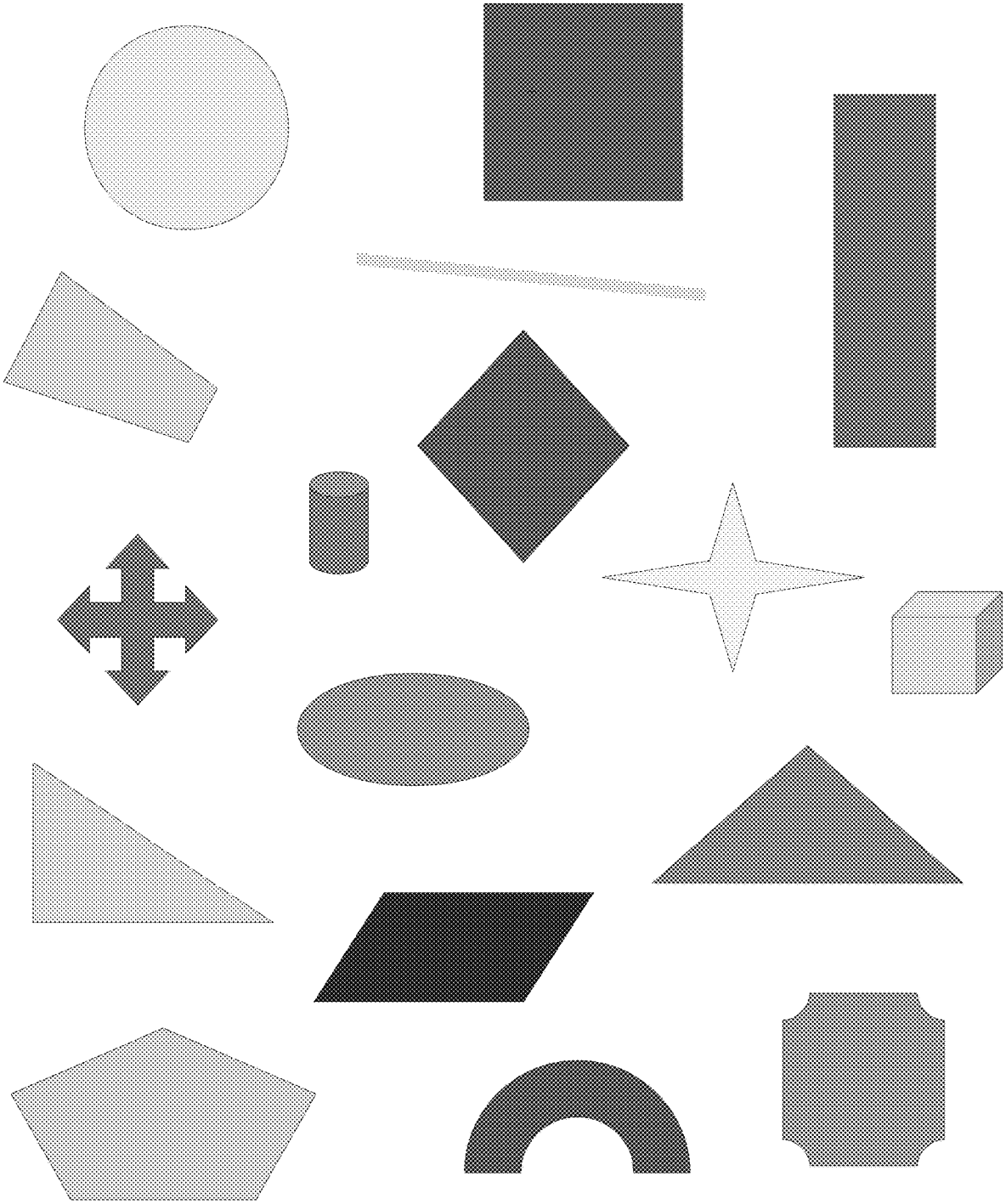
FIG. 38 shows examples of miscellaneous random color objects in random positions.

FIG. 38 shows examples of miscellaneous random color objects in random positions.

Figure 39:
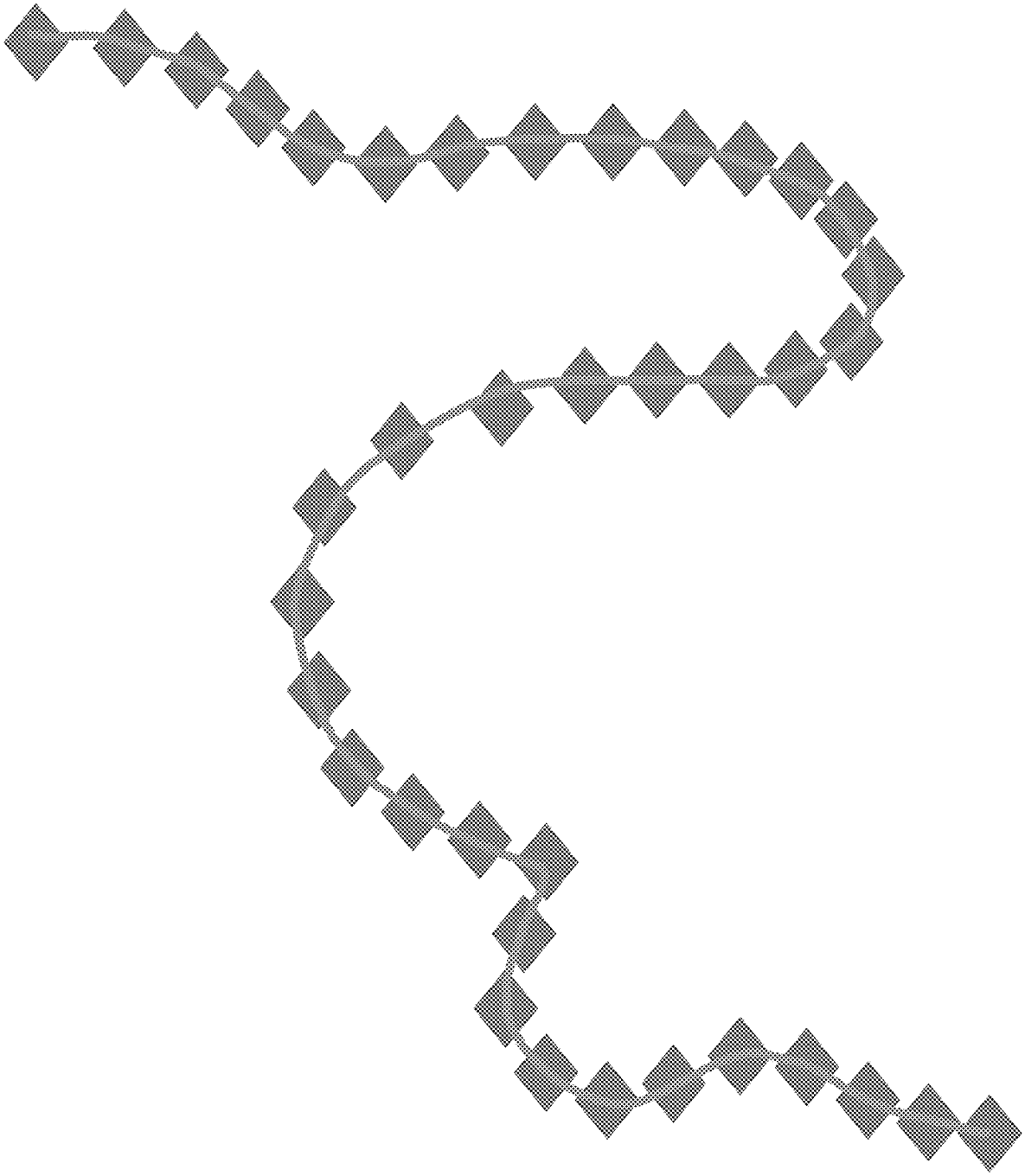
FIG. 39 illustrates color objects along a path.

FIG. 39 illustrates color objects along a path.

Figure 40:
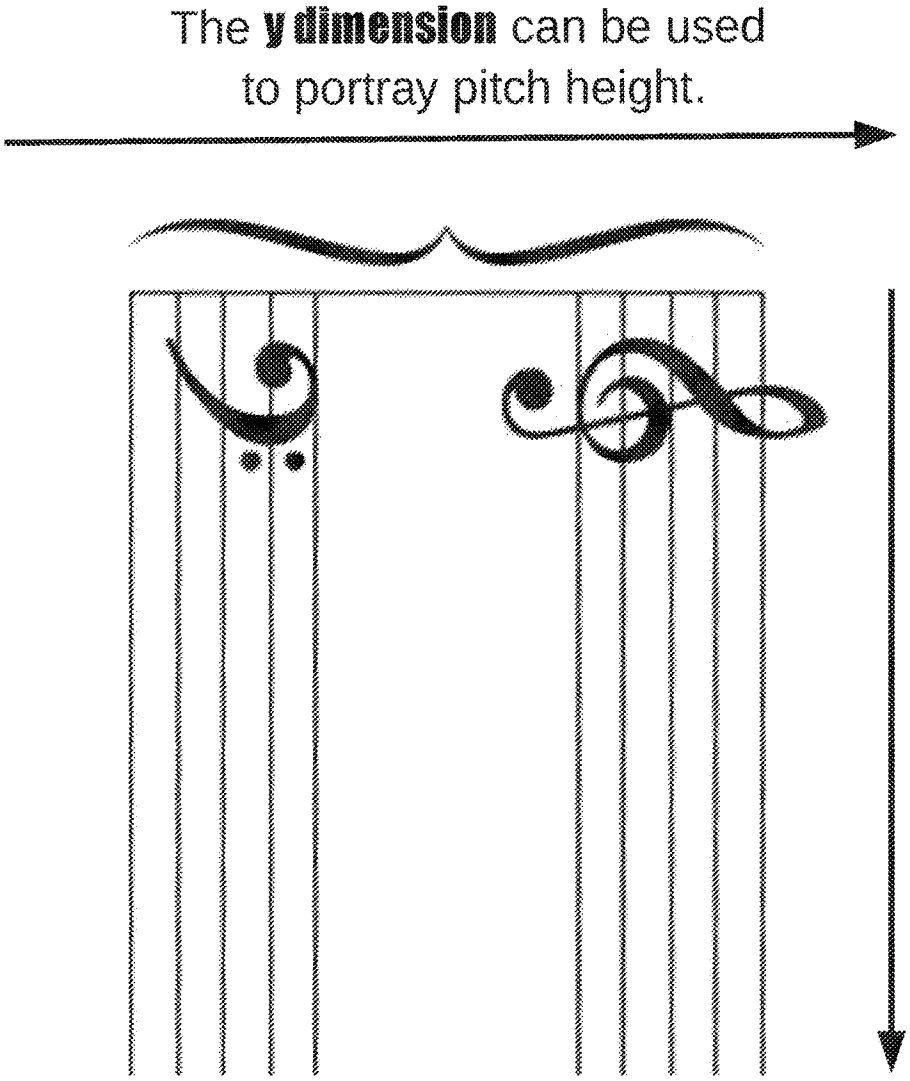
FIG. 40 illustrates 'sheet music voicing', according to the invention, with hue notes shown along a path in a fixed (non-animated) image.

FIG. 40 illustrates basic use of dimensions, by the method, to portray time and pitch in fixed (non-animated) images.

Figure 41:
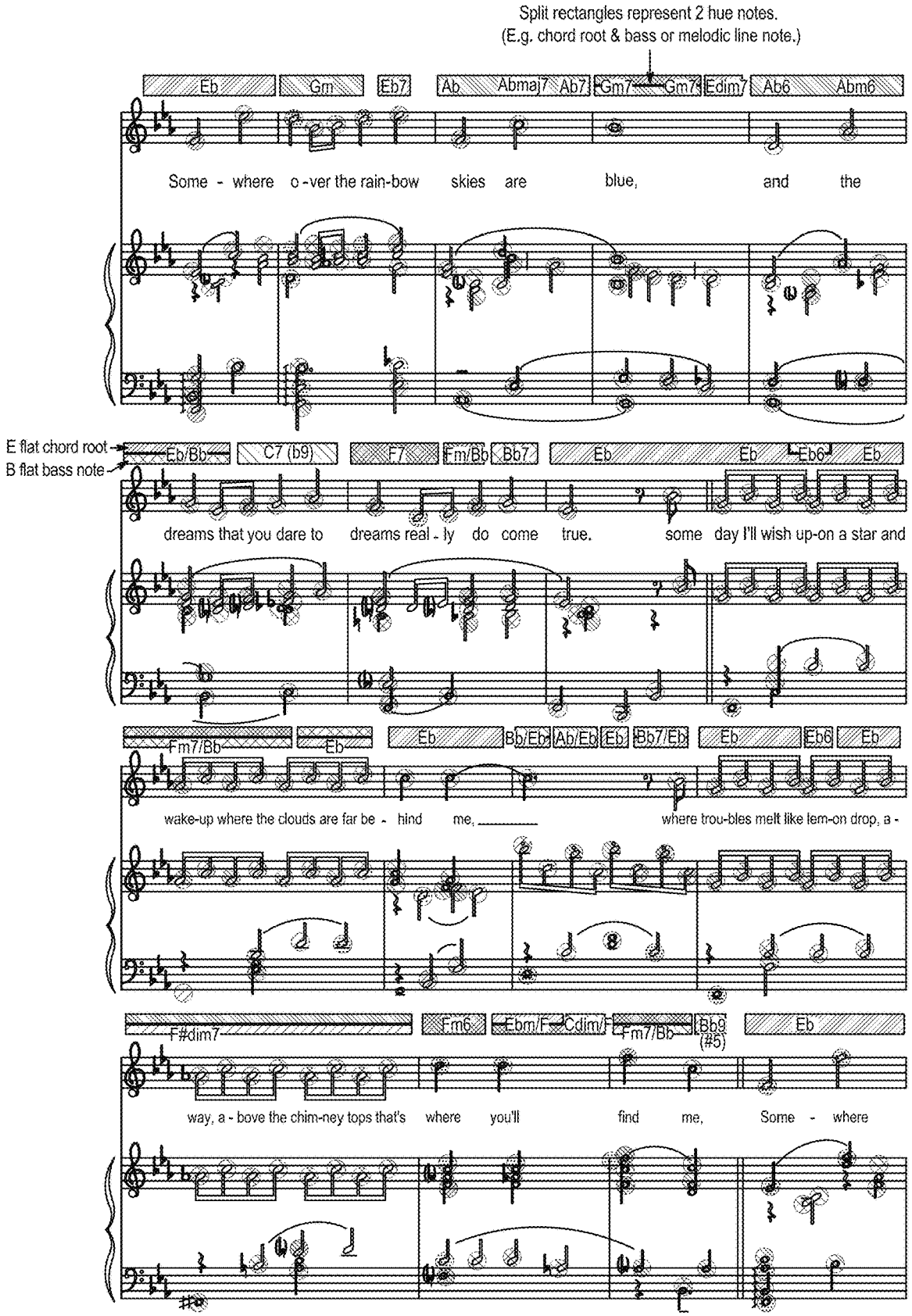
FIG. 41 illustrates basic use of dimensions to portray time and pitch.

FIG. 41 illustrates 'sheet music voicing', with hue notes shown along a path in a fixed (non-animated) image. The dimension of time flows from left to right, along each grand staff, while the dimension of pitch is vertical (in repeating swaths in a range from below to above each successive grand staff).

Figure 42:
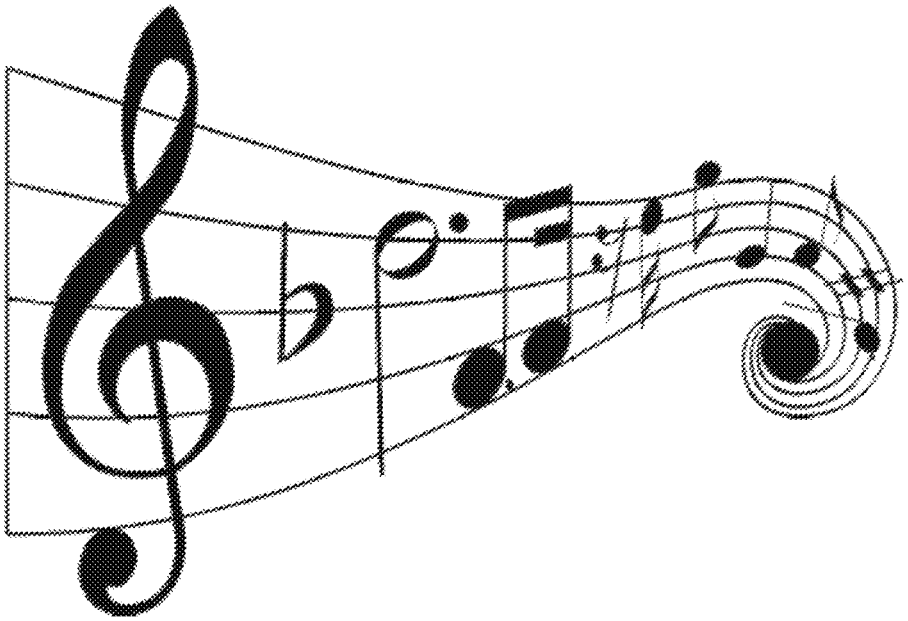
FIG. 42 illustrates that time and pitch dimensions, as shown in FIG. 41, may be modified in viewer-predictable ways without removing the effects of musical correspondence.
Figure 47:
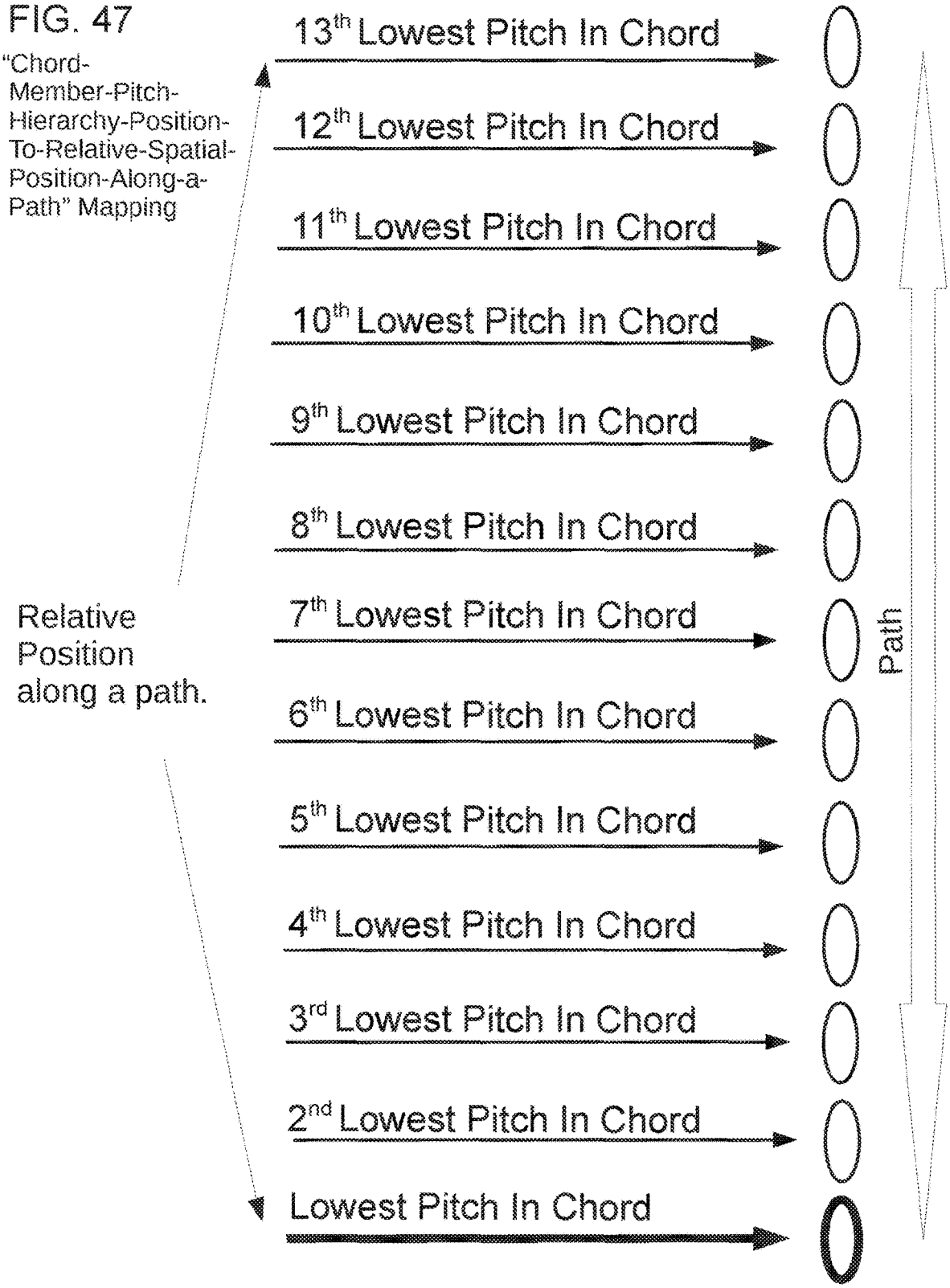
FIG. 47 illustrates a method of mapping from a musical chord tone member pitch hierarchy position to spatial position along a path.

FIG. 42 illustrates that time and pitch dimensions, as were exemplified in FIG. 47, may be modified in viewer-predictable manners without removing the effect of musical correspondence.

FIG. 43 provides an exemplary illustration of network use. The client pc processor 900 is connected by bus to the client pc Read Only Memory (ROM) 905; 910 shows the client pc RAM; a hard drive 915 and a DVD ROM 920 are connected to the client pc i/o adapter 925; The client pc network adapter 930 is connected to the server machine 1020, via a LAN 935; a number of additional clients are shown at 1025, individually shown at 1030, 1035, 1040, 1045, 1050 and 1055. A standard set of mouse/pc/USB adapters 940 connect a mouse 945 and pc keyboard 950; at 955 is shown a color output device adapter (#1) (being the pc display adapter). From the pc display adapter 955 a display adapter cable 960 connects a display device 965. A color output device adapter (#2) 970, being a DMX adapter, is shown connected by a DMX cable 975 to a bank of DMX-controlled RGB LED lights 980, comprised of 3 color object array paths (arbitrarily colored purple, green, and blue here). The speaker output of an audio interface 985 connects to a speaker 990 via a speaker output cable, while an electric guitar 995 and microphone 1000 connect to the input of the audio interface 985 to provide data for pitch detection by a pitch detection processor software module; A MIDI keyboard 1010 is interconnected to a MIDI interface 1015 to provide music protocol data (in the form of MIDI). The USB adapter at 940 can also receive OSC (open sound control) data, and some MIDI instruments provide MIDI-via-USB drivers that allow for MIDI interfacing via the USB adapter at 940 as well. An example of use of the method over a network is the case of an interactive multiplayer online game in which control is obtained, via game play, over virtual club audio, Veejay fx, and lighting, such as for a set of virtual club rooms, via designated user MIDI keyboard, guitar and microphone input, using music interval constructs licensed to the game for modification of generated audio as well as visuals. In such a game, of those involved with a given virtual club room, only a single user would have access to changing the hue tonic at a time; and only a single user would have access to changing the music tonic at a time. However multiple users could provide or generate interval data simultaneously.

Voice Leading—Translation of Relative Interval Position to Relative Spatial Position We mentioned that rapid note changes, such as those that occur in a melody, might overwhelm the human visual sense if they were displayed as successive hue notes at the same location. This is why in one method of the present invention hue melodies are displayed so as to move along "paths". Also in the section regarding the thiNC interface it was said that in music, when transitions occur on consecutive beat pulses between nearby pitches (usually 1-4 semitones with smaller spans being smoother) the music is described as having 'smooth voice leading', apparently because these closely-spaced pitch transitions are easy for the listener to follow. In the present method 'smooth hue note voice leading' is achieved when the location of the consecutive-pulse-&-nearby-in-pitch intervals is on hue notes that are in similar relative 'spatial distance' positions to their loosely-approximate relative 'interval distance' (or, less often, 'pitch distance') positions. In one method of the present invention approximate translation is made from the proximity between the music intervals obtained by the music-interval-comprised-data receiving device and the proximity of color objects as distributed in the color object array.

Next are described some methods of mapping to color object arrays in order to effectively "visually voice" the color sets (of hue intervals) as hue notes on "color objects", using color object paths and dimensions. These methods involve obtaining music-interval-relationship data such as 'melodic interval proximity', 'pitch height', 'chord tone member pitch hierarchy position' (the relative pitch height of chord tones), two-octave-reduced chord tone height above the chord root (this is a root position form of the chord), and 'music note event's musical rhythmic interval position' (so as to map events so that relative nearness in time is mapped to relative nearness in space). This information is obtained from the received music interval data, it is used by the music-harmony-to-color-harmony software module for mapping onto the color object arrays per some selected and defined mapping method (aka "output procedure" method) such as those described below.

Figure 44:
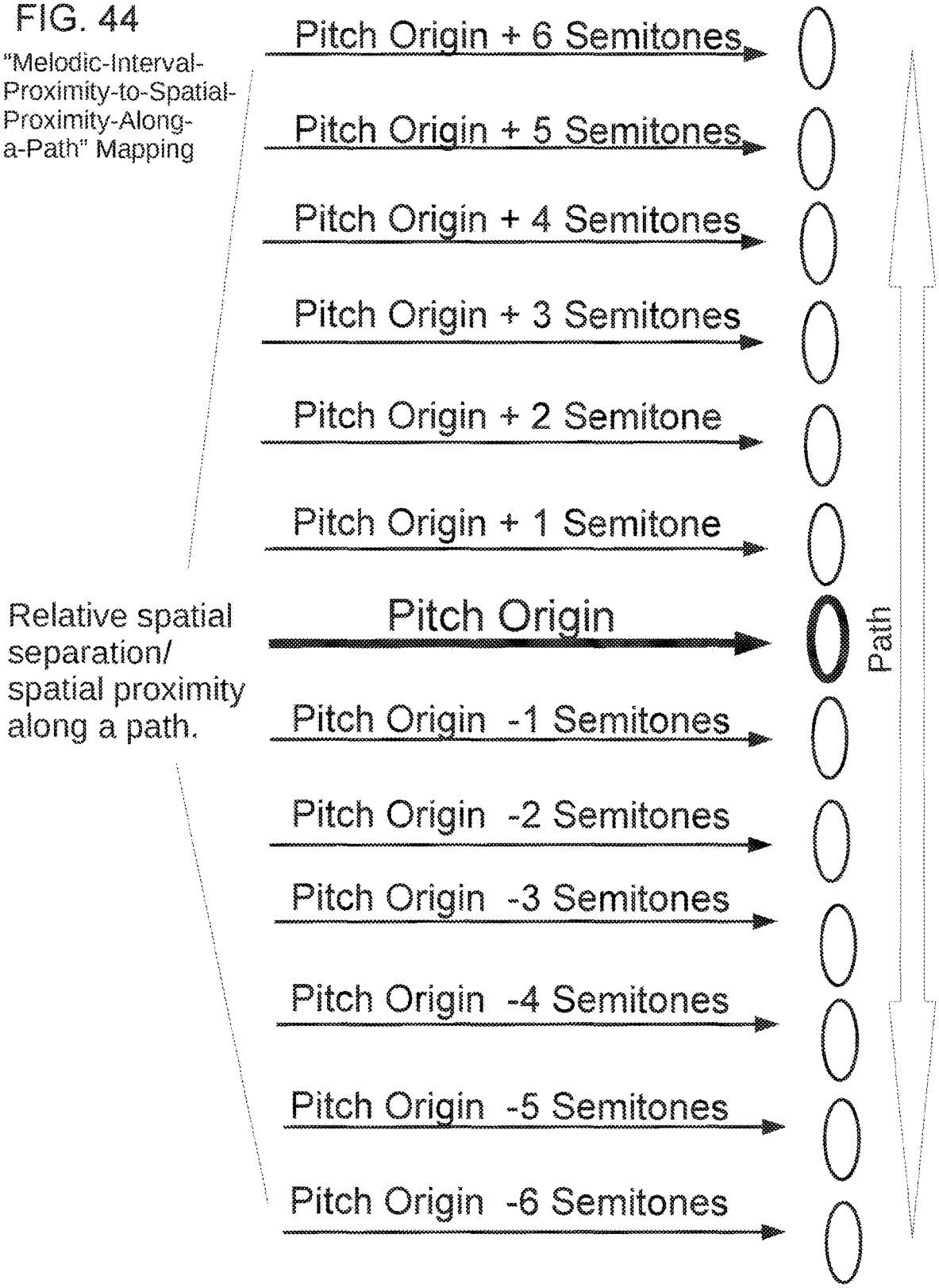
FIG. 44 illustrates a method of mapping 'melodic interval proximity' in music to color object 'spatial proximity' along a path.

FIG. 44 illustrates the method of mapping 'melodic interval proximity' in music to color object 'spatial proximity along a path'.

In one embodiment of the present invention relatively lower pitches generate relatively larger color objects.

Figure 45:
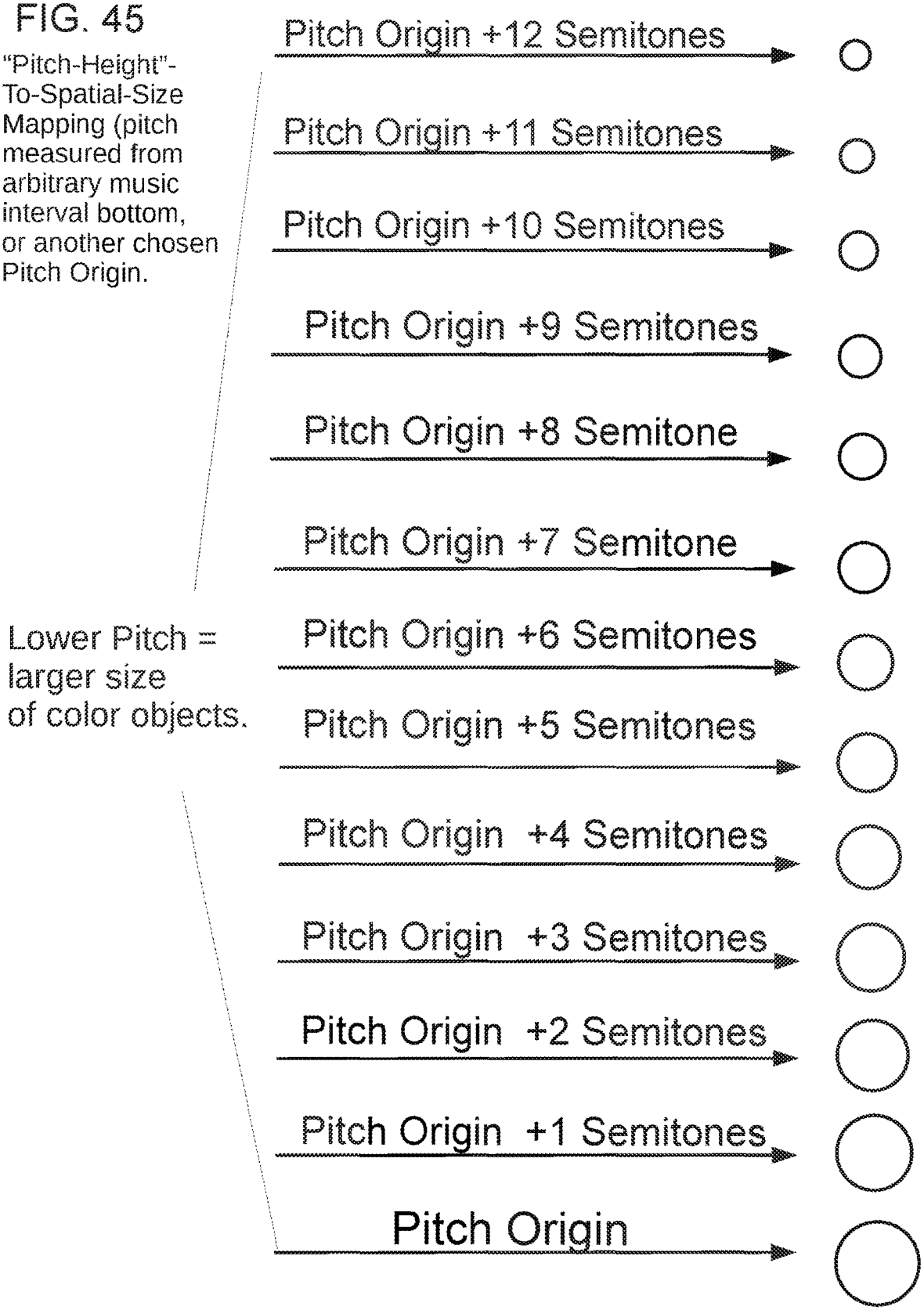
FIG. 45 illustrates a method of mapping music 'pitch height' (measured from AMIB or another chosen pitch height origin) to spatial size.

FIG. 45 illustrates mapping music 'pitch height' (measured from AMIB or another chosen pitch height origin) to spatial size. In one embodiment of the present invention spatial size of the hue notes is influenced by the attribute of pitch height of the received music intervals. For e.g. the color objects can be sprites whose size is generated, or arrays of lights whose size is pre-existing. In the former case the color object size can be adjusted for a particular hue note based upon its source music note pitch height. In the latter case the determination of which color object the hue note is displayed upon is what is influenced.

Figure 46:
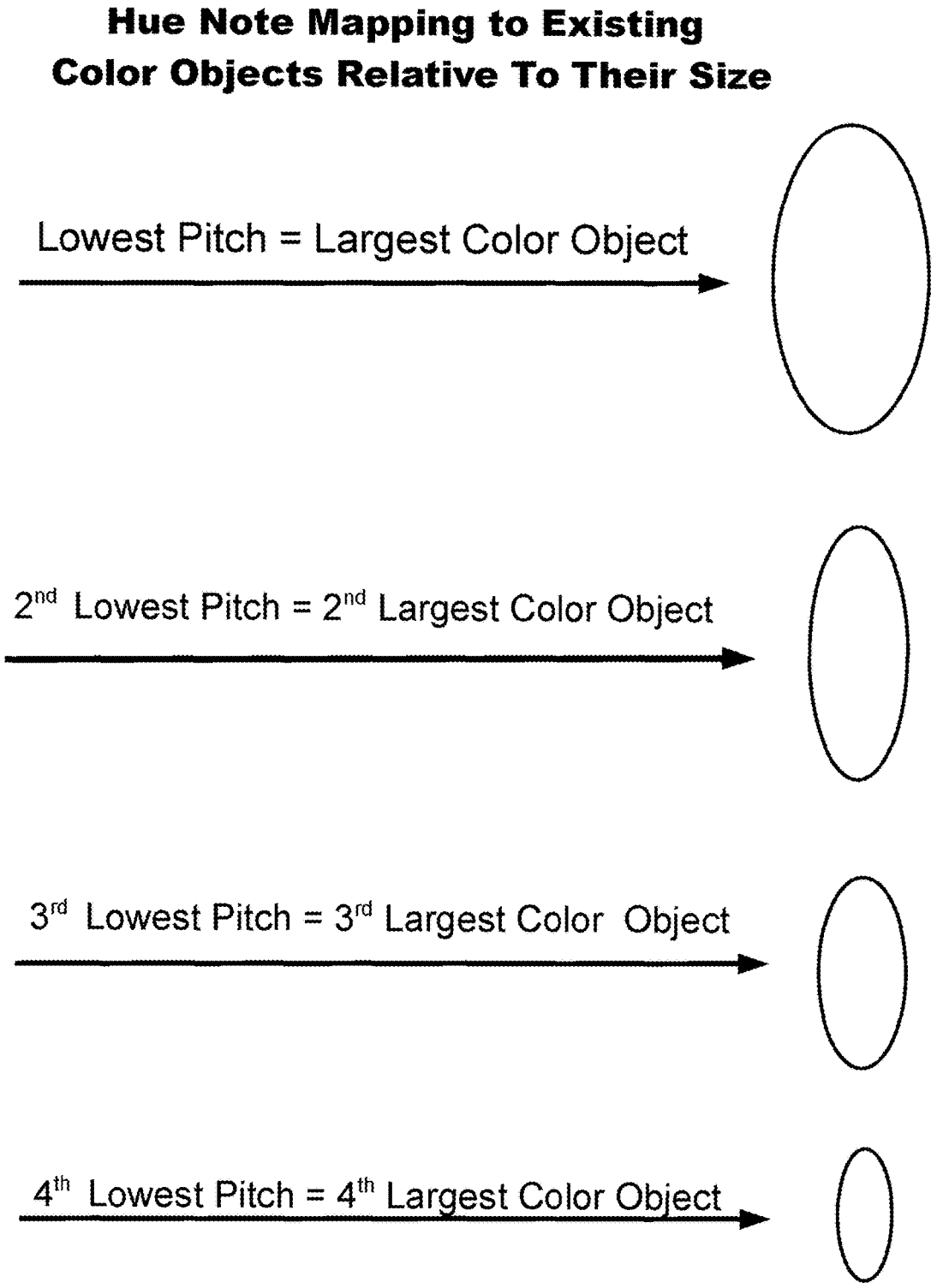
FIG. 46 illustrates a method of mapping hue notes to existing color objects relative to their size.

FIG. 46 illustrates hue note mapping to existing color objects relative to their size property. In one embodiment of the present invention spatial extant of pre-existing color objects is used to determine which hue note is displayed on them, with hue notes from music notes of higher pitch height being determined to display on color objects of smaller spatial extant, and vice versa.

FIG. 47 illustrates mapping from musical chord tone member pitch hierarchy position to spatial position along a path. In one embodiment of the present invention spatial position along a path of a color object array is determined by musical chord tone member pitch hierarchy position. (If there are a greater number of color objects than the number of chord tones in the chord, other algorithms can be chosen from to determine which portion of the color object path the hue notes are mapped to—for e.g. hue notes could be aligned to one end of the path, centered, or distributed with spacing. The important thing is that the hue note sequence follows to music note sequence—which captures the voice leading, and aids in pleasing predictability if visualizing the source music intervals as audible music.

Figure 48:
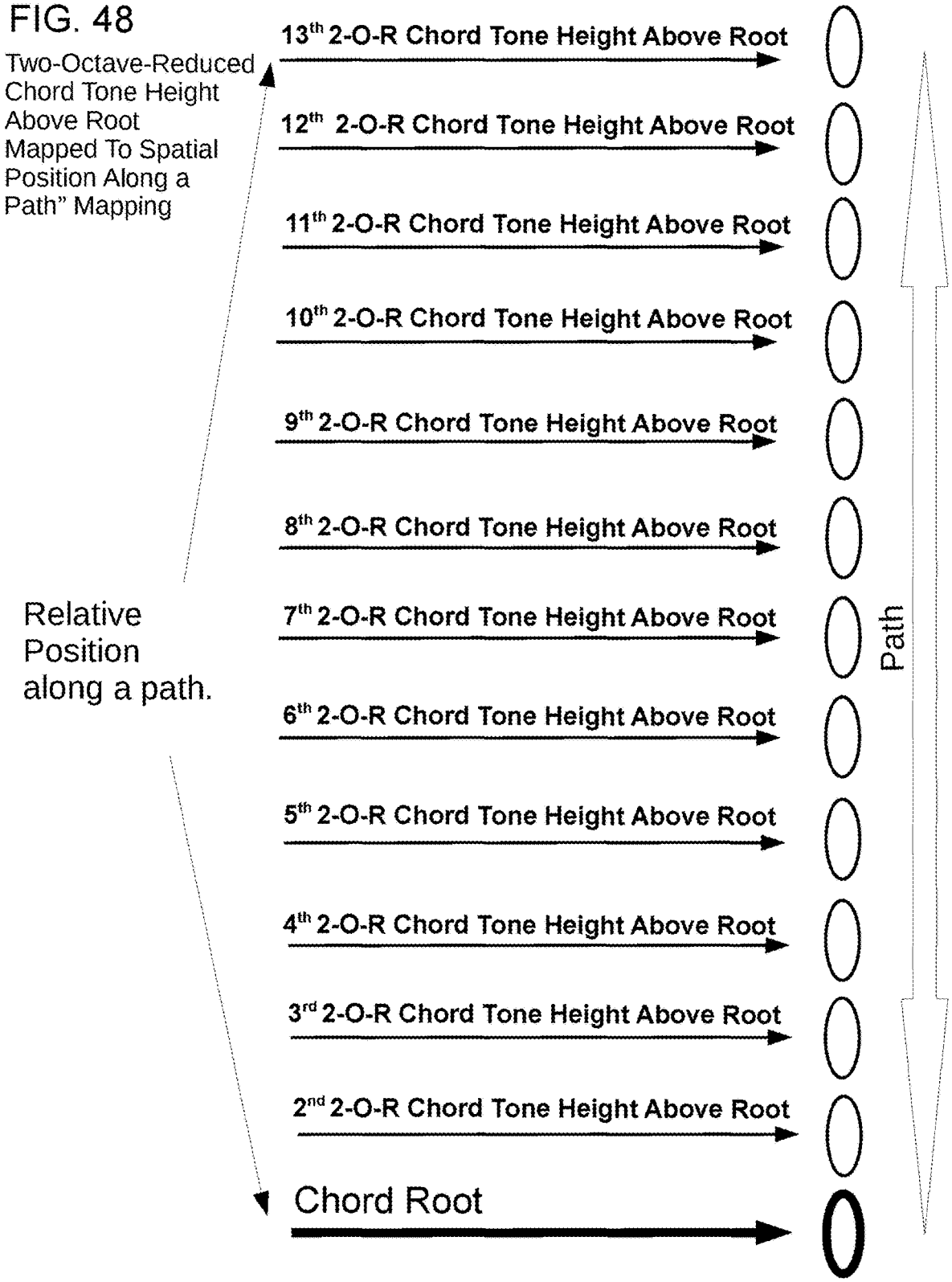
FIG. 48 illustrates a mapping procedure wherein a two-octave-reduced chord tone height above the chord root is mapped to a spatial position along a path

FIG. 48 illustrates the mapping procedure for music chord tones, wherein two-octave-reduced chord tone height above the chord root is mapped to spatial position along a path. (It should be understood that 2-octave-reduction uses stacked thirds chord theory in which the ninth, eleventh, and thirteenth are mapped to the second octave, etc., regardless of the existing chord inversion or voicing). This is in essence as a method for converting the output from the mapping procedure shown in FIG. 47 into a root position visual voicing—which can be used to strengthen the harmonic pull, such as for emphasis, at appropriate times in a hue sequence. In one embodiment of the present invention an inversion of a musical chord is reduced into 2-octave format, and the sequence of chord tones of this format, from low to high, are mapped to spatial position along a path in a color object array. For example E4, C5, G5, D6 (An inversion of a C Major add 9 chord) is 2-octave-reduced and becomes C, E, G, D (C, E, and G are in the first octave of the 2-octave-reduced chord, and D [the ninth of the chord] is in the 2nd octave). Therefore the hue notes for the series C, E, G, D are mapped (often in unbroken series, but occasionally so as to follow some weighting algorithm that best maintains the music note's voice leading) to color objects along a path in a color object array.

Figure 49:
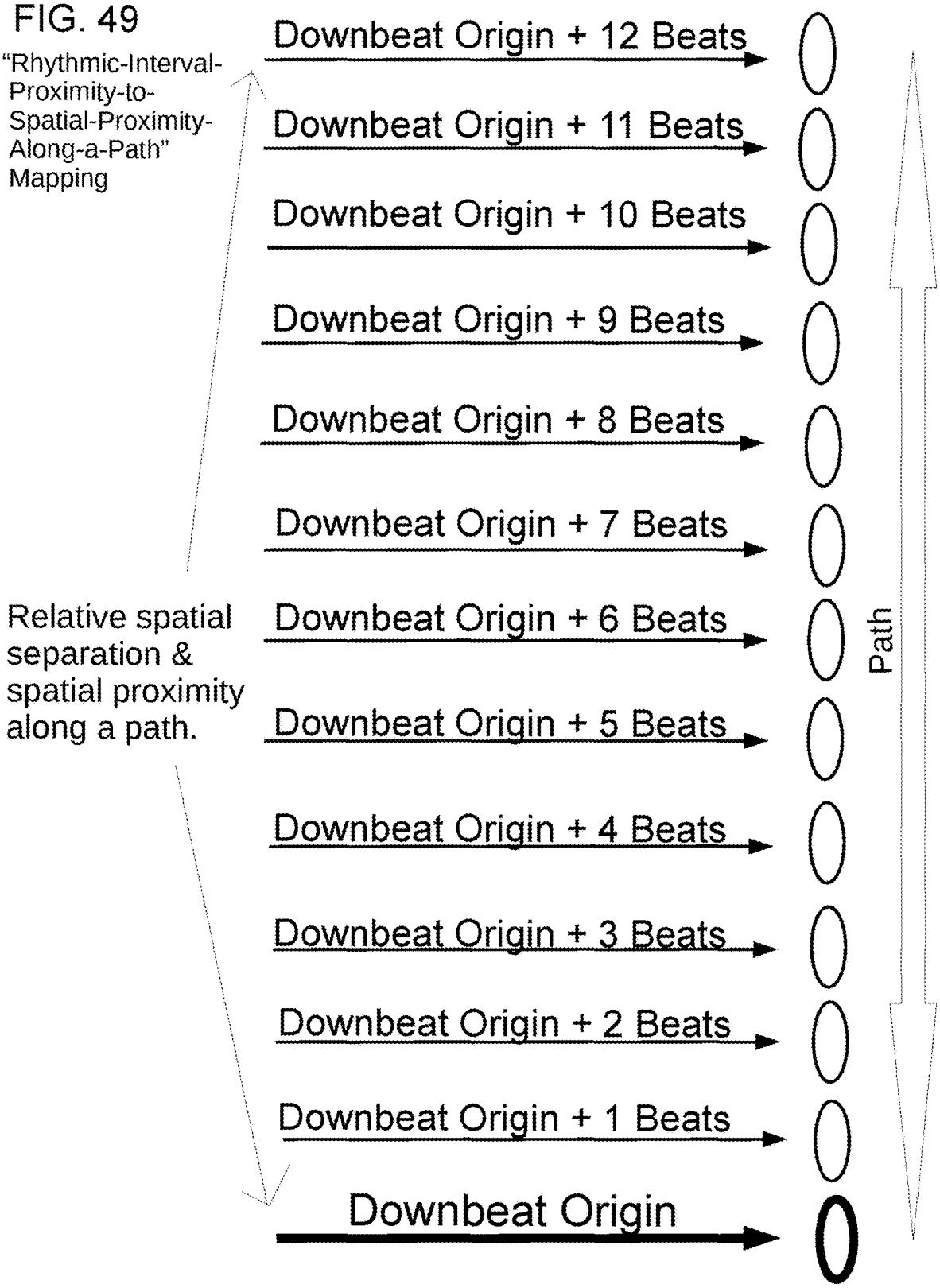
FIG. 49 illustrates a mapping procedure for mapping a music note event's musical rhythmic interval position (and thus proximity in time or beat) to a spatial position along a path or its proximity to other hue notes along a path.
Figure 50:
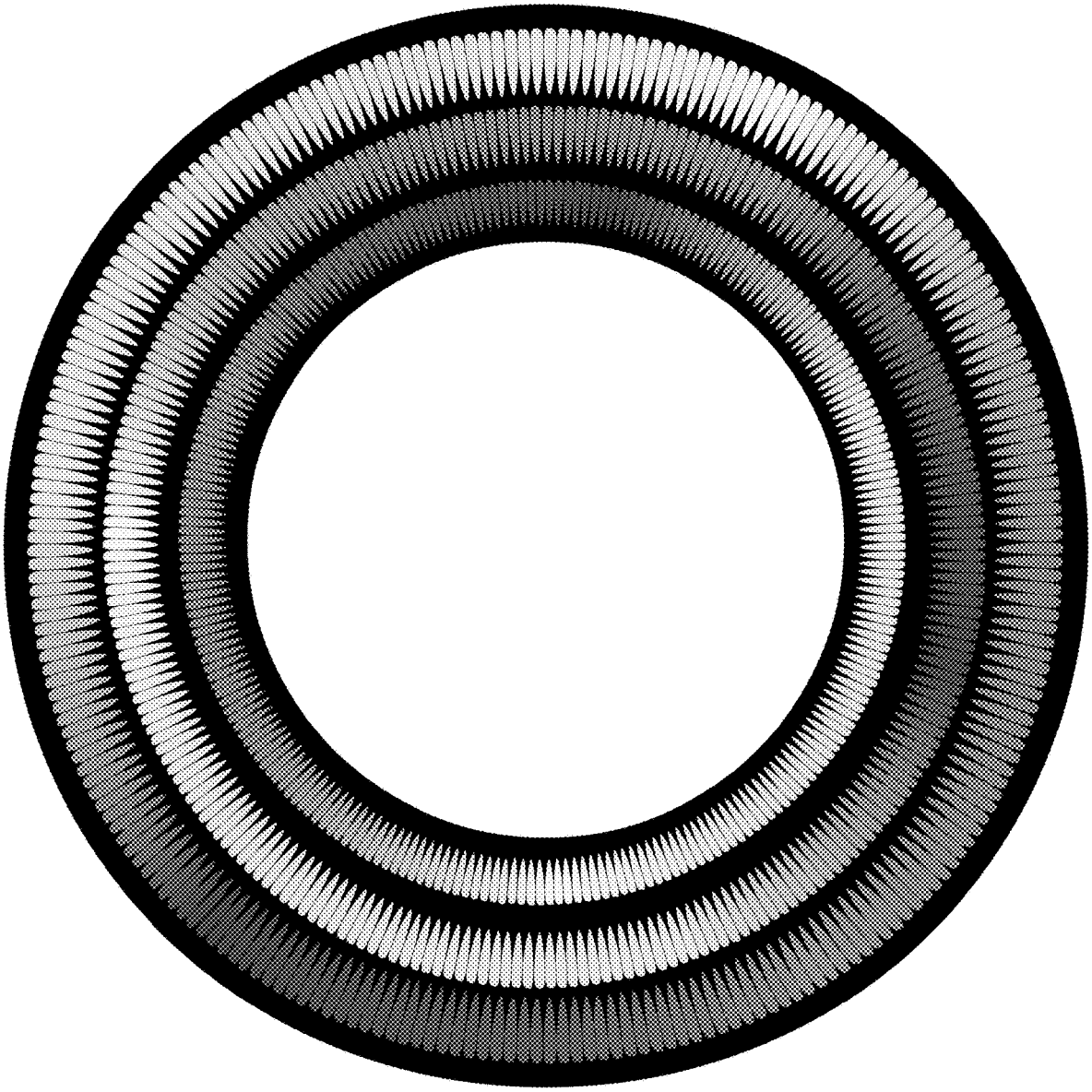
FIG. 50 illustrates a 240-hue resolution thiNC interface displaying the result for a chord comprising a major triad chord.
Figure 51:
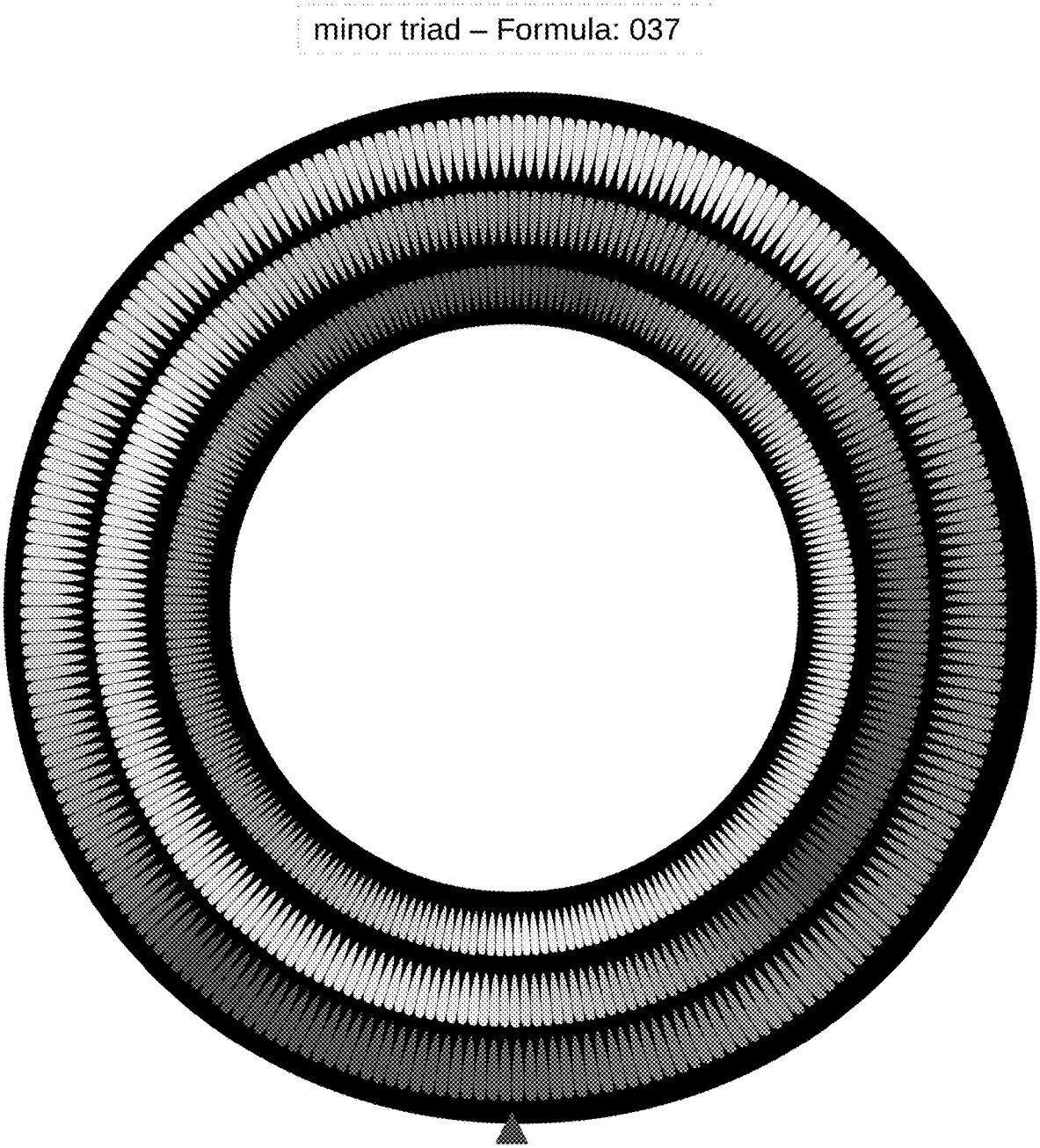
FIG. 51 illustrates a 240-hue resolution thiNC interface displaying the result for a chord comprising a minor triad.
Figure 52:
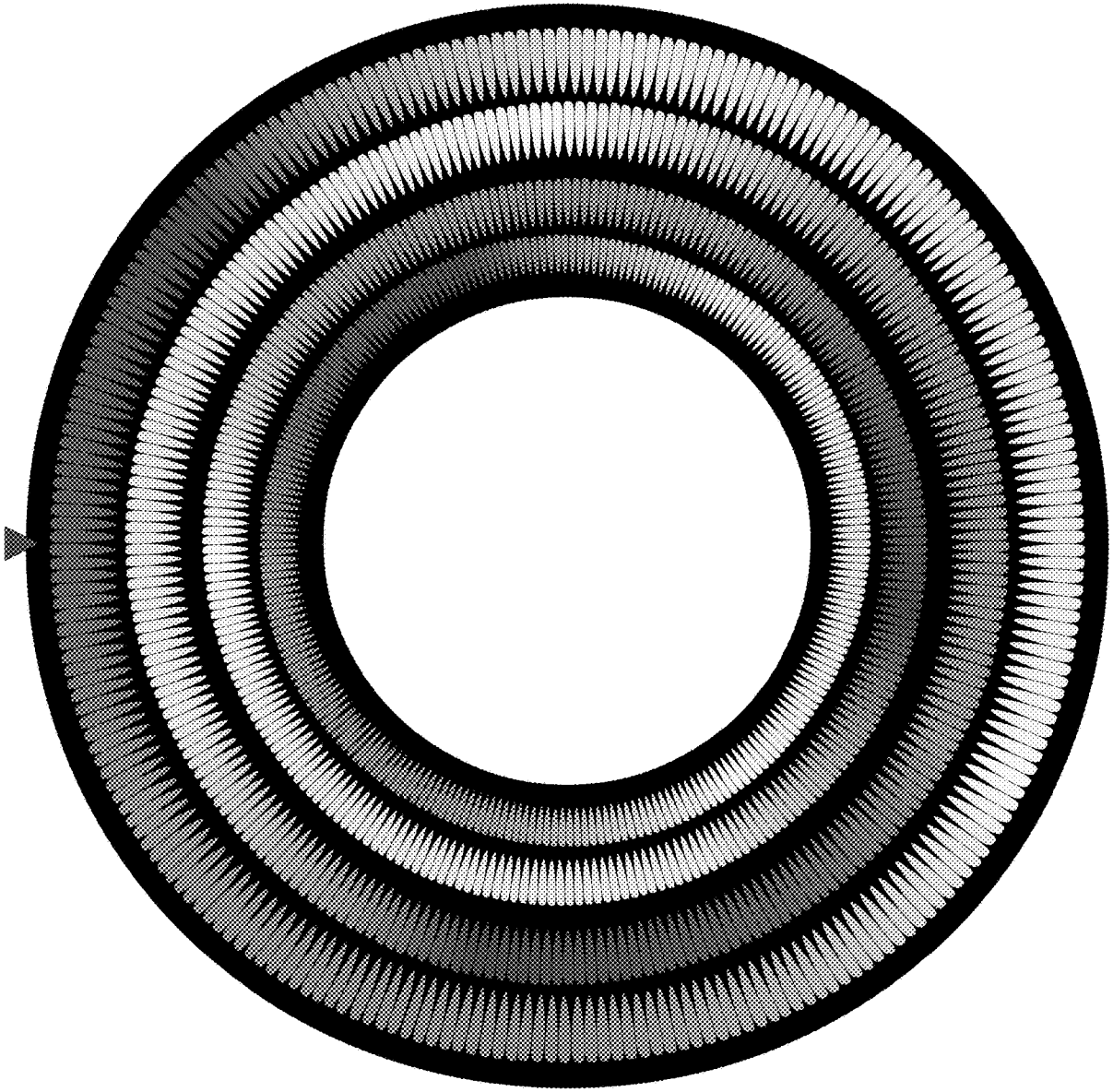
FIG. 52 illustrates a 240-hue resolution thiNC interface displaying the result for a chord comprising a major 7th chord.
Figure 53:
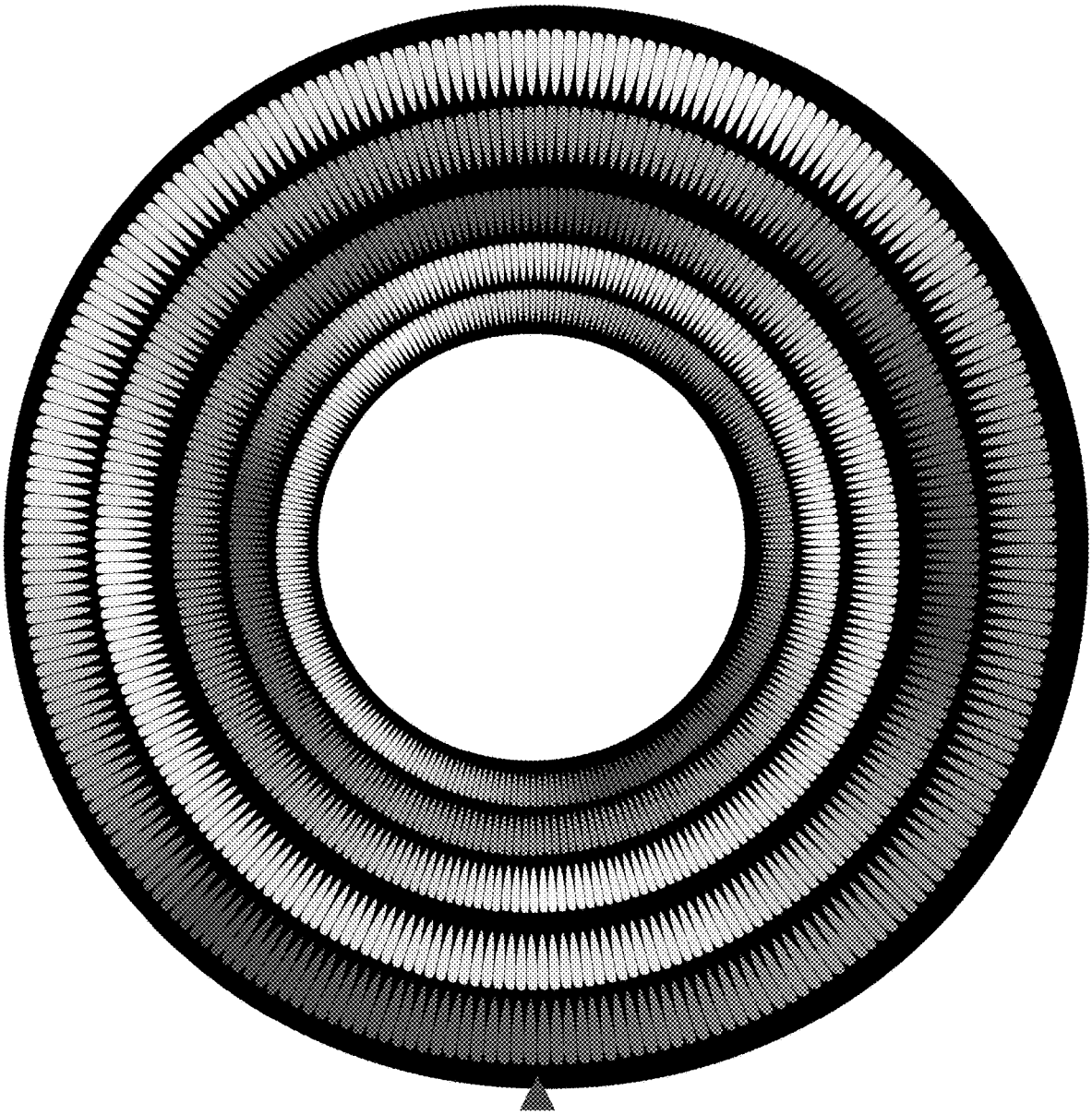
FIG. 53 illustrates a 240-hue resolution thiNC interface displaying the result for a chord comprising a dominant 9th chord.
Figure 54:
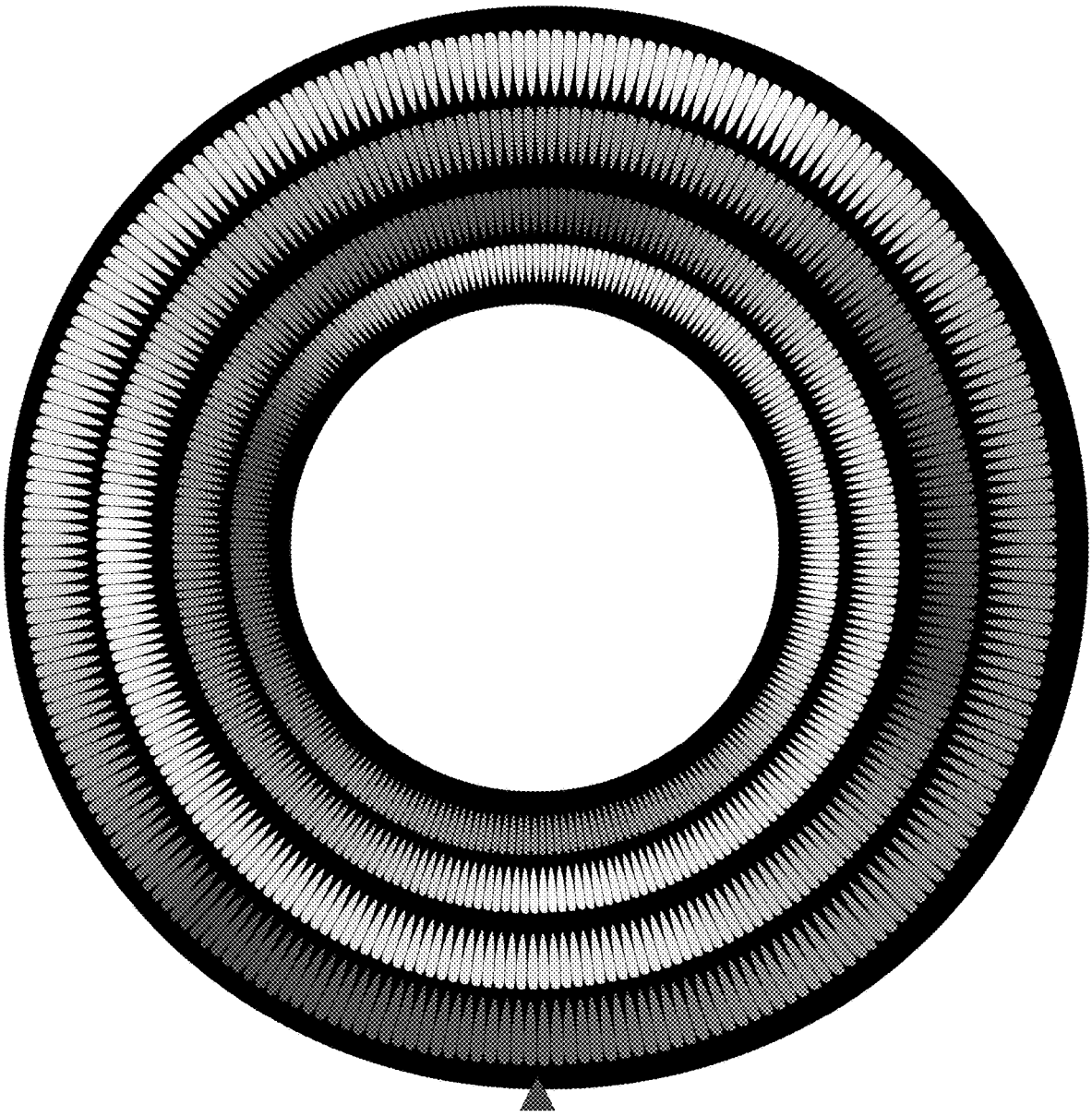
FIG. 54 illustrates a 240-hue resolution thiNC interface displaying the result for a chord comprising a Dominant 7.sup.th chord with a tuned 3.sup.rd and "barbershop" 7.sup.th.

FIG. 49 illustrates the mapping of the music note event's relative musical rhythmic interval position (and thus proximity in time or beat) to relative spatial position along a path, or to proximity (relative closeness) to other hue notes along a path (e.g. as quantized per milliseconds; or e.g. as quantized per the current estimated tempo, such as per triplet 64ths of the current estimated tempo). Positions and proximities can be recyclable, such as by detecting repeating accents, using a circular path, etc.

In one embodiment of the present invention the music note event's relative musical rhythmic interval position is mapped to relative spatial position along a path. In one embodiment of the present invention the music note event's rhythmic closeness determines the hue note's spatial closeness.

FIGS. 50-54 comprise 240-Res thiNC interface examples of a variety of hue chords of different chord categories such as major (FIG. 50); minor (FIG. 51); major 7.sup.th (FIG. 52); dominant 9th (FIG. 53); and a dominant 7.sup.th with a tuned 3.sup.rd and barbershop 7.sup.th (FIG. 54). altered dominant, and fourths chords, along with a few examples of chords with hue intervals tuned in more purity than exists in 12-ET, including 'barbershop chord' hue chord examples.

In one embodiment the system is a color-in color-out system 1100. FIG. 55 shows an exemplary color-in color-out system, which is comparable to FIG. 1 except that the input is a hue-interval-comprised-data receiving device 1120, which can be a digital camera or colorimetry device (such as a spectrophotometer or colorimeter), with this device's output analyzed relative to PHI. In the case of FIG. 55 the data is processed through a bus 1110 by a processing unit 1130 in main memory 1140 containing 1150 which is a Hue Interval Feeding Process, and 1160 which is a Music-Harmony-To-Color-Harmony Software Module Comprised Of At Least One Mu sic-to-Hue (m2h) into histogram data that represent hue peaks in PHI, and their intensity (and if desired along with perceived purity based on an appropriate representative viewer position). Then this combination of peaks and intensity (and if desired also purity) may be interpreted as if it were music interval and amplitude (and if desired also purity) information. The m2h index may be thought of in reverse, with hue being the input and musical intervals being the output. Utilizing a color output device adapter 1170, the color output device 1180 can output the color intervals in text via screen or printer, or in light by way of a lighting device or display screen, or in pigment, by way of a printer, etc.

Application examples would be to take a digital camera photograph of a person's eyes, hair and skin, interpret these as music intervals, and determine the complementary hue intervals based on music theory, or determine "hue intervals to avoid" based on music theory. "Hue intervals to avoid" can be colors producing unpleasing hue chords, based on music theory. One may wish to avoid wearing colors that produce a set of augmented or diminished hue intervals, including when taking into account the eyes, hair, and skin. "Hue intervals to avoid" can also be those hue intervals that would tend to focus or strengthen the awareness of a viewer upon other hue intervals that should more appropriately be de-emphasized. The system can be used to notify a person of this regarding their personal beautification choices. For example certain yellow and green tones can be disadvantageous as skin tones in personal appearance. And wearing these in makeup or clothing, or wearing certain other hue intervals (particularly a P5 away but also a hue Major or hue minor 3rd away) may emphasize these to others that see this person, making this person appear pale. For example the software can warn a person not to wear a specific blue hue interval that is a P5 from those yellow or yellow-green tones one wishes to avoid, and instead suggest wearing another blue hue interval that instead theoretically may "bring out" (e.g. by being itself a P5 away from them) other hues in the skin tone that suggest health (e.g. warmer or more ruddy hues).

In one embodiment the system is a color-in music-out system 1200. FIG. 56 shows an exemplary color-in music-out system, which is comparable to FIG. 1 except that the input is a hue-interval-comprised-data receiving device 1220, which can be a digital camera or colorimetry device (such as a spectrophotometer or colorimeter), with this device's output analyzed relative to PHI In the case of FIG. 56 the data is processed through a bus 1210 by a processing unit 1230 in main memory 1240 containing 1250 which is a Hue Interval Feeding Process, and 1260 which is a Music-Harmony-To-Color-Harmony Software Module Comprised Of At Least One Music-to-Hue (m2h) into histogram data that represent hue peaks in PHI, and their intensity (and if desired along with perceived purity based on an appropriate representative viewer position). Then this combination of peaks and intensity (and if desired also purity) may be interpreted as if it were music interval and amplitude (and if desired also purity) information. The m2h index may be thought of in reverse, with hue being the input and musical intervals being the output. Utilizing a color output device adapter 1270, the music output device 1280 can output the resulting music intervals in text or music notation via screen or printer, or in audio by way of a series of music reproduction device (using music protocol, e.g. MIDI, or synthesized MIDI to audio) producing a sound file or a music output event on speakers.

Music-Interval-Like Hue Interval Storing & Re-Use

In one embodiment music-interval-like hue intervals, as are derived by the present method, may be stored and re-used.

In one embodiment such music-interval-like hue interval data can have music-like transposition methods applied to it.

In one embodiment music-interval-like hue interval data may include a music tonic and a hue tonic, as well as hue chord roots.

Note that while hue chord roots may simply be the same as their source music chord roots, however because a music tonic and a hue tonic are different constructs, the subject of designated music tonics within the music-interval-like hue data requires clarification. So we must point out that the meaning of "music tonic" is "the tonic that exists for a set of music intervals or music-interval-like hue intervals by reason of music theory".

Sometimes in music a progression is described generically, for instance as an ii-V-I progression. This description is possible because of the ability of music theory methods to enable recognition, irrespective of the chord inversions used in the voicings, that certain interval constructs perform certain functions. Two fundamental such interval construct functions are the function of the chord root and the function of the music tonic. (Probability weighting can be assigned when these functions are found not to be definite, as in the case of the chord C6 which can be difficult to distinguish between Am7 in some musical contexts, so what we will call herein the "rooting strength" of the comprised intervals of the chord can weighted. A weighting process could examine the octave-reduced intervals as if each one were the chord root in turn, and see which interval construct was most strengthening or least defeating of that particular root. If a weighting algorithm is constructed properly the pitches "C" and "A" should inevitably come out higher in the weighting that the other intervals, and a "tie breaker" approach is recommended if the rooting strengths of "C" and "A" are precisely equal. So that if there is a "tie" between these two pitches then the lower of the two pitches, in its non-octave-reduced form, will be chosen as the strongest root [the potential root with the most pull]). See the example rooting strength evaluation method below for a slightly fuller example. The present invention makes such determined or weighted music tonics and such determined or weighted chord roots applicable to color harmony theory. In the case of the generic ii-V-I progression mentioned above, the root of the I chord will be the music tonic. In music this progression can be musically transposed so that this music tonic can be any pitch. Similarly in the method of the present invention, when made into music-interval-like hue intervals, this music tonic can be any hue—but this root of the I chord remains the music tonic. The hue chosen (by system or user) is what is meant by the term 'hue tonic'. (Perhaps the term 'hue tonic' could be replaced by the term 'chosen hue key root'.) But regardless of this decision to transpose the progression so as to have different hue tonics, the 'music tonic' remains the generic music-interval-like hue interval structure tonic, with its certain intervallic relationship to the other generic hue intervals; so the music-interval-like hue intervals may include both a designated music tonic and a hue tonic. (Of course it may include neither).

Example—Rooting Strength Evaluation Method, for Chords and Arpeggios

Weightings for intervals given are examples only. (Evaluate the chord (set of chord tones) by testing each chord tone as a "test root", i.e. as if it could be the chord root, finding intervals in the CRVI table, then pulling the weights for each "found interval" from the CRWI table below.

TABLE-US-00003

| 'Chord Interval From Test Root' Valuation Index (v8/31) [aka CRVI] | | | | | | | | | | | | |
|---|---|---|---|---|---|---|---|---|---|---|---|---|
| 0 | 7 | 4 | b | 2 | 9 | 5 | 1 | 3 | 6 | 8 | a | b |
| | 6 | 3 | a | 1 | 8 | 6 | | | | | | |
| | 8 | 5 | | 3 | | | | | | | | |

TABLE-US-00004

| 'Chord Interval From Test Root' Weight Index (v9/14) [aka CRWI] | | | | | | | | | | | | |
|---|---|---|---|---|---|---|---|---|---|---|---|---|
| 0 | 36 | 24 | 18 | 12 | 6 | 0 | −6 | −12 | −18 | −24 | −36 | −36 |
| | 24 | 18 | 12 | 6 | 0 | −6 | | | | | | |
| | 18 | 12 | | 0 | | | | | | | | |

Procedure:

Values in the table are {0, 1, 2, . . . , 9, a, b}, for the 12 semitones of the octave (a and b symbolize 10 and 11, and act as such in any formulae below)

(an empty cell indicates 'skip cell' 'do not use for lookup and weighting')

In the following description, row & column position valuation results found in the CRVI give the positions where the weighting results will be found in the CRWI table.

Access CRVI with octave-reduced note values of a note group [chord, arpeggio, . . . ], using each octave-reduced note value as a test root; so for e.g. for the first test root, finding all the octave-reduced intervals for that note group and looking them up in CRVI (to find its weight location in CRWI) and CRWI (for a weighting for each interval, adding all the interval weights together in the process), finding a total test root weight from the addition of all the interval weights for that test root, then do the same for the 2nd test root, finding a total test root weight for the 2nd test root, etc. until all note values have been given a total test root weight for them.

E.g. start at top left cell and check if that interval exists relative to the present test root. For each interval that exists in the set of chord tones, cumulate its value from CRWI (in the respective cell) into the weighting for the test root until the table is read through as in the following description. If an interval does not exist, go to the cell below and see if that related interval exists. (E.g. if no P5 exists, only then check below to see if a #5 or b5 exists; if no Major 3rd exists, only then check below to see if a minor third or suspended third exists; if no major seventh exists, only then check if a minor seventh exists; if no ninth exists, only then check if a b9 or #9 exists, etc.) After either finding the interval in the top cell, or one of the intervals in the cells below it, or exhausting all the cells with values in them in that column, proceed to the next column to the right and do the same.

Once all chord tones are looked up for their interval weights in CRWI, and their weights are cumulated into a total, find the test root with the highest total test root weight. If there is a tie between multiple test roots, take the test root that is the chord tone that is lowest in terms of its non-octave-reduced pitch, and add 10, making it the strongest root.

This procedure is not only for finding a (presumably) most likely chord root, but it results in a set of rooting strength weights for every chord tone in the set of chord tones.

In one embodiment the music-interval-like hue interval data, as per the m2h index, is incorporated into DVS (Digital Vinyl System) data and media, allowing a light show sequence, one that corresponds to the intervals received by the music-interval-comprised-data receiving device, to be played and controlled via a DVS turntable. This light show (that corresponds to the music intervals received by the music-interval-comprised-data receiving device as a source music sequence) can be displayed on a color output device while synchronized to playback of its source music sequence; or it can be synchronized to music output that has been creatively manipulated from the source music sequence (and as long as it maintains a fair amount of correspondence with that source music sequence it may remain desirable as a light show product). The tempo of both the light show sequence and the source music sequence can be altered while synchronized to one another. By a setting in the software, the tempo shifting (which will normally shift musical pitch) can be allowed to shift hue in the corresponding manner; or not. Meanwhile, by a setting in the software, while leaving tempo alone, either the hue intervals or the music intervals may be transposed without transposing the other.

If the source music sequence is being output as music protocol data, as into a MIDI instrument, then transposition simply involves moving the set of intervals up or down in pitch. If the source music sequence is being output as an audio file then transposing the intervals is accomplished by algorithmically shifting the notes up or down by stretching or shrinking the duration, but this basic manipulation by stretching or shrinking changes both duration and pitch. Duration and pitch can be altered independently using more advanced algorithms such as those by zplane's Elastique, and Serato.

In one embodiment the music-interval-like hue interval data is chemically printed or formulated into a circular lens that can be rotated on a turntable platter (like a record player platter) to affect at least one fibre optic light strand, as the color output device (as to serve for lighting on a Christmas tree).

Various embodiments of the invention have been described and illustrated; however, the description and illustrations are by way of example only. Other embodiments and implementations are possible within the scope of the invention and will be apparent to those of ordinary skill in the art. Therefore, the invention is not limited to the specific details of the representative embodiments and illustrated examples in this description. Accordingly, the invention is not to be restricted except as necessitated by the accompanying claims and their equivalents.

What is claimed is:

1. A system for generating color sets based on concepts of musical harmony, the system comprising:

an input device configured to receive pitch interval data; a computer processing unit configured to execute software instructions; a computer memory storing software instructions configured to be executed by the computer processing unit, the software instructions including a pitch analysis module for identifying pitches and pitch intervals within pitch interval data received by the input device, and a music-harmony-to-color-harmony module that executes at least one music-to-hue process that identifies one or more color sets based on one or more pitch intervals identified in the pitch interval data; and a color output device configured to generate one or more color objects having a hue belonging to a color set identified by the music to hue process characterized in that the music harmony to color harmony module includes a music to hue index that defines a spectrum-like tuned hue gradient that includes a plurality of discrete dominant-wavelength hue notes, a plurality of shorter wavelength ends, and a plurality of longer wavelength end wavelengths of the tuned hue gradient ordered according to a dominant wavelength associated with each discrete dominant-wavelength hue note in the plurality of discrete dominant-wavelength hue notes, and a relatively smaller plurality of interpolated hue notes which include varying amounts of color from each of a shorter wavelength end and a longer wavelength end of the spectrum-like tuned hue gradient to provide a smooth color transition between the plurality of discrete dominant wavelength hue notes and the plurality of interpolated hue notes, wherein each hue note, both dominant wavelength and interpolated hue notes, is assigned an associated unique position in a modular mapping and a unique tuned hue interval variable such that each hue note corresponds to the associated unique position in the modular mapping.

2. The system for generating color sets of claim 1 configured to apply a functional correspondence wherein each hue note, both dominant wavelength and interpolated hue notes, is assigned a unique tuned hue interval variable and a unique tuned hue interval angle between 0 degree and 360 degree such that each hue note corresponds to a unique position around a tuned hue chromatic circle or in graph form or in table form.

3. The system for generating color sets of claim 2 wherein the at least one music to hue process includes:

identifying a pitch interval received by the input device, the pitch interval including a bottom pitch and a top pitch;

identifying an interval angle associated with the pitch interval, associating a first hue note with the bottom pitch;

identifying a second hue note separated from the first hue note by a tuned hue interval angular amount equal to a pitch interval angle associated with the pitch interval; and providing the tuned hue interval variables associated with the first and second hue notes to the output device.

4. The system for generating color sets of claim 3 further comprising:

an electronic memory device, and wherein the at least one music to hue process includes storing pitch interval data including the bottom pitch, the top pitch, the pitch interval angle and the tuned hue interval variables on the electronic memory device.

5. The system for generating color sets of claim 3 wherein the at least one music to hue process is configured to transpose the color first hue note from a first color key to a second color key by associating a third hue note with the bottom pitch and adding an offset angle to the unique tuned hue interval angle assigned to each hue note, the offset angle being equal to an angular separation between the first hue note and the third hue note.

6. The system for generating color sets of claim 2 further comprising:

an interface including a display configured to display: a pitch chromatic circle having a plurality of pitch classes evenly distributed about the circumference of the pitch chromatic circle corresponding to one musical octave, each pitch class being associated with a pitch angle; and a tuned hue chromatic circle co-centered with the pitch chromatic circle.

7. The system for generating color sets of claim 6 wherein the interface display is further configured to display one or more additional tuned hue chromatic circles co-centered with the pitch chromatic circle, each of the tuned hue chromatic circles having a different diameter such that the tuned hue chromatic circles appear nested within one another.

8. The system for generating color sets of claim 7 wherein the at least one music to hue process includes:

identifying a pitch tonic and a hue tonic;

identifying a first pitch interval and a second pitch intervals corresponding to a musical chord received by the input device, the first pitch interval including a chord root pitch and a first top pitch, the second pitch interval including the chord root pitch and a second top pitch;

identifying a root interval angle between the pitch tonic and the chord root pitch, a first interval angle between the chord root pitch and the first top pitch, and a second interval angle between the chord root pitch and the second top pitch;

displaying a first tuned hue chromatic circle with the hue tonic rotated away from the pitch tonic by an angle equal to the root interval angle;

displaying a second tuned hue chromatic circle with the hue tonic rotated away from the pitch tonic by an angle equal to the root interval angle plus the first interval angle between the chord root pitch and the first top pitch;

displaying a third tuned hue chromatic circle rotated relative to the first tuned chromatic circle with the hue tonic rotated away from the pitch tonic by an angle equal to the root interval angle plus the second interval angle between the chord root pitch and the second top pitch; and selecting a color set including radially aligned hue notes from the first, second and third tuned hue chromatic circles.

9. The system for generating color sets of claim 1 wherein the color output device comprises a plurality of lights having selectable multi-color lenses.

10. The system for generating color sets of claim 9 wherein the plurality of lights includes one or more lights of different sizes.

11. A method of generating color objects sent to a plurality of color output devices based on music theory, comprising:

establishing a hue index with a mapped correspondence by defining a spectrum-like tuned hue gradient that includes a plurality of discrete dominant-wavelength hue notes ordered according to a dominant wavelength associated with each dominant wavelength hue note and a relatively smaller plurality of interpolated hue notes which include varying amounts of color from each of a shorter wavelength end and a longer wavelength end of the spectrum-like tuned hue gradient to provide a smooth hue transition between the plurality of discrete dominant wavelength hue note and the plurality of interpolated hue notes, wherein each hue note, both dominant wavelength and interpolated hue notes is assigned an associated unique position in a modular mapping and a unique tuned hue interval variable such that each hue note corresponds to the associated unique position in the modular mapping;

executing a music to hue process for identifying pitches and pitch intervals within pitch interval data, identifying on the hue index one or more color sets based on one or more pitch intervals identified in the pitch interval data; and sending the plurality of color sets to the plurality of color output devices.

12. The method of claim 11, wherein the mapped correspondence associates decreasing successive musical pitch wavelength with successive increasing dominant wavelength of approximate linearity.

13. The method of claim 11, further comprising:

generating the mapped correspondence between a plurality of pitch classes, each pitch class separated by a predetermined frequency ratio and forming an octave, and a plurality of hue notes comprising the spectrum-like tuned hue gradient, wherein the pitch classes form a music chromatic circle of angles, and the hue notes of the spectrum-like tuned hue gradient form a hue chromatic circle of angles.

14. The method of claim 13, further comprising:

designating a pitch class as a pitch class starting point on the music chromatic circle of angles;

designating a hue as a hue starting point on the hue chromatic circle of angles;

receiving a music note;

determining an angle from the pitch class starting point to the music note; and utilizing the angle to find a hue note on the hue chromatic circle of angles.

15. The method of claim 14, further comprising:

determining an angle from the pitch class starting point to the music note;

utilizing the angle to find a hue note on the hue chromatic circle of angles; and utilizing pitch interval data frequency to determine the size of a plurality of color objects to be output on the plurality of color output devices.

16. The method of claim 11, further comprising:

classifying the pitch interval data into a plurality of chord roots with a corresponding plurality of chord root color sets and a plurality non-chord roots with a corresponding plurality of non-chord root color sets; and sending the plurality of chord root color sets to the plurality of color output devices.

17. The method of claim 16, wherein the plurality of chord root color sets are at least 5 percent more spatially expansive than the non-chord root color sets.

18. The method of claim 16, further comprising:

sending the plurality of chord root color sets to the plurality of color output devices so that the plurality of chord root color sets is sustained until a next chord is detected.

19. The method of claim 11, further comprising:

determining non-octave-reduced relative pitch locations for a plurality of pitches in the pitch interval data;

recording relative pitch location data from the plurality of pitches to the plurality of color sets; and displaying the plurality of color sets so that the relative pitch locations of the plurality of pitches correspond to the location of the color sets displayed on the plurality of color output devices.

20. The method of claim 11, further comprising:

displaying a plurality of color sets so that relative pitch locations of the plurality of pitches correspond to the location of the color sets displayed on the plurality of color output devices.

21. The method of claim 11, wherein the plurality of discrete dominant-wavelength hue notes progress in linearly increasing dominant wavelength spans and correspond with a series of musical semitones that successively increase by approximately 1.05946 . . . :1 and wherein the hue notes successively increase an average of 20-23 nm, and are subdivisible into hue cents corresponding with musical cents, but that successively increase by wavelength amounts averaging between 0.20-0.23 nm.

* * * * *